US011263879B2

(12) United States Patent
Biggs

(10) Patent No.: US 11,263,879 B2
(45) **Date of Patent: *Mar. 1, 2022**

(54) TACTILE TRANSDUCER WITH DIGITAL SIGNAL PROCESSING FOR IMPROVED FIDELITY

(71) Applicant: Taction Technology, Inc., Los Gatos, CA (US)

(72) Inventor: Silmon James Biggs, Los Gatos, CA (US)

(73) Assignee: Taction Technology, Inc., Los Gatos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/797,411

(22) Filed: Feb. 21, 2020

(65) Prior Publication Data

US 2020/0372766 A1 Nov. 26, 2020

Related U.S. Application Data

(63) Continuation of application No. 16/501,601, filed on May 6, 2019, now Pat. No. 10,573,139, and a continuation-in-part of application No. 15/268,423, filed on Sep. 16, 2016, now Pat. No. 10,390,139.

(60) Provisional application No. 62/762,443, filed on May 7, 2018, provisional application No. 62/219,371, filed on Sep. 16, 2015.

(51) Int. Cl.

| | |
|---|---|
| ***G08B 6/00*** | (2006.01) |
| ***H04R 1/10*** | (2006.01) |
| ***H04R 3/04*** | (2006.01) |

(52) U.S. Cl.
CPC ..... *G08B 6/00* (2013.01); *H04R 1/1008* (2013.01); *H04R 1/1091* (2013.01); *H04R 3/04* (2013.01); *H04R 2400/03* (2013.01)

(58) Field of Classification Search
None
See application file for complete search history.

(56) References Cited

U.S. PATENT DOCUMENTS

| | | | |
|---|---|---|---|
| 3,919,607 | A | 11/1975 | Habock et al. |
| 4,017,694 | A | 4/1977 | King |
| 5,296,790 | A | 3/1994 | Fincher |
| 5,621,293 | A | 4/1997 | Gennesseaux |
| 5,717,767 | A | 2/1998 | Inanagam et al. |

(Continued)

FOREIGN PATENT DOCUMENTS

| | | |
|---|---|---|
| AU | 2013203626 | 5/2013 |
| CA | 2 808 716 | 3/2012 |

(Continued)

OTHER PUBLICATIONS

International Search Report, Application No. PCT/US2015/051888, dated Sep. 24, 2015.

(Continued)

*Primary Examiner* — Paul W Huber
(74) *Attorney, Agent, or Firm* — Knobbe, Martens, Olson & Bear, LLP

(57) ABSTRACT

The apparatus and methods of the present invention provide improved accuracy of response for a tactile transducer included in a body-mounted device such as a headphone, VR/AR headset or similar device. Accuracy is increased through the application of digital signal processing, such as with Infinite Impulse Response filters or Finite Impulse Response filters.

20 Claims, 61 Drawing Sheets

(56) References Cited

U.S. PATENT DOCUMENTS

| | | | |
|---|---|---|---|
| 5,783,899 | A | 7/1998 | Okazaki |
| 5,921,149 | A | 7/1999 | Masberg et al. |
| 6,023,515 | A | 2/2000 | McKee et al. |
| 6,603,863 | B1 | 8/2003 | Nagayoshi |
| 7,071,584 | B2 | 7/2006 | Kawano et al. |
| 8,097,988 | B2 | 1/2012 | Kim et al. |
| 8,134,259 | B2 | 3/2012 | Choi |
| 8,242,642 | B2 | 8/2012 | Odajima et al. |
| 8,253,282 | B2 | 8/2012 | Park |
| 8,398,570 | B2 | 3/2013 | Mortimer et al. |
| 8,400,027 | B2 | 3/2013 | Dong et al. |
| 8,461,728 | B2 | 6/2013 | Park et al. |
| 8,492,938 | B2 | 7/2013 | Park |
| 8,502,864 | B1 | 8/2013 | Watkins |
| 8,598,750 | B2 | 12/2013 | Park |
| 8,669,679 | B2 | 3/2014 | Lee et al. |
| 8,767,996 | B1 | 7/2014 | Lin |
| 8,797,295 | B2 | 8/2014 | Bernstein et al. |
| 8,860,262 | B2 | 10/2014 | Kim et al. |
| 8,860,263 | B2 | 10/2014 | Yoon |
| 8,892,233 | B1 | 11/2014 | Lin et al. |
| 8,963,695 | B2 | 2/2015 | Johnson et al. |
| 8,977,376 | B1 | 3/2015 | Lin |
| 9,106,986 | B2 | 8/2015 | Shen |
| 9,107,011 | B2 | 8/2015 | Broadley |
| 9,110,536 | B2 | 8/2015 | Sorvisto et al. |
| 9,201,458 | B2 | 12/2015 | Hunt et al. |
| 9,263,983 | B2 | 2/2016 | Miyazaki |
| 9,277,320 | B1 | 3/2016 | Hoskins |
| 9,277,334 | B1 | 3/2016 | Wong |
| 9,306,429 | B2 | 4/2016 | Akanuma et al. |
| 9,312,744 | B2 | 4/2016 | Akanuma et al. |
| 9,430,921 | B2 | 8/2016 | Biggs |
| 9,535,501 | B1 | 1/2017 | Moussette et al. |
| 9,548,646 | B2 | 1/2017 | Park et al. |
| 9,590,463 | B2 | 3/2017 | Kuroda et al. |
| 9,594,429 | B2 | 3/2017 | Bard et al. |
| 9,608,506 | B2 | 3/2017 | Degner et al. |
| 9,630,213 | B2 | 4/2017 | Odajima et al. |
| 9,652,040 | B2 | 5/2017 | Martinez et al. |
| 9,680,672 | B2 | 6/2017 | Hajati et al. |
| 9,748,827 | B2 | 8/2017 | Dong |
| 9,815,085 | B2 | 11/2017 | Chun |
| 9,830,782 | B2 | 11/2017 | Morrell et al. |
| 9,850,957 | B2 | 12/2017 | Lee et al. |
| 9,928,950 | B2 | 3/2018 | Lubinski et al. |
| 9,936,273 | B2 | 4/2018 | Biggs |
| 9,966,825 | B2 | 5/2018 | Hajati et al. |
| 10,069,392 | B2 | 9/2018 | Degner et al. |
| 10,108,265 | B2 | 10/2018 | Harley et al. |
| 10,126,817 | B2 | 11/2018 | Morrell et al. |
| 10,127,778 | B2 | 11/2018 | Hajati et al. |
| 10,218,250 | B2 | 2/2019 | Berrezag et al. |
| 10,236,760 | B2 | 3/2019 | Moussette et al. |
| 10,390,139 | B2 | 8/2019 | Biggs |
| 10,573,139 | B2 | 2/2020 | Biggs |
| 10,642,361 | B2 | 5/2020 | Kessler et al. |
| 10,651,716 | B2 | 5/2020 | Moussette et al. |
| 10,659,885 | B2 | 5/2020 | Biggs |
| 10,812,913 | B2 | 10/2020 | Biggs |
| 10,820,117 | B2 | 10/2020 | Biggs |
| 2002/0001392 | A1 | 1/2002 | Isono et al. |
| 2003/0015929 | A1 | 1/2003 | Lee |
| 2004/0155741 | A1 | 8/2004 | Godin |
| 2004/0251750 | A1 | 12/2004 | Cheung et al. |
| 2005/0189823 | A1 | 9/2005 | Backs |
| 2006/0045298 | A1 | 3/2006 | Westerkull |
| 2006/0171553 | A1 | 8/2006 | Wong et al. |
| 2006/0290662 | A1 | 12/2006 | Houston et al. |
| 2006/0293722 | A1 | 12/2006 | Slatkine et al. |
| 2007/0146317 | A1 | 6/2007 | Schena |
| 2007/0270196 | A1 | 11/2007 | Wu |
| 2007/0290988 | A1 | 12/2007 | Nogami et al. |
| 2008/0001483 | A1 | 1/2008 | Kitamura et al. |
| 2008/0090622 | A1 | 4/2008 | Kim |
| 2008/0096726 | A1 | 4/2008 | Riley |
| 2008/0194962 | A1 | 8/2008 | Randall |
| 2009/0036212 | A1 | 2/2009 | Provancher |
| 2009/0174266 | A1 | 7/2009 | Jajtic et al. |
| 2010/0046787 | A1 | 2/2010 | Aarts |
| 2010/0134225 | A1 | 6/2010 | Yajima et al. |
| 2010/0141408 | A1 | 6/2010 | Doy et al. |
| 2010/0316235 | A1 | 12/2010 | Park |
| 2011/0018365 | A1 | 1/2011 | Kim et al. |
| 2011/0018367 | A1 | 1/2011 | Kim et al. |
| 2011/0101896 | A1 | 5/2011 | Shikayama et al. |
| 2012/0025742 | A1 | 2/2012 | Masahiko |
| 2012/0027222 | A1 | 2/2012 | Kirsch |
| 2012/0032619 | A1 | 2/2012 | Kobayashi et al. |
| 2012/0062047 | A1 | 3/2012 | Nakagawa et al. |
| 2012/0163269 | A1 | 6/2012 | Shuster |
| 2012/0200021 | A1 | 8/2012 | Kanaya et al. |
| 2012/0237067 | A1 | 9/2012 | Asnes |
| 2012/0249797 | A1 | 10/2012 | Haddick |
| 2012/0293022 | A1 | 11/2012 | Park |
| 2013/0022220 | A1 | 1/2013 | Dong |
| 2013/0033126 | A1 | 2/2013 | Choi |
| 2013/0076652 | A1 | 3/2013 | Leung |
| 2013/0099600 | A1 | 4/2013 | Park |
| 2013/0113305 | A1 | 5/2013 | Choi |
| 2013/0204169 | A1 | 8/2013 | Poepperling et al. |
| 2013/0225915 | A1 | 8/2013 | Redfield et al. |
| 2013/0322676 | A1 | 12/2013 | Araki et al. |
| 2013/0339850 | A1 | 12/2013 | Hardi |
| 2013/0342521 | A1 | 12/2013 | Griffiths |
| 2014/0009005 | A1 | 1/2014 | Irwin |
| 2014/0056459 | A1 | 2/2014 | Oishi et al. |
| 2014/0064536 | A1 | 3/2014 | Kim et al. |
| 2014/0125558 | A1 | 5/2014 | Miyajima |
| 2015/0070274 | A1 | 3/2015 | Morozov |
| 2015/0081110 | A1 | 3/2015 | Houston et al. |
| 2015/0109223 | A1 | 4/2015 | Kessler et al. |
| 2015/0110277 | A1 | 4/2015 | Pidgeon |
| 2015/0123498 | A1 | 5/2015 | Yang et al. |
| 2015/0177899 | A1 | 6/2015 | Degner et al. |
| 2015/0181338 | A1 | 6/2015 | Hosoi et al. |
| 2015/0195663 | A1 | 7/2015 | Lin et al. |
| 2015/0214822 | A1 | 7/2015 | Kim et al. |
| 2015/0242608 | A1 | 8/2015 | Kim |
| 2015/0289034 | A1 | 10/2015 | Engman |
| 2015/0319546 | A1 | 11/2015 | Sprague |
| 2016/0056701 | A1 | 2/2016 | Lee et al. |
| 2016/0105089 | A1 | 4/2016 | Shi et al. |
| 2016/0173318 | A1 | 6/2016 | Ha |
| 2016/0181904 | A1 | 6/2016 | Zhang |
| 2016/0209648 | A1 | 7/2016 | Haddick |
| 2016/0212515 | A1 | 7/2016 | Biggs |
| 2016/0216943 | A1 | 7/2016 | Welti et al. |
| 2016/0234588 | A1 | 8/2016 | Timothy |
| 2017/0059871 | A1 | 3/2017 | Hashiba |
| 2017/0110951 | A1 | 4/2017 | Akanuma et al. |
| 2017/0123499 | A1 | 5/2017 | Eid |
| 2017/0171666 | A1 | 6/2017 | Biggs |
| 2017/0180863 | A1 | 6/2017 | Biggs |
| 2017/0227778 | A1 | 8/2017 | Osterhout |
| 2019/0189106 | A1 | 6/2019 | Hull et al. |
| 2019/0261088 | A1 | 8/2019 | Sheffield |
| 2021/0219062 | A1 | 7/2021 | Biggs |

FOREIGN PATENT DOCUMENTS

| | | |
|---|---|---|
| CN | 100468926 | 3/2009 |
| CN | 103847454 | 6/2014 |
| CN | 103872875 | 6/2014 |
| CN | 103918283 | 7/2014 |
| EP | 0 204 386 | 12/1986 |
| EP | 0 229 013 | 7/1987 |
| EP | 0 239 333 | 9/1987 |
| EP | 1 258 970 | 11/2002 |
| EP | 1 282 338 | 2/2003 |
| EP | 1 300 932 | 4/2003 |
| EP | 1 438 111 | 7/2004 |
| EP | 2 183 660 | 5/2010 |
| EP | 2 273 346 | 1/2011 |

(56) References Cited

FOREIGN PATENT DOCUMENTS

| | | |
|---|---|---|
| EP | 2 338 219 | 6/2011 |
| EP | 2 626 990 | 8/2013 |
| EP | 2 786 591 | 10/2014 |
| EP | 2 890 153 | 7/2015 |
| EP | 2 977 858 | 1/2016 |
| JP | 2007-043768 | 2/2007 |
| KR | 10-1506556 | 3/2015 |
| KR | 10-2016-0057772 | 5/2016 |
| WO | WO 2006/001436 | 1/2006 |
| WO | WO 2012/173669 | 12/2012 |
| WO | WO 2013/0134388 | 9/2013 |
| WO | WO 2014/031756 | 2/2014 |
| WO | WO 2014/147946 | 9/2014 |
| WO | WO 2014/179969 | 11/2014 |
| WO | WO 2016/007920 | 1/2016 |

OTHER PUBLICATIONS

International Search Report, Application No. PCT/US2016/052347, dated Jan. 27, 2017.

European Search Report for Application No. 15843916.6, dated Apr. 20, 2018.

Verillo, et al., "Sensation magnitude of vibrotactile stimuli", Perception and Psychophysics 61: 300-372 (1960).

Ahmadkhanlou, Farzad, "Design, Modeling and Control of Magnetorheological Fluid-Based Force Feedback Dampers for Telerobotic Systems", Apr. 2008, pp. 18, http://citeseerx.ist.psu.edu/viewdoc/download/?doi=10.1.1.515.6737&rep=rep1&type=pdf.

Melillo et al., "Ferrofluids as a Means of Controlling Woofer Design Parameters", Journal of the Audio Engineering Society, Audio Engineering Society, New York, NY, US, vol. 29, No. 3, Mar. 1, 1981, pp. 132-138.

Olaru et al., "New Linear Actuator with Ferrofluid and Permanent Magnets", Revue Roumaine des Sciences Techniques—Serie Électrotechnique et Énergétique, Jan. 2014, pp. 9.

Tekkeon, "ezTalker™ digital Bluetooth Headset with OLED Display", Datasheet, Nov. 15, 2008, pp. 2, http://www.tekkeon.com/downloads/et3000.

Official Communication received in European Patent Application No. 15843916.6, dated Dec. 12, 2018 in 6 pages.

Official Communication received in European Patent Application No. 15843916.6, dated Feb. 4, 2020 in 6 pages.

International Preliminary Report on Patentability and Written Opinion received in PCT Application No. PCT/US2015/051888, dated Apr. 6, 2017 in 8 pages.

Official Communication received in European Patent Application No. 16847504.4, dated Apr. 18, 2019 in 14 pages.

Official Communication received in European Patent Application No. 16847504.4, dated Jul. 24, 2019 in 12 pages.

International Preliminary Report on Patentability and Written Opinion received in PCT Application No. PCT/US2016/052347, dated Mar. 29, 2018 in 7 pages.

Official Communication received in European Patent Application No. 16847504.4, dated May 31, 2021 in 4 pages.

Defendant Apple Inc.'S Answer, Affirmative Defenses, and Counterclaims To Plaintiff Taction Technology, Inc.'S Complaint, *Taction Technology, Inc.,* V. *Apple Inc.,* Case No. 21-cv-00812-GPC-JLB, filed Jun. 17, 2021, p. 43.

Plaintiff Taction Technology, Inc.'S Complaint, *Taction Technology, Inc.,* v. *Apple Inc.,* Case No. 21-cv-00812-GPC-JLB, filed Apr. 26, 2021, 31 pages.

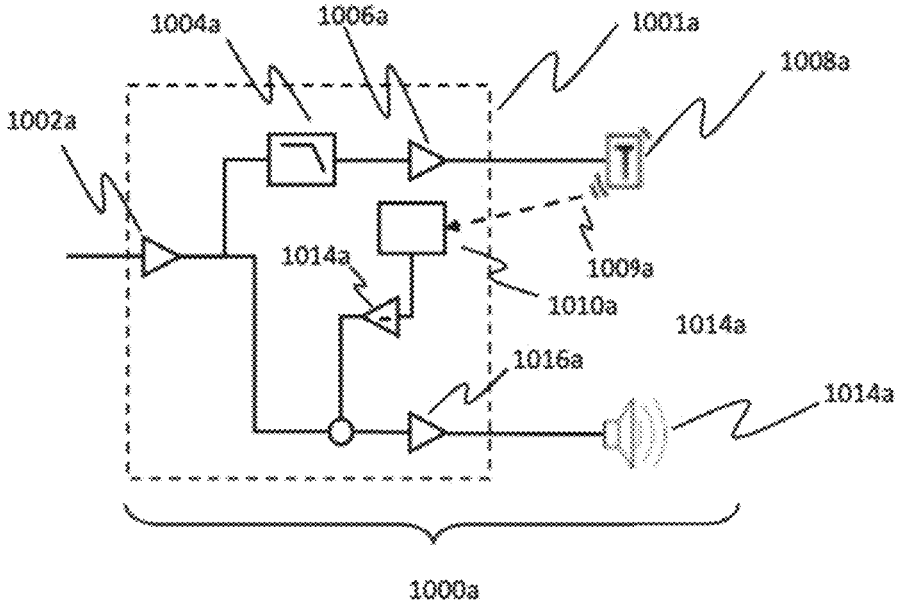
Fig 10a
Fig 10b
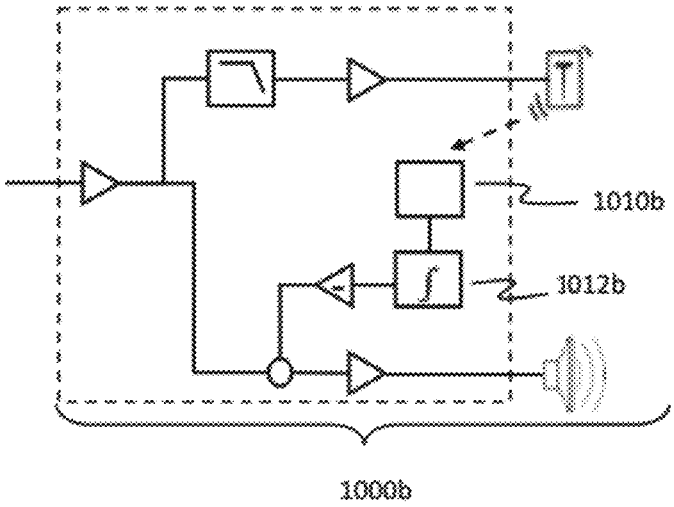

Present Invention 1906 1902 1904

```
function [ y ] = directed(x, z, f, dt)
%
% [ y ] = directed(x, z, f, dt)
%
% directed.m sharpens an audio signal to give it a directed tactile
feeling
% using the pseudo-attraction illusion.  It's suitable for systems where
% signal (input) scales the velocity (output) of the tactile system.
% It can process long vector of data (offline), or for real time
% it can operate on just 2 points: [x(i); x(i-1)].
%
% x = [Nx1]input signal [V]
% z = [#] direction and size of effect, typically (-1<z<1),
% f = [Hz] fundamental freq being filtered (be within ~2x for good
results)
% dt =[sec/sample] sampling interval
%
% how it works:
% Adds first 2 harmonics of sawtooth to signal
%
% v = dx/dt; turns sin(x) ---> cos(x)
% harm2 by dbl angle formula: sin2x=sinxcosx = z*v
% harm3 by AM modulating harm2 -> sideband at f=f(harm2)+f(harm1)
%
% Copyright 2015, S. James Biggs, Ph.D., all rights reserved

omega = 2*pi*f;

v = [0; diff(x)]./dt;
harm2 = 2*x.*v./omega;

if z>0,
    harm3 = v.*harm2./omega;
end

if z<0,
    harm3 = -v.*harm2/omega;
end

y = 0.7*x + z*(0.4*harm2 + 0.3* harm3);

end
```

Fig. 20

```
if(x(i)>0)&(x(i-1)<0),
    upzerocross=1;
else,
    upzerocross=0;
end
if (telapsed>tmin) & (upzerocross),
    x=x+(z*bump(i))
    i++
    telapsed++
end
if (i)> bump_length,
    i = 1
    upzerocross = 0
    telapsed = 0
end
```

2302 2301 2304 2306

Fig. 23

Present invention

Prior Art

TACTILE TRANSDUCER WITH DIGITAL SIGNAL PROCESSING FOR IMPROVED FIDELITY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Audio spatialization is of interest to many headphone users, such as gamers (where is my opponent?), audiophiles (where is the cello?), and pilots (where is ground control?), for example. Location cues can be rendered through conventional headphones to signal, for example, the location of an opponent's footsteps in a video game. The normal human array of two ears, the complex shape of the pinnae, and the computational capacities of the rest of auditory system provide sophisticated tools for sound localization.

These tools include head related transfer function (HRTF), which describes how a given sound wave input (parameterized as frequency and source location) is filtered by the diffraction and reflection properties of the head, pinna, and torso, before the sound reaches the transduction machinery of the eardrum and inner ear; interaural time difference (ITD) (when one ear is closer to the source of the sound waves than the other, the sound will arrive at the closer ear sooner than it will at the ear that is farther from the sound source); and interaural level difference (ILD) (because sound pressure falls with distance, the closer ear will receive a stronger signal than the more distant ear). Together these cues permit humans and other animals to quickly localize sounds in the real world that can indicate danger and other significant situations. However, in the artificial environment of reproduced sound, and particularly sound reproduced through headphones, localization can be more challenging.

Presenting additional information through taction can provide another means for enhancing the perception of sound location.

SUMMARY OF THE INVENTION

Apparatus and methods for audio-tactile spatialization of sound and perception of bass are disclosed. The apparatus and methods of the present invention provide quiet, compact, robust hardware that can accurately produce a wide range of tactile frequencies at a perceptually constant intensity. For greater expressiveness, some apparatus for moving the skin in multiple axes are also disclosed. Signal processing methods are presented to enhance the user's experience of audio spatialization. The methods transform audio signals into directional tactile cues matched to the time resolution of the skin, and which exploit directional tactile illusions.

In some embodiments, apparatus for generating tactile directional cues to a user via electromagnetically actuated motion is provided. The apparatus includes a first ear cup configured to be located proximate to a first one of the user's ears and a second ear cup configured to be located proximate to a second one of the user's ears. Each ear cup includes a vibration module that produces motion in a plane substantially parallel to the sagittal plane of a user's head and a cushion in physical contact with the vibration module. The vibration module of each ear cup is independently addressable, and electrical signals delivered simultaneously to each vibration module produce independent vibration profiles in each vibration module. When applied to the user's skin the independent vibration profiles produce a directionally indicative tactile sensation. In some embodiments, each ear cup can include two or more independently addressable vibration modules to provide finer directionally indicative tactile sensations. In further embodiments, electrical signals delivered to each vibration module are offset from each other in time, preferably by at least 20 ms. In still further embodiments, the electrical signals may accelerate at least one of the vibration modules more quickly when the waveform is moving in one direction and more slowly when the waveform is moving in the opposite direction.

In some embodiments, an apparatus is provided that includes electro-acoustic drivers for reproducing audio waveforms as sound and tactors for generating electromagnetically actuated motion. The apparatus further includes one or more ear cups or frames. Each ear cup or frame locates the electro-acoustic driver proximate to an ear canal of a user and locates the tactors in direct or indirect contact with the user's skin. Each tactor is capable of generating motion along at least one axis, and two or more tactors are located proximate to the same side of said user's head. Preferably, each tactor is independently addressable and generates motion in a plane parallel to the user's sagittal plane. In some embodiments, the ear cups or frames locate one or more tactors in an anterior direction relative the user's ear and one or more vibration modules in a posterior direction relative to the user's ear. In these and other embodiments, the ear cups or frames locate one or more tactors in a superior direction relative the user's ear and one or more vibration modules in an inferior direction relative to the user's ear.

In some embodiments, a vibration module is provided that generates electromagnetically actuated motion along a first axis and a second axis, where the first and second axes lie in substantially the same plane. The vibration module includes a first conductive coil and a second conductive coil, where said first coil is configured to generate a magnetic field that is oriented substantially orthogonal to the orientation of the magnetic field generated by said second coil. The vibration module also includes a pair of magnets aligned with the magnetic field generated with said first conductive coil and a pair of magnets aligned with the magnetic field generated with said second conductive coil. Still further, the vibration module includes a moveable member formed from at least the magnets or said conductive coils, a suspension that that guides said moveable member with respect to the other of said magnets or said conductive coils, and at least a damping member in communication with said moveable member. At least one of said tactors may be driven independently of at least one other of said tactors located proximate to the same side of said user's head.

In some embodiments, methods and systems are provided for electronic tuning of tactile transducer parameters for improved performance in both frequency and time domains.

In some embodiments, methods and systems are provided for the use of accelerometers to provide closed-loop control of tactile transducers.

In some embodiments, methods and systems are provided for the use of microphones to provide closed-loop control of tactile transducers In some embodiments, methods and systems are provided for the use of tactile transducers to enhance noise cancellation in devices such as noise cancelling headphones.

In some embodiments, methods and systems are provided for the use of finite impulse response filtering to improve fidelity of tactile output of tactile transducers.

In some embodiments, methods and systems are provided for techniques for matching the dynamic range of tactile acoustic transducers.

In some embodiments, methods and systems are provided forminimizing high-frequency output from tactile transducers with soft saturation filters.

In some embodiments, methods and systems are provided for devices including wearable tactile transducers that do not block the ambient sound field.

In some embodiments, methods and systems are provided for selectably turning off acoustic output in a tactile transducer-enabled headset.

In some embodiments, methods and systems are provided for improving manufacturability of tactile transducers employing fluid damping.

In some embodiments, methods and systems are provided for using tactile transducers to enhance brain wave entrainment.

In some embodiments, methods and systems are provided for including tactile transducers for in-ear headphones.

In some embodiments, methods and systems are provided for employing controlled lighting to enhance visibility of the movement of a tactile transducer.

The details of one or more implementations are set forth in the accompanying drawings and the description below. Other features and advantages will be apparent from the description and drawings.

BRIEF DESCRIPTION OF THE DRAWINGS

For a fuller understanding of the inventive embodiments, reference is made to the following description taken in connection with the accompanying drawings in which:

FIGS. 10*a* and 10*b* show a schematic representations of further audio-tactile systems, in accordance with some embodiments;

FIG. 20 shows code for transforming a non-directed sine wave into a directed one, in accordance with various embodiments;

FIG. 23 shows exemplary pseudocode for transforming a non-directed sine wave into a directed one, in accordance with various embodiments;

DETAILED DESCRIPTION OF THE PREFERRED EMBODIMENT

Frequencies below about 200 Hz are perceived both by sound and touch, a fact that is familiar to anyone who has "felt the beat" of strong dance music in the chest, or rested their hand on a piano. Thus, the tactile sense has much to offer a listener when proper apparatus and signals are provided. Adding sound-derived tactile stimulation, appropriately processed, can improve the sense of sound location. Adding tactile stimulation ("taction") is also of interest to those who enjoy loud music, as it can provide a listener with the enhanced intensity at a reduced acoustic volume, thereby sparing their hearing from damage.

Figure 1A:
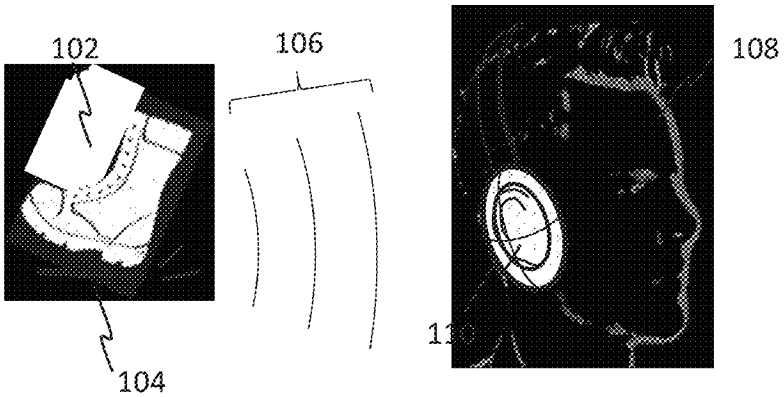
Fig. 1a (Prior Art)
FIGS. 1*a* and 1*b* show pictorial representations of the perception of a footfall, in accordance with the prior art and embodiments of the present invention, respectively.
Figure 1B:
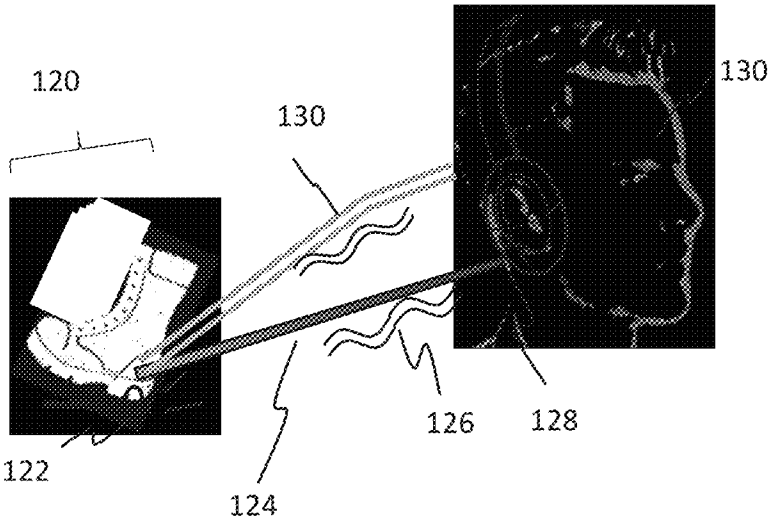

A number of advantages can be achieved by enhancing the directional cues already present in sound with taction. Some embodiments of the present invention are directed to delivering a Tactile InterAural Level Difference (TILD). The enhancement offered by the subject invention may be understood with a simple example: an observer witnessing another person walking on a resonant floor, as illustrated in FIGS. 1*a* and 1*b*. This information may be relevant, for example, in a virtual reality environment, or in a video game in which a player seeks to find an opponent before that opponent finds her. In the prior art, information about an event (foot 102 striking against floor 104) is conveyed via sound waves 106 reaching the ears of the observer 108. When the observer is physically in the same room as the event generating sound, the sound waves travel through the air to reach the observer's ears; when the event has been recorded and is played back via headphones 110, it is generally conveyed as electrical signals that are transduced into sound by drivers in the headphones.

A pictorial representation the tactile enhancements provided by embodiments of the present invention is shown in FIG. 1*b*. If a footfall 120 on floor 122 has (or is artificially enhanced to include) audio content in the tactile range (~5-200 Hz), the acoustic ILD can also be presented (in addition to conventional audio) as physical vibration to the skin of the head with an array of two or more tactors, so that the tactile sensation is stronger on the side closer to the sound source. This type of tactile signaling may be analogous to having a virtual stick 124 connecting the sound source to the user's ear cup 128, where the stick transmits only the mechanical vibrations 126 of foot hitting the floor. A second virtual stick 130 may be thought of as transmitting the physical vibration of the footfall to the ear on the distant side (not shown), but with relative attenuation. The observer is likely to process the difference in amplitude of the taction as an indication of the origin of the signal on the side where the signal is stronger.

Transmission of a signal conveying spatial information via relative amplitude differences using taction can be accomplished with two tactors—one on each side of the head. Tactors could also be used to convey more complex signals. For example, if the ear cup of a headphone, or a portion thereof, could alternatively push forward, or backward, or upward or downward, then a great deal more information could be communicated, including the direction of movement of an object such as the opponent's foot in the air. By this metaphor and others, one can imagine how an appropriately expressive headphone could naturally augment the cues of spatial audio.

Studies with low-fidelity actuators playing tones on the skin of the head and torso have shown that tactile cues can speed reaction time over audio alone, and can help users discriminate direction (J. B. F. van Erp and B. P. Self. RTO-TR-HFM-122-Tactile Displays for Orientation, Navigation and Communication in Air, Sea and Land Environments. NATO Science and Technology Organization, 2008).

Accordingly, the inventor undertook measurements of reaction times in a left/right discrimination task to see if low-frequency vibrations derived from audio could provide similar benefits when displayed to skin contacting the cushions of headphones. The headphones produced damped, electromagnetically-actuated motion in the sagittal plane, as disclosed previously in application Ser. No. 14/864,278, now issued as U.S. Pat. No. 9,430,921, the disclosure of which is incorporated by reference herein in its entirety. Improvement in median response time for the three subjects in the test was 60 milliseconds, indicating that the added tactile signal enabled users to respond to a left or right stimulus more quickly.

In another preliminary study conducted by the inventor and a colleague, the effect of audio-derived tactile stimulation on a user's preferred listening level was investigated, to see if adding skin vibration would lower user's preferred acoustic volume (Schweitzer, H. C. & Biggs, J. (2014). Prospects for hearing protection with multi-sensory headphone innovations. Presentation to the Annual meeting of the American Academy of Audiology. Orlando Fla.). On average, the 5 subjects in the inventor's study lowered their preferred acoustic volume 4 dB when skin vibration was added. This volume reduction was non-trivial in terms of hearing preservation, since NIOSH hearing safety guidelines show a 4 dB reduction is equivalent to cutting sound exposure time by more than half. Thus, taction may provide a long-term hearing protection benefit.

The perceptual enhancement of directional cues described above can be applied in a number of additional contexts. For example, many hearing impaired people rely heavily on visual input, but the human visual field is limited to, at best, roughly a half sphere; events outside that range may be undetected by the profoundly hearing impaired. In general, such people are likely to be at least as sensitive to taction as are fully hearing people. It would be very helpful to those with hearing impairments to have a means by which sound-generating events occurring outside a person's field of view could be conveyed via tactors, such information could be coded via TILD, for example, so as to cue the wearer as to the direction of the source of the signal. Thus, if a hearing-impaired person is crossing a street and does not see an approaching automobile, that person would receive tactile cueing indicating that a horn is honking nearby. But without directional cueing, it is likely to take the wearer precious time to find the source visually. It would be far more useful (and potentially life-saving) to use tactors to convey directional information. While such tactors can be incorporated into a headphone that also conveys information via sound waves, some hearing impaired users might prefer a system that conveys only tactile signals.

In addition to assisting the hearing impaired, this aspect of the subject invention may be used to augment the senses of people with normal hearing when they operate under conditions in which normal hearing is compromised. For example, workers in industrial settings that are very loud (e.g., steel mills and other heavy industries) often wear (and may be required to wear) hearing protection. While earplugs or over-the-ear hearing protectors can preserve hearing against long-term exposure to high sound levels, they also block audible cueing that a worker may very much want to receive, such as the sound of a forklift approaching from behind, or the voice of a co-worker. Taction could provide a means for cueing a worker wearing hearing protection of the location of a sound source that is outside her visual field.

Similarly, taction could provide soldiers with a virtually silent cueing mechanism to inform them of the location of friendly (or unfriendly) actors, and could help firefighters locate each other inside burning buildings. Situational awareness is vital in these and other high-risk situations. Battlefields can very loud, and hearing loss among soldiers is a serious problem. Hearing protection reduces situational awareness. The problem may be exacerbated when other equipment, such as night vision goggles, reduce the visual field. But a taction-based system could protect hearing while preserving situational awareness. Signal processing could convert relevant audio and other information into specific types of tactive signals. For example, if a 4-member patrol is operating in a low-visibility environment, it would be useful to provide a means by which each soldier could sense the location of each of the other team members.

There are multiple ways of determining the spatial relationship between multiple persons or objects. One such method is described US Patent application number US20150316383A1 and in WO2012167301A1, both to Ashod Donikian, which uses data from inertial sensors such as accelerometers and gyroscopes commonly found in mobile devices to provide 3D information. The acquisition of position information is outside the scope of the current invention. However, there are likely contexts in which presentation of that spatial information via traditional methods (hand-held displays, heads-up displays or even traditional audio prompts) are all impractical or ineffective. The subject invention can relieve information overload from the visual and auditory communications channel, which may both lower the cognitive load of users and provide a shorter "signal path" to the decision-making areas of the brain.

Figure 2:
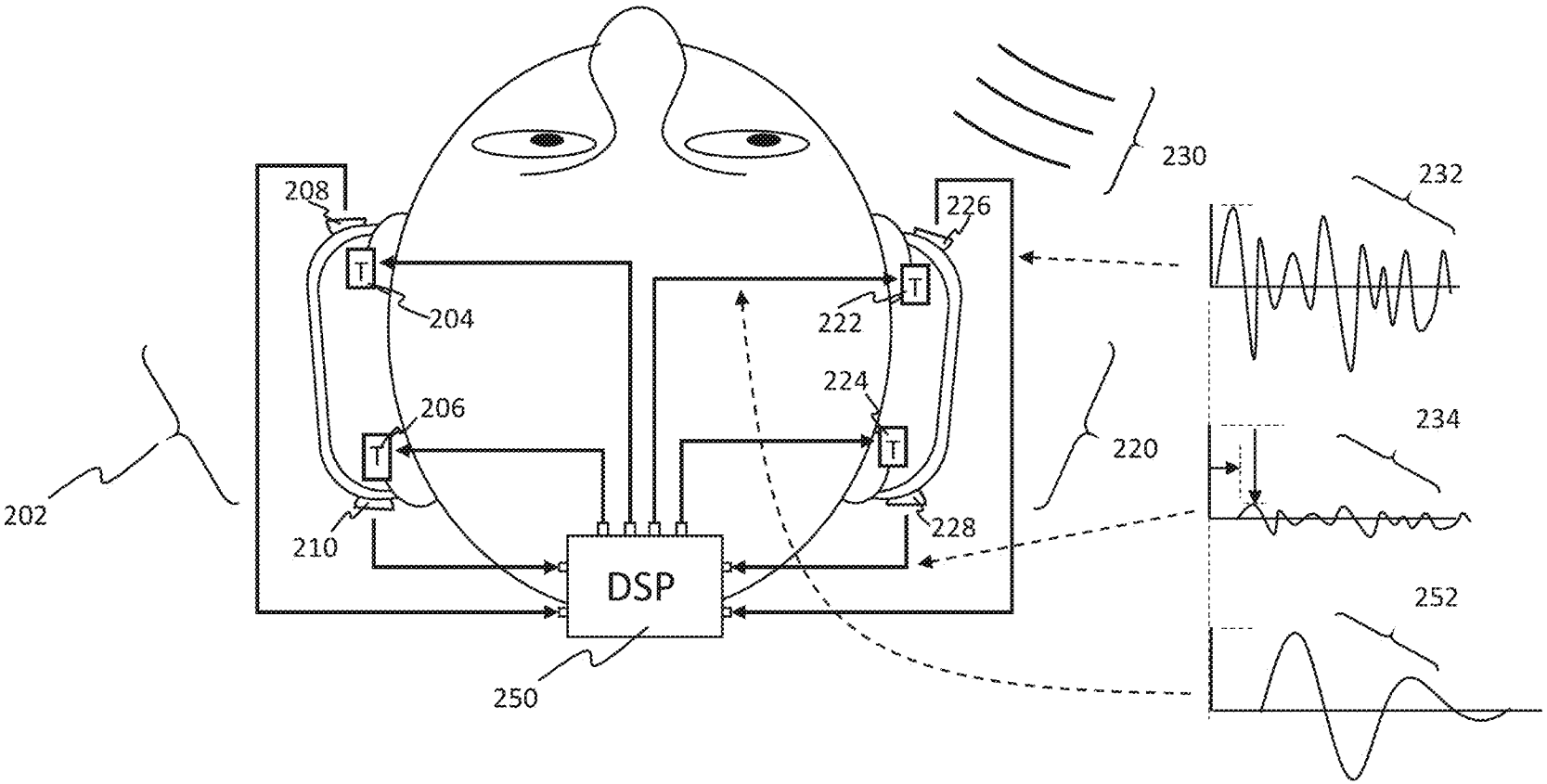
FIG. 2 shows a top plan view of a person wearing a tactor-enhanced headset that conveys location information, in accordance with various embodiments.

FIG. 2 shows a top plan view of a person wearing a tactor-enhanced headset that conveys location information, in accordance with various embodiments. Left headphone cup 202 incorporates front tactor 204 and rear tactor 206. It also incorporates front microphone 208 and rear microphone 210. Right headphone cup 220 incorporates front tactor 222 and rear tactor 224, as well as front microphone 226 and rear microphone 228. (It should be noted that in some applications the headphone cups, and/or even the conventional headphone drivers, may be omitted.)

When audio-frequency signal 230 is generated forward and to the right of the person wearing the headset, front right microphone 226 captures strong signal 232, while right rear microphone 228 captures weaker signal 234. The signals from both microphones are transmitted to digital signal processor ("DSP") 250. DSP 250 may analyze relative loudness, arrival times and other parameters in order to determine the vector of origin for the sound. DSP 250 then generates signal 252 to send to the appropriate tactor or tactors. In this case, signal 252 might be sent to solely to tactor 222, to each tactor (or a subset of all tactors) with amplitudes varying in relation to the relative distance from the vector of origin to the respective tactor.

The signal sent to the tactor must match to the frequency response of the tactor and perceptual range of the skin, even though the original sound received by the microphone might be well outside one or more of those ranges. Thus, the signal generated by DSP 250 may be harmonically related to the original signal (as when the original signal is processed through a divider network). Or it may be unrelated to the source signal, but chosen based on maximum sensitivity of the subject, or on some other basis.

When employing taction in order to enhance the bass response of headphones, it may be important to ensure good matching of the perceived volume level produced by the conventional sound-generating means (one or more transducers that create sound waves in the air between the driver and the eardrum) and the tactors, which produce vibration directly on the skin rather than through the air. Similar problems have been addressed for decades in multi-driver loudspeakers (and more recently, headphones), which may use crossover networks (traditionally comprised of capacitors, inductors and resistors) to send low frequencies to one driver and high frequencies to another. In such systems it is generally necessary to attenuate the output of at least one driver in order present the desired overall frequency response to the listener.

Presenting a desired overall frequency response is more complex when combining tactors with conventional drivers, in part because the two different drivers present information via two different perceptual channels, which the brain effectively re-assembles into the desired result. Where a calibrated microphone can take a single measurement of a multi-driver speaker system (putting aside issues of positioning, room effects, etc.), a microphone cannot integrate sound pressure levels generated by conventional drivers with the vibrations generated by tactors. As used herein, the terms "conventional driver" and "audio driver" are used interchangeably and encompass a wide range of technologies, including moving coil drivers, electrostatic drivers, balanced armatures, planar drivers and other design. As used herein, the term "conventional drivers" refer to drivers that produce sound by compressing and rarifying air, thereby creating sound waves detected primarily through hearing.

It may also be the case that there are different target tactile frequency responses for headphones relative to head-mounted displays, and other wearable technology. Finally, there are at least three ways of quantifying the magnitude of the taction effect on a "listener": acceleration (measured in, for example, meters/second/second); velocity (measured, for example in meters/second); and displacement (measured, for example, in meters). Previous research developed the iso-sensation curves for touch illustrated in FIG. 3. (Verillo-R T, Fraioli-A J, Smith-R L. Sensation magnitude of vibrotactile stimuli. Perception and Psychophysics 61:300-372 (1960)).

Previous attempts to present audio frequency information via taction have tended to design and measure those systems based upon their characteristics in terms of displacement (i.e., the distance traveled by the tactor when producing vibration) and/or acceleration (the rate of change in its movement). It is likely that these measurements were favored because of the common and inexpensive availability of tools (e.g., Linear Variable Displacement Transducers, accelerometers) that can directly measure those parameters. This prior work, based on measurements of displacement, does not yield subjectively flat frequency response for taction in the range of 20 to 150 Hz.

Figure 3:
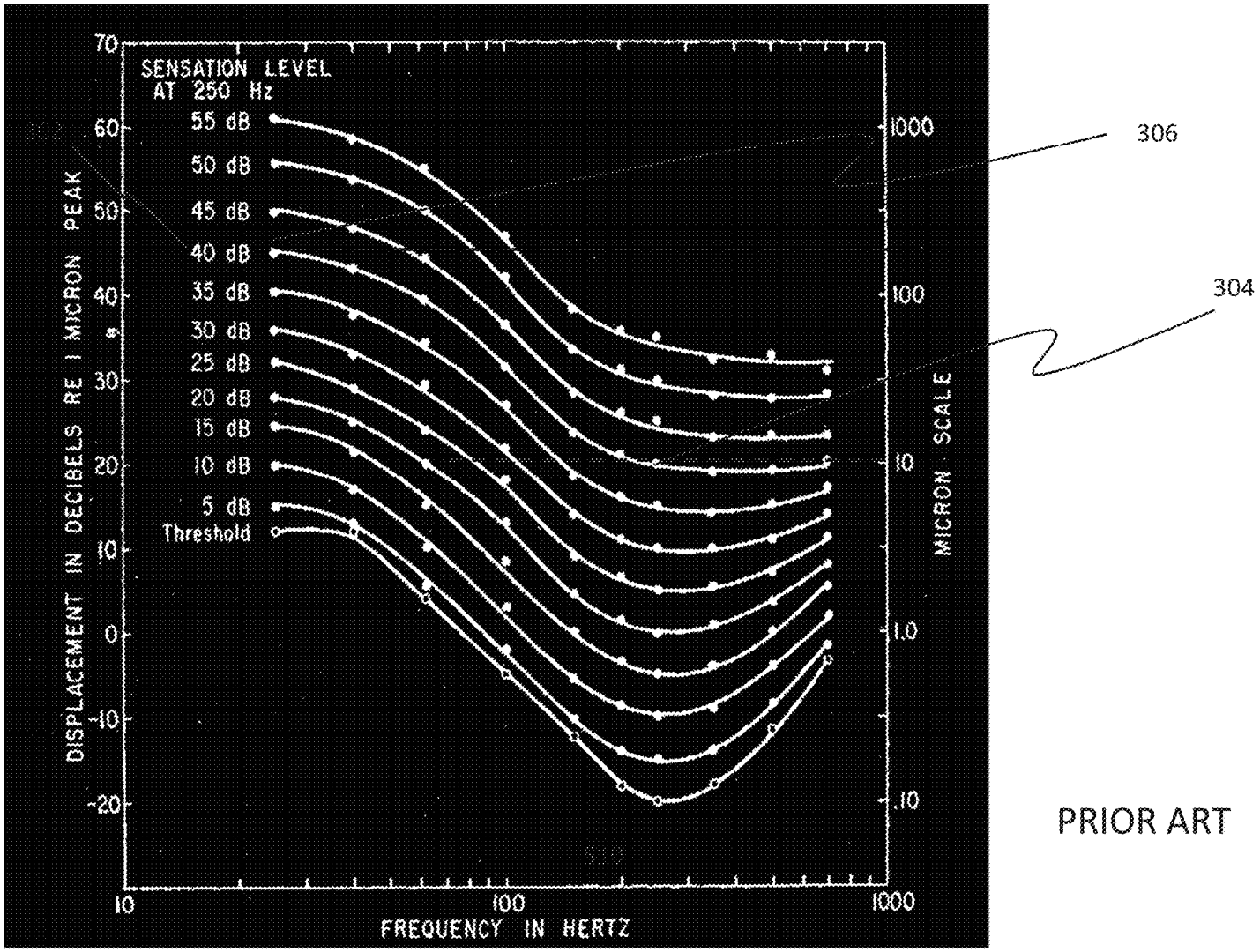
FIG. 3 shows a prior art graph of iso-sensation curves for touch.

As shown in FIG. 3, which is reproduced from Verillo et al. paper, the iso-sensations over that frequency range show a strong frequency dependence: for a given amount of displacement, the perceptual mechanism is significantly more sensitive to a 100 Hz signal than to a 20 Hz signal. For example, the 40 dB iso-sensation curve 302 shows that approximately 10 microns of displacement at 200 Hz 304 produces a sensation level of 40 db, whereas the same curve indicates that at 20 Hz over 100 microns of displacement 306 is required to produce the same sensation level. Thus a tactor designed for constant displacement over the relevant frequency range for a given input signal level will not provide equal sensation intensity over the desired range of frequencies.

In contrast to this displacement-based description of perceived intensity, loudspeakers have been measured for decades using microphones and related equipment capable of plotting sound pressure levels at various frequencies. Measuring speakers in terms of sound power levels is interchangeable with measuring their velocity (with adjustment for the relative surface area of the drivers), since SPL=Apv, where A is area, p is pressure and v is speaker cone velocity.

Sufficient displacement data is presented in the Verillo et al. paper previously referenced to derive velocity and acceleration iso-sensations in addition to the iso-sensations provided for displacement. This is because for sinusoidal motion the displacement, acceleration, and frequency are related as in equations 1-3, where A is displacement amplitude, and co is frequency in radian/s.

$$x=A\sin(\omega f) \quad \text{(Eq. 1)}$$

$$v=\omega A\cos(\omega f) \quad \text{(Eq. 2)}$$

$$a=-\omega^2 A\sin(\omega f) \quad \text{(Eq. 3)}$$

Figure 4A:
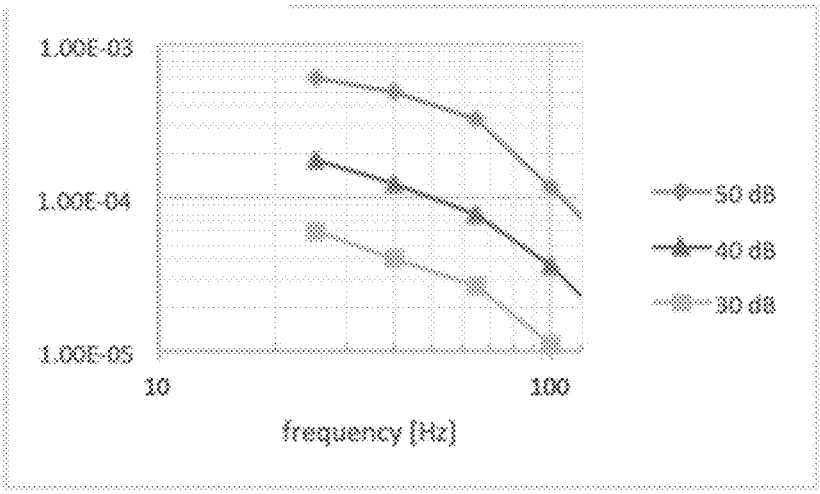
FIGS. 4*a*-4*c* show graphs of iso-sensation curves for touch, in accordance with the prior art (FIG. 4*a*) and embodiments of the present invention (FIGS. 4*b* and 4*c*)
Figure 4B:
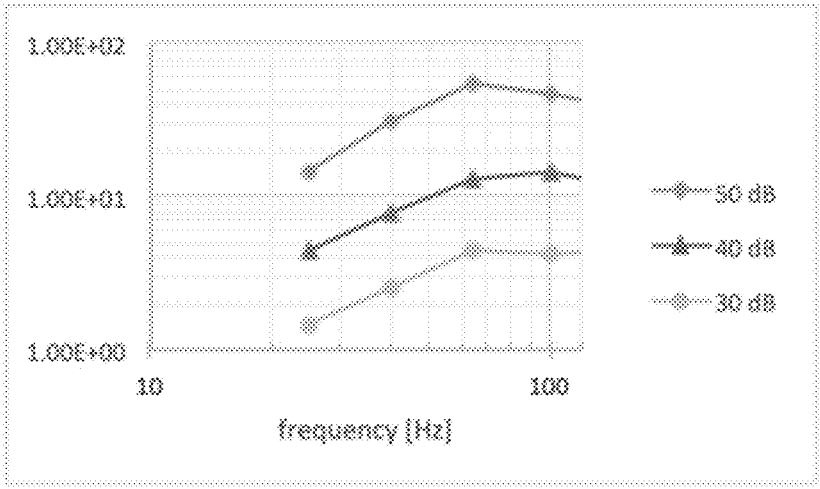

Each of those three iso-sensation graphs, limited to the relevant frequency range, is shown in FIGS. 4*a*, 4*b* and 4 *c*.

FIG. 4*a* shows the iso-sensation curves as measured by Verillo as described above, (that is, comparing perceived intensity to displacement) but limiting the plots to the most relevant frequency range for tactile bass (approximately 20-100 Hz). It shows that a tactor system optimized for constant displacement will not be perceived as having flat frequency response by a user, because the "listener" will be much more sensitive to a given level of displacement at 100 Hz than that same listener will be to the same level of displacement at 20 Hz.

FIG. 4*b* shows the same range of iso-sensation assuming that the tactor system is optimized to deliver constant acceleration amplitude. This graph demonstrates the opposite shortcoming: it shows that a tactor optimized for constant acceleration will not be perceived as having flat frequency response by a user, because the "listener" will be much less sensitive to a given level of acceleration at 100 Hz than that same listener will be to the same level of acceleration at 20 Hz.

Figure 4C:
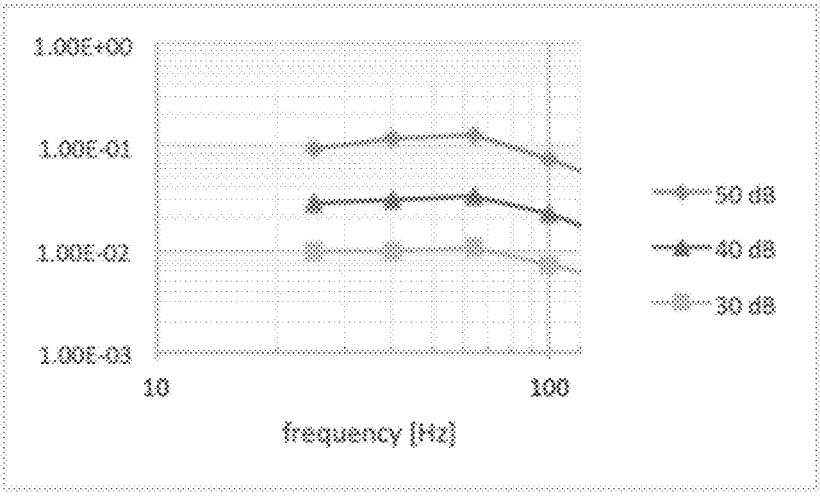

FIG. 4*c* shows the same range of iso-sensation assuming that the tactor system is optimized to deliver constant velocity amplitude. Over the relevant frequency and amplitude ranges, constant velocity delivers relatively consistent sensations over the relevant frequency and amplitude regions. It has thus been found by the inventor that, over the range of intensities and frequencies of interest, the best results are obtained by treating people wearing tactors as velocity-sensors. That is, tactile iso-sensation curves are flattest over the range of 10-150 Hz when vibrations are expressed in terms of velocity, and the velocity is therefore a good physical correlate for sensation intensity in this range.

Actually delivering consistent velocity as a function of frequency with a tactor in a headphone is a complex undertaking. Some of the factors that will affect the velocity presented at the interface between the taction system and the wearer include (1) the mechanical characteristics of the tactor itself, including the inertial mass of the reciprocating portion of the tactor, the characteristics of the spring that provides restorative force to the reciprocating portion of the tactor, and the damping applied to the system; (2) the effective mass of the headphone cup or other tactor housing; (3) the stiffness and damping of the headphone bow or other means by which the tactor is held against the skin; (4) the shear stiffness and damping of the cushions or other compressible material(s) used to couple the tactor to the skin, if any; and (5) the shear stiffness and damping of the scalp around the ear or other location where the tactor is held against the skin.

Figure 5:
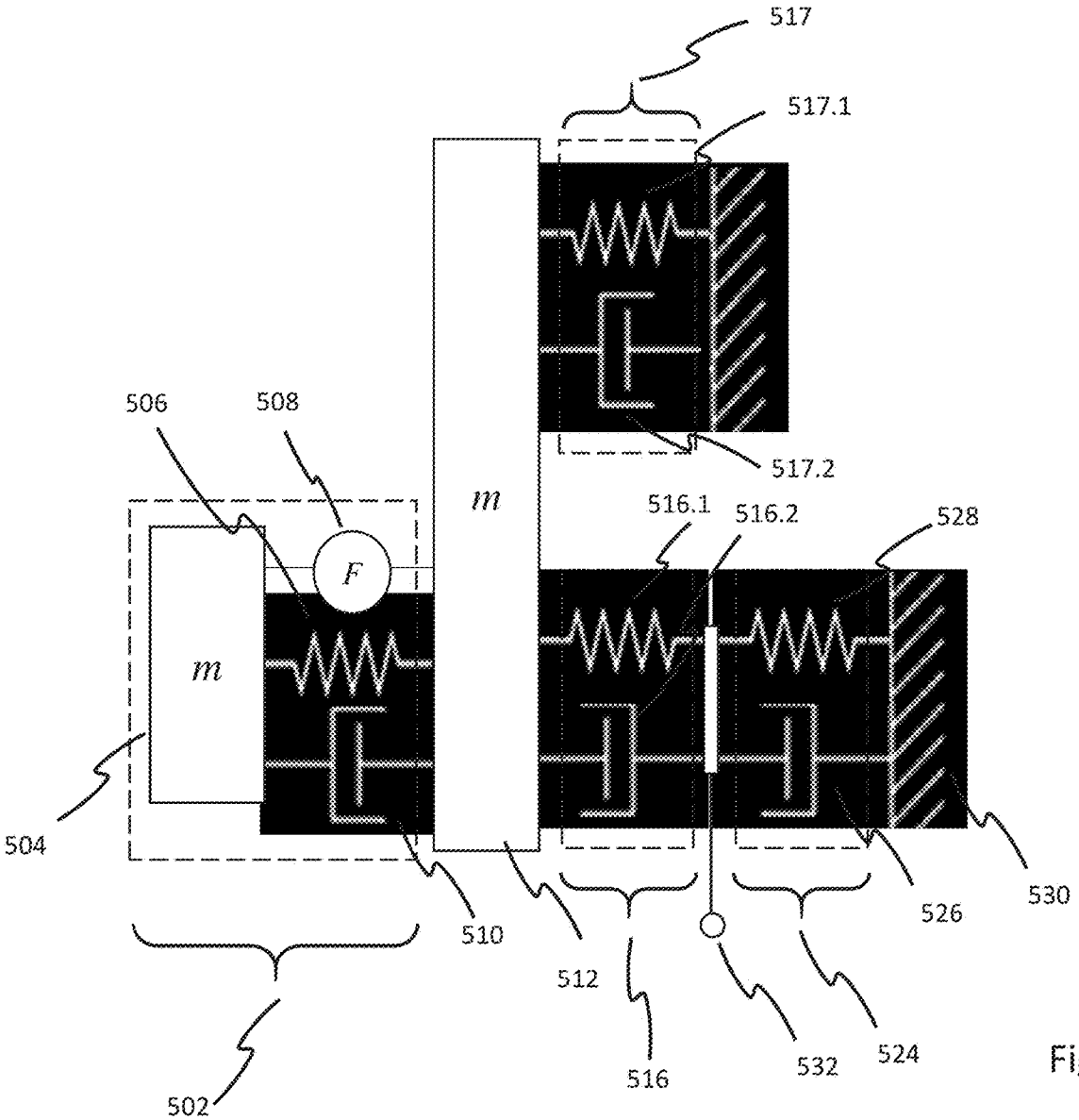
FIG. 5 shows a system dynamics model of a taction module optimized for constant skin velocity output in accordance with various embodiments.

FIG. 5 shows a system dynamics model of a taction module 502, optimized for constant skin velocity output in accordance with various embodiments. The various physical components of taction module 502 may be represented by mass 504, spring 506, which stores and release energy as the mass moves, energy source 508, which is the motor transducing electrical energy into kinetic energy, and damping member 510, which may be a ferrofluid or other means for converting kinetic energy into heat. Module 502 can be installed in ear cup 512, which may be treated as purely passive and thus consists of mass for purposes of this portion of the disclosure.

Ear cup 512 generally contacts the wearer's head via two structures: cushion 516, and the bow 517, which generally connects the left and right ear cups and provides some clamping force while distributing some of the weight of the headphones away from the cushions and to the top of the wearer's head. Some headphones use non-contact bows; these are generally lighter weight headphones. Cushion 516 may be conceptually understood as including both a spring 516.1 and a damper 516.2, which is typically provided in the form of a foam member possessing both properties. Bow 517 may also be cushioned so as to provide characteristics of both a spring 517.1 and a damper 517.2. (If the portion of the bow contacting the wearer's head does not comprise a foam or foam-like cushion, the bow may not exhibit these properties.)

The goal of taction module 502 is to move the wearer's skin 524 relative to the rigid structure underneath: cranium 530. The skin has its own elastic properties, and thus may be viewed as including spring 526 and damper 528.

Because the point of adding taction in the first place is to create the proper amount of movement at the interface 532 of the cushion and the skin, the entire system must be taken into account in order to produce the correct velocity at that point. Thus tuning the behavior of the entire system to deliver constant velocity output at intersection 532 for a given level of input is critical. It is impractical at best to change the properties of the skin on the listener, and when adding tactors to an existing system, most of the critical parameters are difficult to significantly change. One of the properties most accessible for the taction designed is the damping 510 within the tactor 502.

A mechanical system capable of producing significant output at frequencies as low as 5 or 10 hz requires movably suspending a significant mass. In motion, such a mass stores significant kinetic energy, and if appropriate means are not provided to dissipate that energy, such a transducer will exhibit highly under-damped motion at resonance, which is inconsistent with the goal of flat velocity response. In the context of headphones used to listen to music, an under-damped tactile transducer gives "one-note bass," which greatly reduces the pitch information present in low-frequency music. In other contexts, it may interfere with other forms of signaling associated with different frequencies.

To make the system still more complex, the resonance of the module itself becomes part of the complex resonant system discussed above. There is limited value in providing a module that has a flat frequency response when suspended in free space, if the system response becomes non-flat once it is added to headphones mounted on a human head. Accordingly, an object of present invention is to provide a method of damping of taction modules specifically adjusted to provide headphone tactors with a flat velocity response when they drive a load like cushioned ear cups shearing skin around a wearer's ears.

Figure 6:
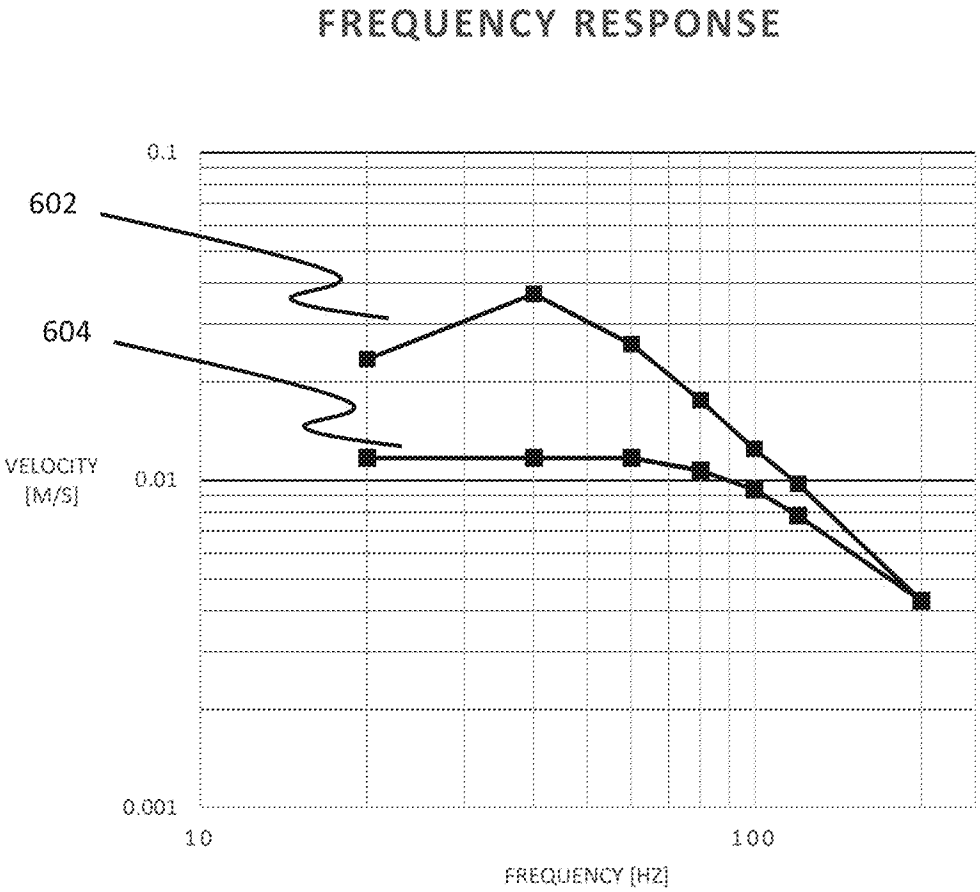
FIG. 6 shows a graph illustrating the effect on frequency response of applying damping to tactors, in accordance with various embodiments.

The effect on frequency response of applying damping to the tactors is shown in FIG. 6. Response curve 602 gives an example of the in-system velocity response of a tactor with inadequate damping. This system may be perceived by a user as providing "one-note" bass centered around the resonant frequency of 40 Hz. On the other hand, response curve 604 presents a much flatter output. It should be noted, however, that damping comes at a cost: overall output is substantially reduced for a given input, as the damping means converts more of the input signal directly into heat. Overdamped systems require more power for a given output level, placing greater demands on amplifiers, batteries, etc. Thus with properly applied damping, applying a signal, such as 1 Volt peak-to-peak, to the tactile module produces vibration of the same qualitative intensity, whether the frequency being reproduced is 20 Hz or 100 Hz.

A potential consequence of using tactors to provide deep bass is that the action of the tactors is not solely perceived via shear against the skin of the listener: the tactors may also produce audio output which can be perceived via the conventional auditory pathways. Maintaining a desired acoustic frequency response in a headphone when ear cups are vibrated thus requires accounting for the combined audio contribution of the conventional drivers and the tactors. Although moving the ear cups parallel to the side of the head (as disclosed in the present invention and in application Ser. No. 14/864,278, now issued as U.S. Pat. No. 9,430,921, and which is incorporated by reference herein in its entirety) is far quieter than moving them toward and away from the head (as practiced in the prior art), the excess sound generated may not be negligible, and could produce acoustic bass audio of 90 dB or louder all by itself. This output may not be objectionable in and of itself, but may create undesired effects when added to (or subtracted from, depending on phase) the output of the conventional driver. One way to compensate for this excess acoustic bass is to attenuate the acoustic driver when the tactile vibration is already providing the acoustic bass audio.

Figure 7:
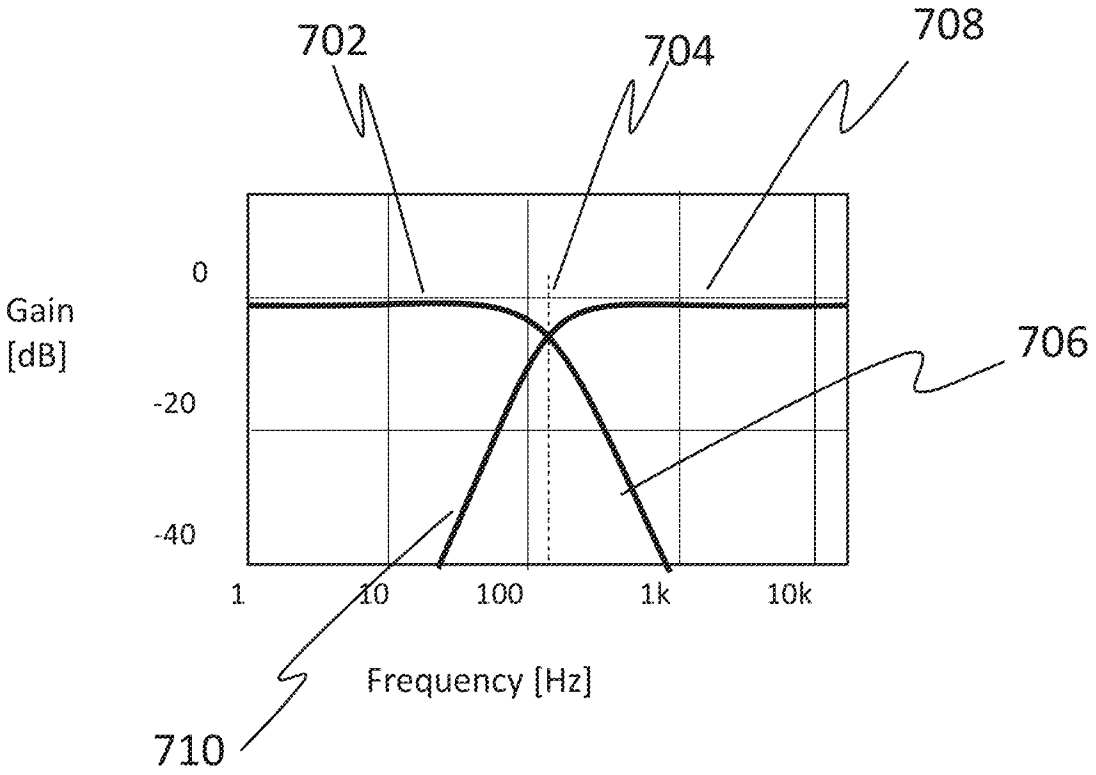
FIG. 7 shows a graph of the frequency response for a crossover circuit configured to attenuate a tactile transducer and an acoustic based on frequency, in accordance with various embodiments.

Accordingly, several methods for accomplishing this attenuation are disclosed. One method is to treat the tactile transducer as a subwoofer, and to use a crossover circuit that attenuates the acoustic driver based on frequency as illustrated in FIG. 7. In this approach the response of tactor 702 is rolled off above crossover frequency 704 at slope 706, and the response of primary audio driver 708 is rolled off at the crossover frequency at slope 710. Slopes for the crossovers may be of various types: from first order (6 dB/octave) to more complex crossovers with slopes as high as 48 dB per octave or more, as is understood in the art.

Preserving phase is a desirable aspect of the hand-off from driver acoustics to tactor acoustics. It may be attained by appropriately matching the order of the high and low-pass filters, as is understood from in the art of pure audio crossover circuits. It is also preferable to perform such crossover function with low-level signals (i.e., prior to amplification), because passive high-pass filtering generally requires physically large (and expensive) inductors.

Figure 8:
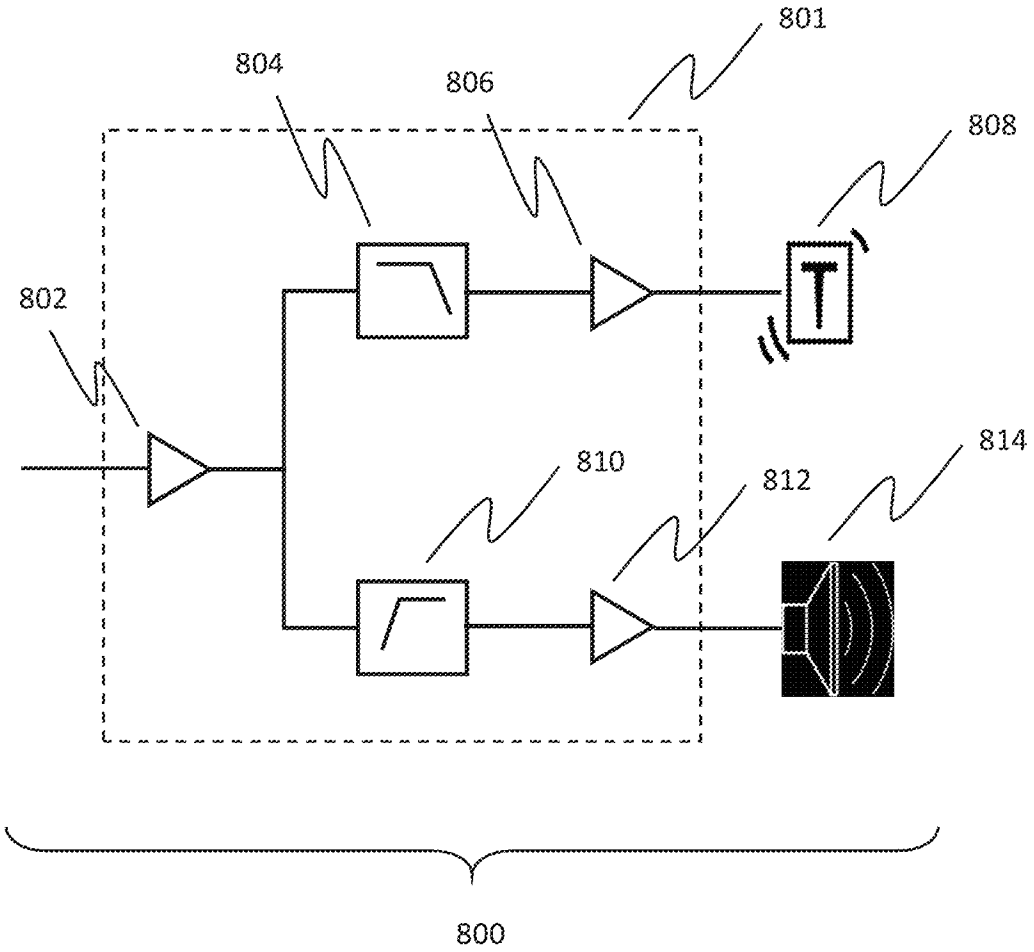
FIG. 8 shows a schematic representation of an audio-tactile system, including cross-over circuit, a taction driver, and a conventional driver, in accordance with some embodiments.

FIG. 8 shows a schematic representation of audio-tactile system 800, including cross-over circuit 801, taction driver 808, and conventional driver 814, in accordance with some embodiments. Circuit 801 may include a buffer 802 to prevent interaction between the crossovers and circuitry upstream of those crossovers. After buffer 802, the signal may feed circuit elements specific to each of the two drivers. Low pass crossover network 804 feeds the frequencies intended for the tactors to gain stage 806. Gain stage 806 may adjust gain or attenuate the signal, as known in the art, in order to account for listener preferences for the amount of bass enhancement provided. The signal then passes to taction driver 808. At the same time, the signal from the buffer is passed to a high pass filter 810, which passes the signal in turn to gain stage 812, and then to conventional driver 814.

Figure 9:
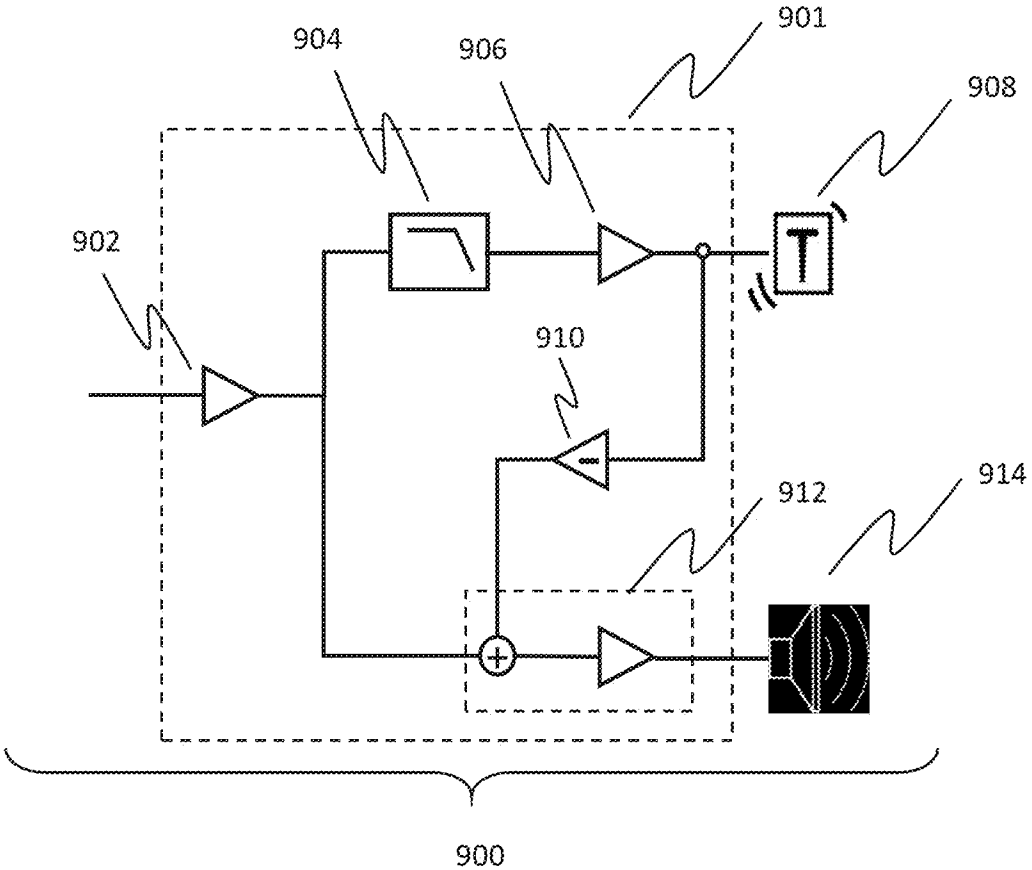
FIG. 9 shows a schematic representation of an alternative audio-tactile system, including a cross-over circuit, a taction driver, and a conventional driver, in accordance with some embodiments.

FIG. 9 shows a schematic representation of an alternative audio-tactile system 900, including cross-over circuit 901, taction driver 908, and conventional driver 914, in accordance with some embodiments. In taction system 900, some of the tactile transducer signal is fed forward so that it may be subtracted from the signal provided to conventional driver 914. As in FIG. 8, buffer 902 isolates the network from upstream circuitry. Buffer 902 feeds low pass network 904, which in turn feeds gain stage 906, which may be adjustable. In addition to feeding taction driver 908, the output of gain stage 908 also feeds an inverter/scaler 910. This module inverts the signal of the output from gain stage 908, and (if required) adjusts the level of the signal in order to provide the appropriate level of cancellation relative to the output of buffer 902 as presented to summing gain stage 912, which in turn drives conventional driver 914.

FIG. 10*a* shows a schematic representation of another audio-tactile system 1000 *a*, including cross-over circuit 1001 *a*, taction driver 1008 *a*, and conventional driver 1014 *a*, in accordance with some embodiments. In taction system 1000 *a*, sensor-based feedback is used to attenuate acoustic driver 1014 *a*. In particular, buffer 1002 *a* again isolates the network, and low-pass filter 1004 *a* feeds gain stage 1006 *a*, which in turn feeds the signal to taction driver 1008 *a*. The physical movement 1009 *a* generated by taction driver 1008 *a* is measured by accelerometer 1010 *a*. Using an accelerometer to measure ear cup motion is a convenient source of the feedback signal, since there is no acoustic transmission delay as there would be for a microphone. Accelerometer 1010 *a* then outputs a proportionate electrical signal, which is in turn fed to an inverting gain stage 1014 *a*. Gain stage 1014 *a* inverts this signal and scales it to provide appropriate cancellation when it is mixed with the output of buffer 1002 *a*. This summed signal is finally provided to gain stage 1016 *a*, which drives conventional transducer 1014 *a*.

FIG. 10*b* shows a schematic representation of taction system 1000 *b*, which modifies audio-tactile system 1000 *a* to improve the uniformity of cancellation across a range of frequencies, in accordance with various embodiments. In particular, in taction system 1000 *b*, the signal of the accelerometer 1010 *b* may be modified by leaky integrator 1012 *b*. In this embodiment, before proceeding to inverting gain stage 1014 *b*, the accelerometer signal is passed through a leaky integrator 1012 *b* to transform the accelerometer signal into one proportional to ear cup velocity, since sound pressure level scales with velocity of the emitter independent of frequency.

The approach shown in FIGS. 10*a* and 10*b* may have several advantages. Because the accelerometer reacts to movement, and is ideally physically coupled to the tactor itself, the response time of the system is quick. And because the accelerometer is sensitive to motion rather than sound, it easily isolates the output of the tactor as it is relatively insensitive to the output of the conventional driver.

Figure 11:
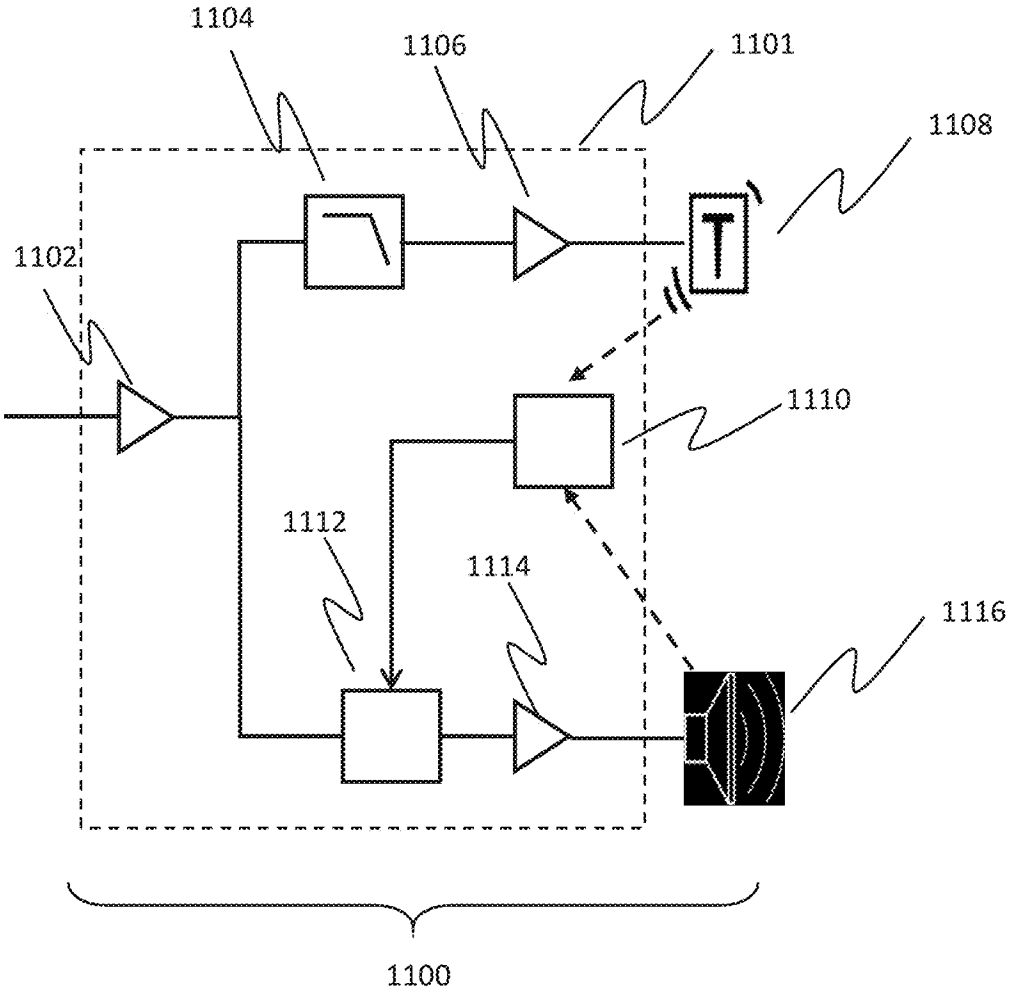
FIG. 11 shows a schematic representation of yet another audio-tactile system 1100, in accordance with some embodiments.

FIG. 11 shows a schematic representation of yet another audio-tactile system 1100, including cross-over circuit 1101, taction driver 1108, and conventional driver 1116, in accordance with some embodiments. Buffer 1102 again isolates the network; low-pass filter 1104 feeds gain stage 1106, which in turn feeds the signal to tactor 1108. When the tactor physically moves the ear cup, changes in air pressure are measured by microphone 1110, located within the chamber created by the earphone against the head. The output of microphone 1110 is fed to a noise-cancelling circuit 1112, as known in the art. Noise-cancelling circuit 1112 feeds its output to gain stage 1114, which in turn feeds conventional driver 1116. An advantage of this approach may be that the microphone used to provide active noise cancellation may also be used to tune the output of driver 1116 relative to tactor 1110. In effect, the system may treat the output of the tactor as a source of undesirable noise (at least within the range where the tactor overlaps with the conventional driver).

It is also possible to reduce or eliminate unwanted effects resulting from overlapping coverage between tactors and conventional drivers by attenuating output of the tactors in the frequency range of concern, either through crossover design or through feedback mechanisms as disclosed above.

As previously discussed, one benefit of the instant invention is the ability to convey complex spatial information using taction. For a number of reasons, it is desirable to address how embodiments of the invention can integrate with current audio standards. Tactile technology that leverages existing audio tools has a better chance of success because sound authoring tools already exist and professionals, like sound designers for games, movies, and virtual environments, are in place to apply them. Accordingly, the present invention contemplates extending existing audio editing tools, so that authors may embed useful tactile content into existing audio streams. The present invention also contemplates the creation of hardware that is capable of extracting that tactile content from conventional audio streams and delivering that content to the user. Accordingly, plugins for audio editors such as Virtual Studio Technology ("VST") and Audio Units are explicitly contemplated.

VST is a software interface that integrates software audio synthesizer and effect plugins with audio editors and recording systems. VST and similar technologies use digital signal processing to simulate traditional recording studio hardware in software. Audio Units are digital-audio plug-ins provided by Core Audio in Apple's OS X and iOS operating systems. AU are a set of application programming interface (API) services provided by the operating system to generate, process, receive, or otherwise manipulate streams of audio with minimal latency. There are also large existing libraries for the audio APIs of video game engines. It would be desirable to provide a means for delivering spatial cueing that is compatible with existing techniques and protocols for delivering audio content.

On the hardware side, things can be simple when the tactile content aims primarily to reinforce the audio signal. Since the tactile content is generally simultaneous with the higher-frequency audio signal, low-pass filtering can be sufficient to extract it.

As discussed above, if headphones are provided with at least two tactors in each ear cup, it is possible to do more than just enhance audio content with deep bass: if two tactors per side of the head are provided, taction can provide cues about the front-versus-back location of a sound source, in addition to right-left information. For example, an array of four tactors can be provided such that one is located in front of the left ear, the second behind the left ear, the third in front of the right ear, and the fourth behind the right ear. Such an arrangement can be achieved for example by placing multiple tactors in segmented headphone cushions, for example, as is discussed more fully below. With such an arrangement, audio-derived tactile vibration may be routed to the tactor closest to the sound source. It should also be noted that the same concept can be used to integrate the third dimension in tactile spatial signaling. That is, if additional tactors are provided and arranged so that some are higher on the user's head and some are lower, it is possible to signal not just front-back information, but also up-down information.

Figure 12:
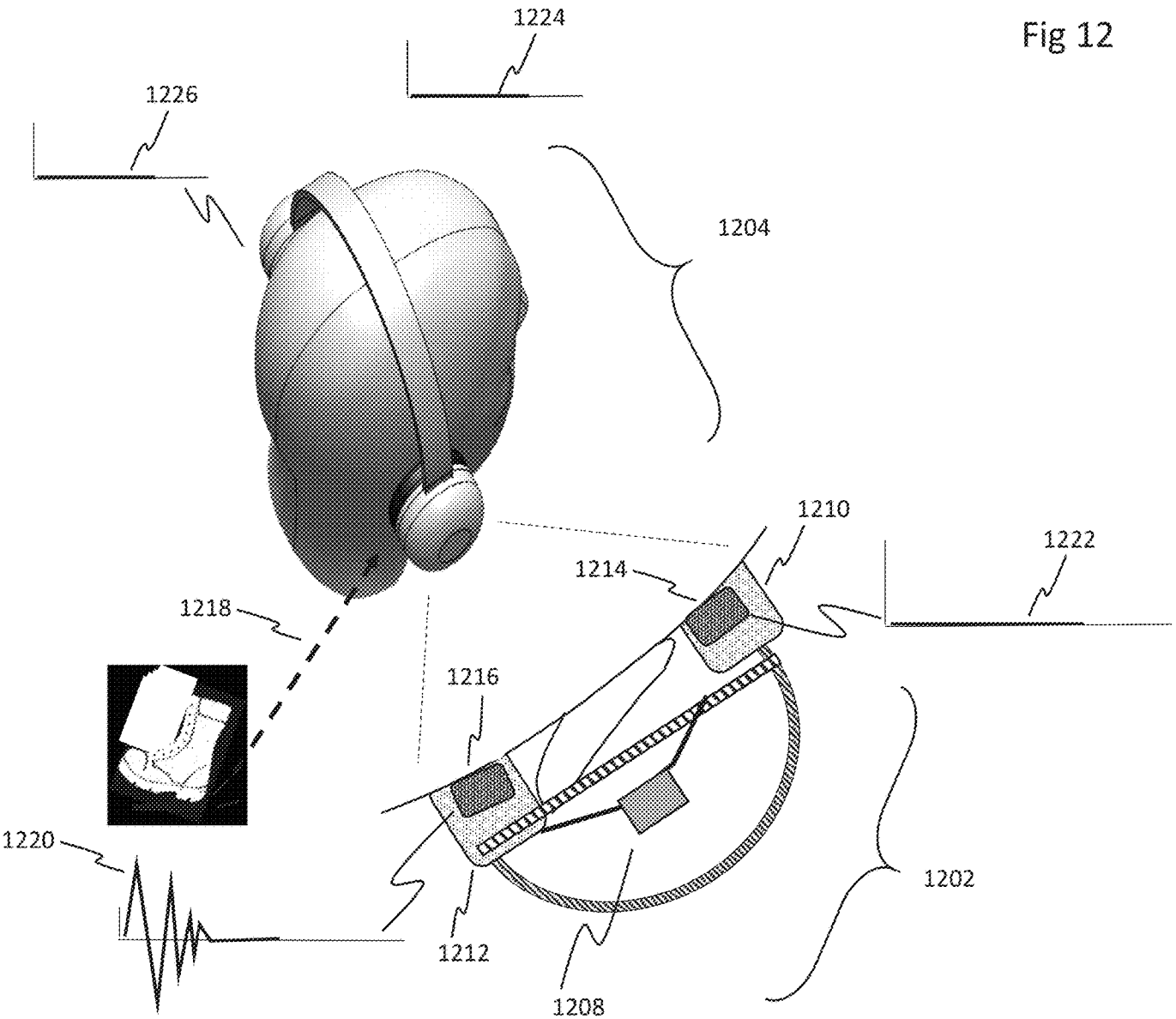
FIG. 12 shows a perspective view and a cross-sectional detail of a simplified headphone, including headphone cup assemblies provided with front and back tactors, in accordance with some embodiments.

FIG. 12 combines perspective and cross-sectional detail of a simplified headphone 1204, including headphone cup assemblies 1202 provided with front and back tactors, in accordance with some embodiments. Headphone cup assembly 1202 includes conventional driver 1208, as well as front cushion 1210 and rear cushion 1212, which are physically separated. The front cushion contains front right tactor 1214; the rear cushion contains right rear tactor 1216.

When presenting a sound intended to be localized as coming from behind and to the right of the headphone wearer, such as footfall 1218, a corresponding signal 1220 (represented as a waveform over time) may be sent to right rear tactor 1216, while no signal (represented by a flat line 1222) is sent to right front tactor 1214. Similarly, the left rear tactor (not shown) would receive null signal 1224, and the left front tactor would receive null signal 1226. To present a sound as localized as coming from the right front, tactor 1214 would receive a signal, while the other three would not.

In the simplest case, taction signals would go to only one tactor. However, it is also possible to represent intermediate vectors with weighted signals going to more than one tactor. Thus sending 75% of the signal to the left rear and 25% to the left front would convey that the source was to the left and somewhat to the rear; sending 50% to the left rear and 50% to the right rear would convey that the source was directly behind the user, and so on.

Figure 13B:
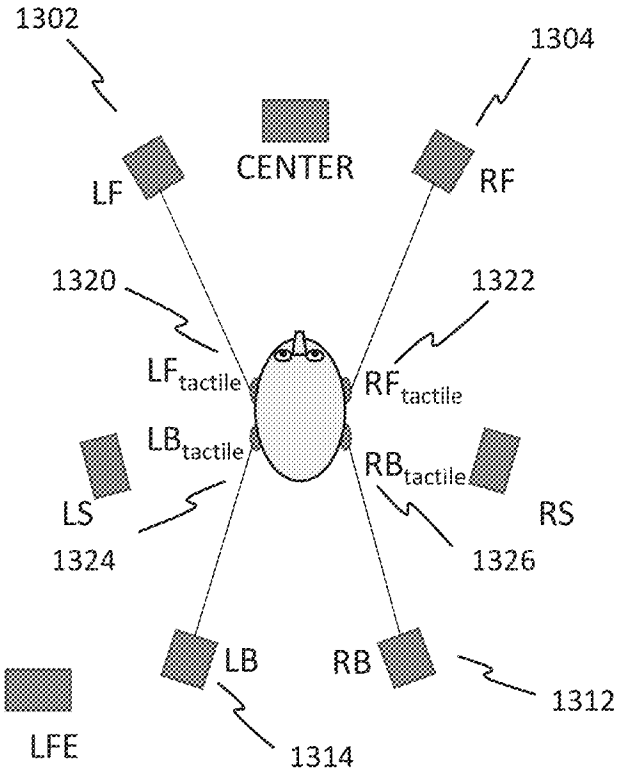
FIG. 13*b* shows a pictorial representation of using multiple tactors to encode multi-channel spatial information, in accordance with various embodiments.
Figure 13A:
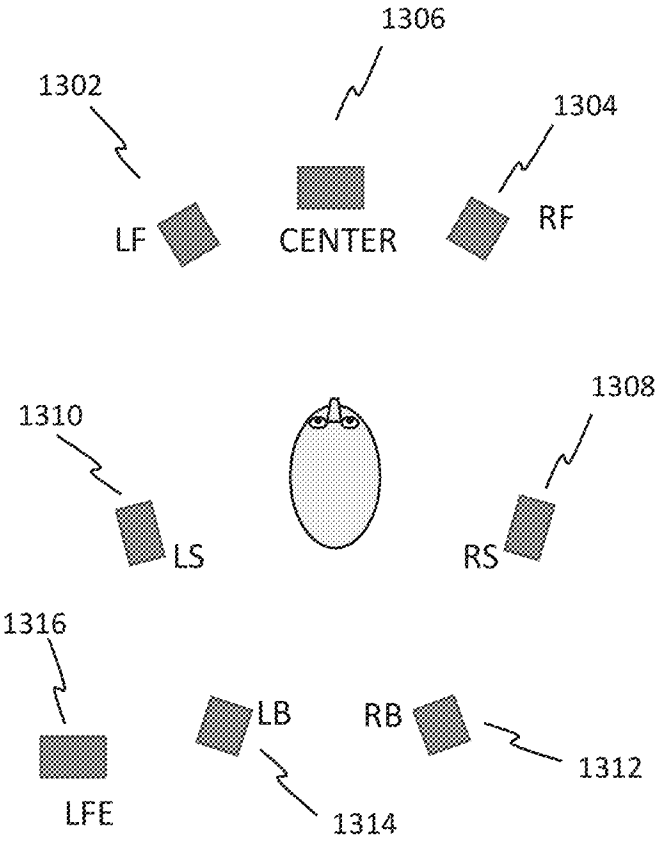
PRIOR ART Fig. 13a
FIG. 13*a* shows a pictorial representation of the channels of the prior art Dolby 7.1 surround sound format.

One example of a widely used spatial coding system is Dolby 7.1, which is used in a variety of equipment including sound cards for personal computers and home theater receivers and processors. As shown in FIG. 13*a*, in addition to the conventional stereo channels for left (front) 1302 and right (front) 1304, Dolby 7.1 presents another 5 channels intended to provide spatial cueing: center channel 1306, right side channel 1308, left side channel 1310, right back channel 1312 and left back channel 1314. Finally, a low frequency channel 1316 is also provided. A single low frequency channel is generally considered adequate for reasons including (a) subwoofers tend to be large and expensive, making it impractical to place multiple subwoofers in most rooms, and (b) because low frequencies when presented as sound waves in a room, are relatively non-directional, so that the added value of multiple, spatially dispersed subwoofers may yield limited benefit relative to the cost.

Other surround standards have included Dolby 5.1 and DTS. Those with ordinary skill in the art will appreciate that the techniques discussed in this document may be applied in those and other similar contexts as well.

There have been multiple commercial products that seek to provide the "surround sound" experience using headphones. Many of these involve providing a relatively large number of conventional drivers within each ear cup. The limited real estate inside a headphone cup generally requires that those conventional drivers be smaller than the drivers in typical stereo headphones, which can compromise audio quality. Furthermore, the close proximity of the drivers, and the difficulty of isolating those drivers from each other, makes providing a convincing experience challenging. Providing a method for mapping the information encoded in Dolby 7.1 to stereo headphones provided with four tactors, on the other hand, presents spatial information without compromising audio quality.

One aspect of the subject invention is a means for using multiple tactors to encode multi-channel spatial information using conventional stereo headphones. A simplified conceptual version of this concept is shown in FIG. 13*b*. Information encoded for left front speaker 1302 is routed to left front tactor 1320; information encoded for right front speaker 1304 is routed to right front tactor 1322; information encoded for left back speaker 1314 is routed to left back tactor 1324; information encoded for right back speaker 1312 is routed to right back tactor 1326.

One drawback to such a simplified approach is that taction is most effective for low frequencies, and tactors are likely to be used with low-pass filtering, so that high frequency content in the surround channels will be filtered out of the taction signal, thereby reducing the surround effect. While tactors alone will not be capable of fully realizing a surround effects, aspects of the subject invention present more sophisticated matrix approaches that can deliver significant surround effects despite these limitations.

Figure 14:
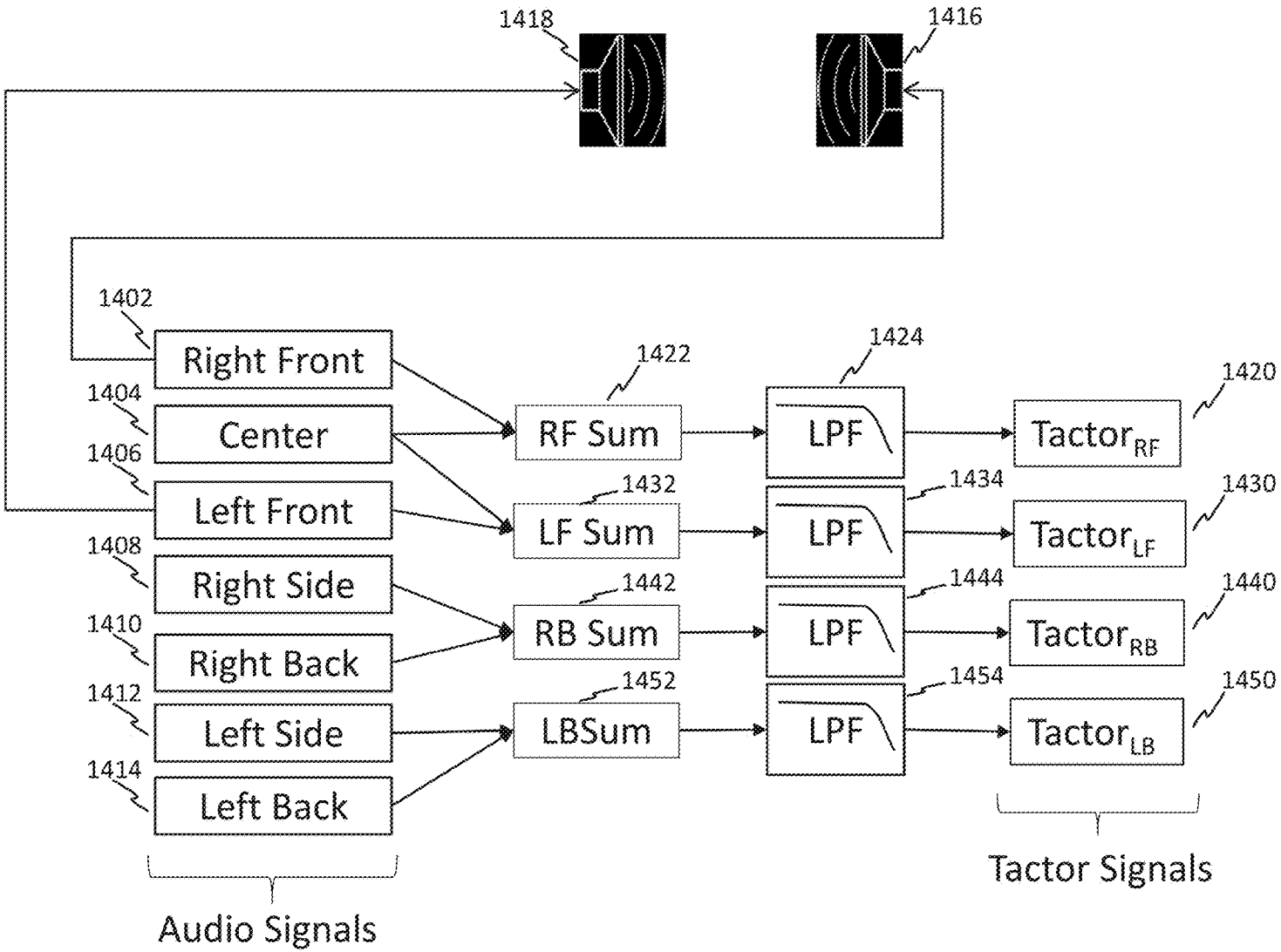
FIG. 14 shows a schematic representation of an exemplary mapping of a 7.1-encoded program to a headphone system consisting of two audio drivers and four tactors, in accordance with various embodiments.

One method of mapping the 8 channels of a 7.1-encoded program to a headphone system consisting of two audio drivers and four tactors is shown in FIG. 14. Signals used to generate tactor output include right front 1402, center channel 1404, left front 1406, right side 1408, right back 1410, left side 1412 and left back 1414. In addition to being processed for taction, right front channel 1402 is also transmitted to the main audio driver for the right headphone cup 1416; left front channel 1404 is sent to both taction processing and to main audio driver 1418 for the left side. The signal sent to the right front tactor 1420 is created by summing 1422 the signals from right front channel 1402 and center channel 1406; passing that signal through low pass filter 1424, and then passing the signal through appropriate amplification, etc. (not shown) to tactor 1420. The signal sent to the left front tactor 1430 is created by summing 1432 the signals from left front channel 1404 and center channel 1406; passing that signal through low pass filter 1434, and then passing the signal through appropriate amplification, etc. (not shown) to tactor 1430. The signal sent to the right back tactor 1440 is created by summing 1442 the signals from right side channel 1408 and right rear channel 1412; passing that signal through low pass filter 1444, and then passing the signal through appropriate amplification, etc. (not shown) to tactor 1440. The signal sent to the left back tactor 1450 is created by summing 1452 the signals from left side channel 1410 and left back channel 1414; passing that signal through low pass filter 1454, and then passing the signal through appropriate amplification, etc. (not shown) to tactor 1450.

Figure 15:
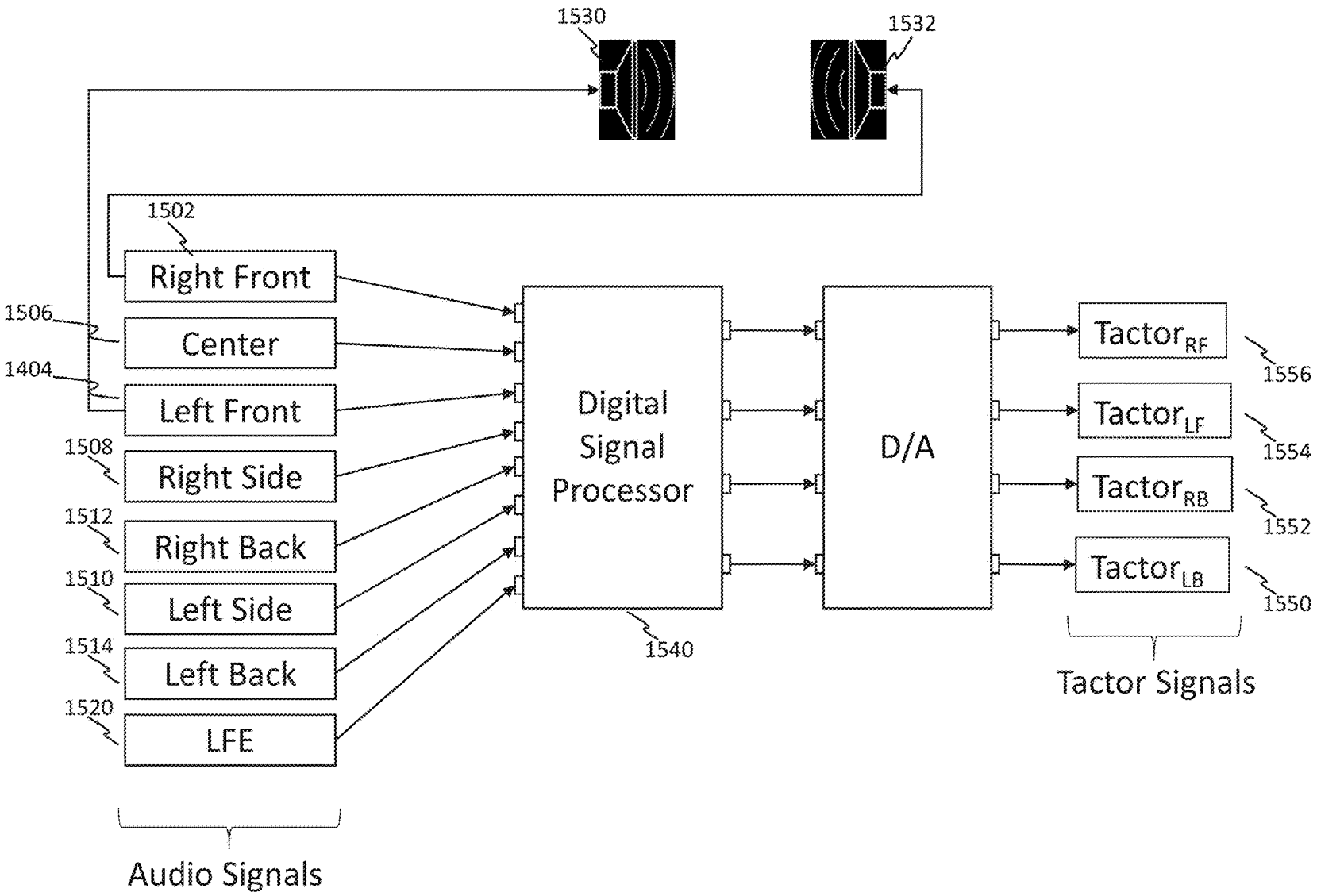
FIG. 15 shows a schematic representation of an exemplary mapping of a low frequency effects (LFE) channel to tactors, in accordance with various embodiments.

In order to achieve these effects, it is necessary for the full multi-channel signal set to reach the processors performing the steps listed above. Thus the result can be accomplished by providing a separate module that is connected between the signal source and the headphones. The signal source may be a game console, home theater receiver or processor, computer, portable device capable of outputting multi-channel audio, or other compatible device. Alternatively, the processors may be located within the headphones themselves, but that approach requires that the information contained in each channel remain separate when conveyed to the headphones, which requires a more complex cable. Alternately, the data may be transmitted wirelessly from the box to the headphone, before or after the summation. An additional alternative is to transmit the audio information to the headphones as an integrated digital signal, with decoding and digital-to-analog conversion taking place in circuitry within the headphones. The particular summing scheme described here is merely an illustrative example, and other relative weight-factors, and additional audio-to-tactile connections are contemplated by the present invention It may be that a movie, game, or song encoded with an existing audio standard such as Dolby 5.1, Dolby 7.1, or DTS already has appropriate low-frequency information in the selected channels that can be present using tactors. In those cases, routing directional cues to the tactors is more straightforward. Or, it may be that a given recording has routed much of the content to a Low Frequency Effects channel (LFE). Where low-frequency content has been routed solely or primarily to the LFE channel, the original information spatial cueing that may have once existed in those signals cannot be perfectly reconstructed. However, given the nature of most naturally occurring sounds, which tend to be comprised of both fundamentals and a series of overtones, a strong impulse in the (directionless) LFE channel, for example, is likely to be correlated with a higher-frequency impulse in one or more of the other directional channels. It is therefore possible to assign the LFE signal to one or more tactors based upon analysis of the signals in the other channels, and thereby providing a significant approximation of a full 5.1 or 7.1 experience with stereo headphones. A simple way to accomplish this is to route low frequency effects to the channel with maximum acoustic power in a specific frequency band, such as the range from 80-200 Hz, as illustrated in FIG. 15.

Figure 18:
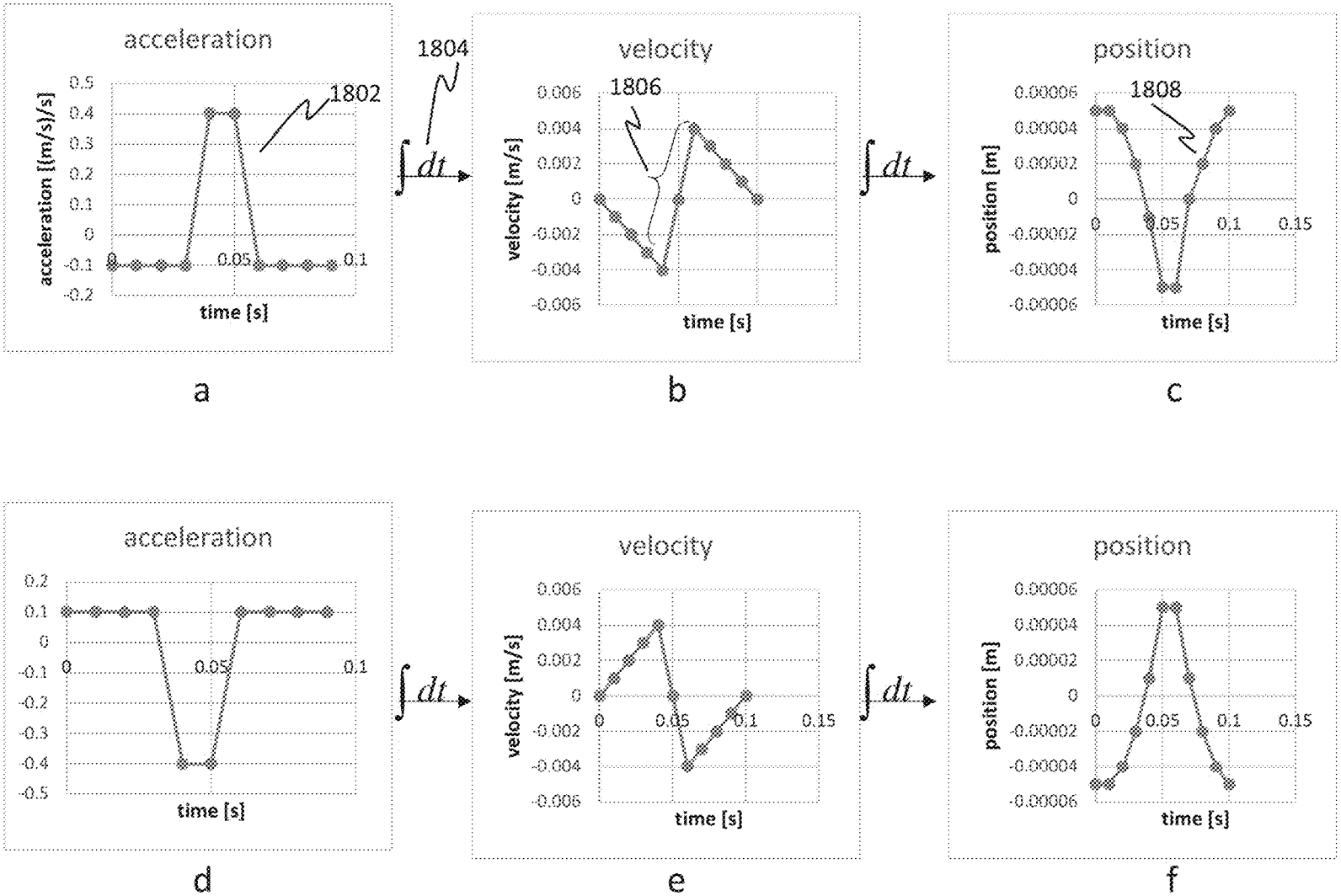
FIGS. 18*a*-18*f* show graphs of waveforms that produce a sense of directed force, in accordance with various embodiments.

Although it is possible to achieve at least some version of the type of processing discussed through analog circuitry, it is significantly simpler to do so in the digital domain. Accordingly, the simplest way to accomplish this processing is prior to conversion of the digital multichannel signals into analog signals. However, it can still be accomplished after D/A conversion; it would then however be necessary to re-convert the signal into the digital domain prior to processing, and then process it through a second D/A converter after processing. FIG. 18 assumes that the input signals are in the digital domain.

Input channels may include right front 1502, left front 1504, center 1506, right side 1508, left side 1510, right back 1512, left back 1514, and low frequency energy channel 1520. Front left 1502 and front right 1504 signals are sent to the conventional drivers 1530 and 1532 (through circuitry that may include D/A converters and amplifiers, not shown) in addition to being sent to the digital signal processor (DSP) 1540. The remaining channels including all surround channels and the LFE channel are sent to the DSP 1540.

In an implementation of this approach, DSP 1540 is used to identify from moment to moment which of the seven directional audio channels contains the strongest signal. If, for example, left rear channel 1514 has the strongest signal (as for example, if the sound of an explosion is to be produced at that location), DSP 1540 will direct the signal from LFE channel 1520 to left back tactor 1550. Similar localization based on activity in the directionally specific channels can be used to direct output to right back tactor 1552, left front tactor 1554, or right front tactor 1556.

While some content presents sounds as being delivered purely by a single channel, modern programming sometimes uses multi-channel content in a more sophisticated way in order to present the illusion that sounds are coming from a place between two discrete outputs. For example, a sound that is intended to sound as if it coming from directly behind the listener may be presented with equal intensity in both the left rear and right rear channel, with no related output in any of the other channels. Such weighting is particularly useful when presenting the illusion of motion, so that sounds move smoothly between channels rather than jumping from one source to another; the weighting adjusts incrementally.

These more sophisticated effects can be produced as well using the subject invention. In some embodiments, the intensity of the signal in multiple input channels could be weighted and the output directed to a combination of tactors in order to approximate the ratios in the directional channels—in essence, multiplying the vector of spatial audio signals by a weighting matrix. Thus, for example, if instantaneous volume levels are 40% of maximum in the front right channel 1502, and 80% of maximum in right side 1508, and zero in the other channels, the taction signal would be divided among right front tactor 1556 and right rear tactor 1552 in order to place the subjective source of the sound reproduced by the tactors at a point between the two, but closer to the front tactor 1556.

One limitation of this approach is that in some contexts (particularly those with multiple uncorrelated events) not all sounds being generated are related to the specific content in the LFE channel. Thus a more sophisticated approach would involve analysis of the signals present in each directional channel. Heuristics can then infer sound direction from the waveforms present in each of those channels. For example, it is likely that the sound of an explosion will result (a) in a specific waveform in the LFE channel, and (b) that one or more directional channels will contain a signal that is correlated with that LFE signal. Factors indicating such correlation might include the degree to which frequencies in the audio channel are harmonics of the frequencies in the LFE channel. Or, the sound-power-level in the best audio channel might have the highest correlation with the sound power level in the LFE, or other factors. Those correlations may be used to inform the DSP as to which of the tactors should receive the LFE signal at a given moment.

In the case of many computer games, and for gaming platforms such as the Sony PlayStation and Microsoft X-Box, the problem of delivering directional bass signals to the appropriate tactor is simpler. Position information about sound sources is often available within game software, and the signal can be processed to activate the correct tactor.

Because game audio requires real-time audio-to-tactile filtering, it is most efficient to do taction processing within game-engine software. This approach does the necessary audio processing within the computer, console or other device, prior to generation of the signals for each channel and subsequent conversion to analog audio, as opposed to the methods previously discussed, in which processing occurs after those steps have already occurred.

Application Programming Interfaces for spatializing sound are standard features of video games and virtual reality simulations. The present invention contemplates extending the capabilities of these code libraries by incorporating the audio-tactile algorithms disclosed herein. The coding conventions now used to process monaural sounds into spatial audio apply in a natural way to the structure of the audio-tactile direction cueing algorithms outlined here. That is, the game or VII engine sends the following data to the spatializing sound function (1) position of a sound emitter relative to the listener's head and (2) the digital file of sound to be spatialized. After processing, the function returns to the game engine, or sends to the sound card (1) a right and left audio signal to display to the user and, optionally, (2) additional audio signals for additional transducers, such as the multiple speakers of Dolby 7.1 format.

The algorithms of the present invention are naturally implemented in this established programming structure. For directional tactile cueing, the general process of changing the signal frequencies (spectral filtering), and introducing appropriate time delays is analogous to the processing required for spatial audio.

The output of tactile directional cueing algorithms may be low-frequency modifications to sounds that will be routed to conventional right and left acoustic drivers. These low frequency signals may subsequently be extracted by low pass filtering at a processing component of the tactor driver. Or the signals may be directed to existing signal pathways that are "vestigial" for headphones, such as the multiple channels that remain unused when headphones are plugged into a Dolby 7.1 sound card. These channels may be attached to tactors instead. Or, the output of the algorithms may be directed to entirely new, dedicated tactile channels, by extension of current audio standards.

Another application for the subject invention involves imparting tactile spatial information to a user. A useful metaphor for the tactile spatialization of sound is the concept of "Liquid Sound." The directed sensation of flowing water is familiar to everyone. It has a vibratory component—the impact of individual droplets—and a directed force component: the net momentum of the water stream. Tactile stimulation that can create a sense of directed force can make natural use of this familiar metaphor to cue the direction of sound.

Figure 16B:
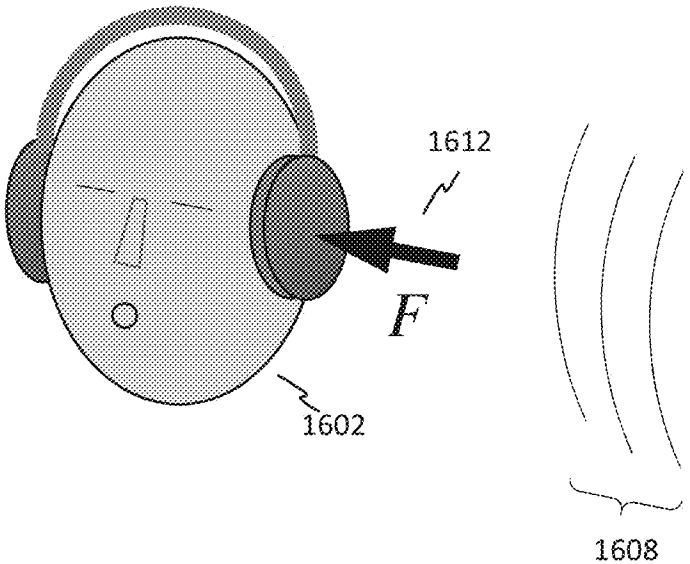
FIGS. 16*a* and 16*b* show illustrative pictorial diagrams of providing a sense of directed force via taction, in accordance with various embodiments.
Figure 16A:
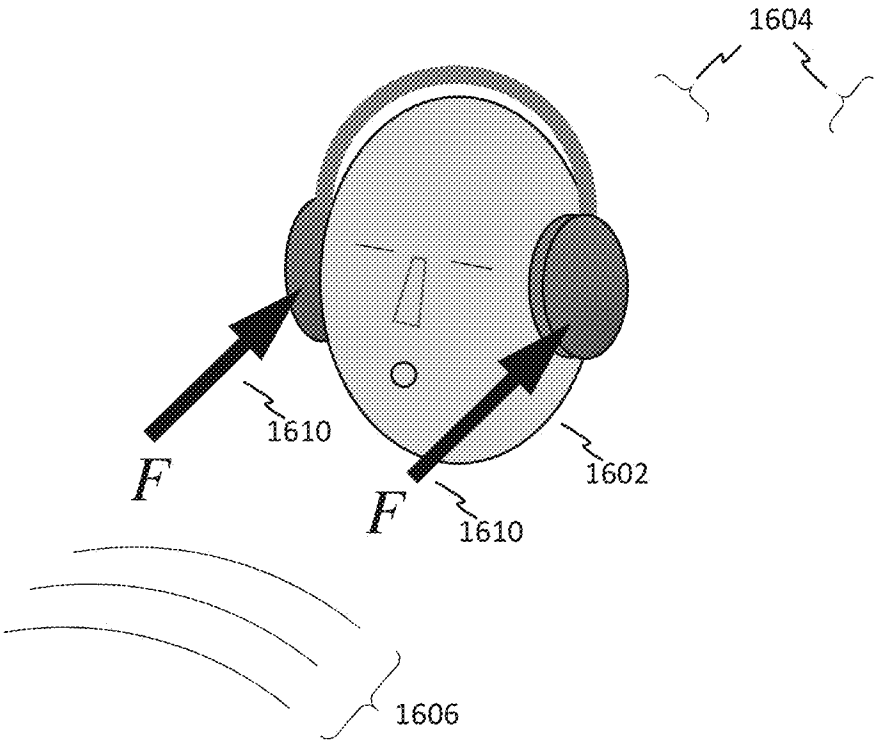

FIGS. 16*a* and 16*b* illustrate this concept. Headphone wearer 1602 listens to sound through headphones 1604. If the sound source is thought of as having a palpable radiation pressure, like water pressure, then sound waves emanating from a source to the front 1606 exert a force 1610 that pushes headphones 1604 backward relative to the listeners head 1602. Sound waves emanating from a source to the side 1608 exert a force 1612 that pushes headphones 1604 to the side relative to the listener's head 1602. And a source to the rear pushes headphones forward, and so on. Through this metaphor, skin tractions may naturally be used to signal the direction of a sound source.

When a conventional symmetrical waveform is applied to the skin via taction in the form of shear vibration, there is no net directional force, and no directional signaling other than that conveyed by the difference in intensity between multiple tactors. That is, in a system comprising x tactors, if all x tactors receive the same symmetrical waveform, no directional cueing takes place. However, when shear vibration is applied to the skin, and the vibration has an appropriate asymmetric acceleration profile, the perception can be one of both vibration and a net pulling force. See T. Amemiya, H. Ando, T. Maeda, "Virtual Force Display: Direction Guidance using Asymmetric Acceleration via Periodic Translational Motion", In Proc. of World Haptics Conference 2005, pp. 619-622. This occurs because the human tactile system is not a perfect integrator, and brief, strong accelerations are felt more than longer weak ones.

Figure 17:
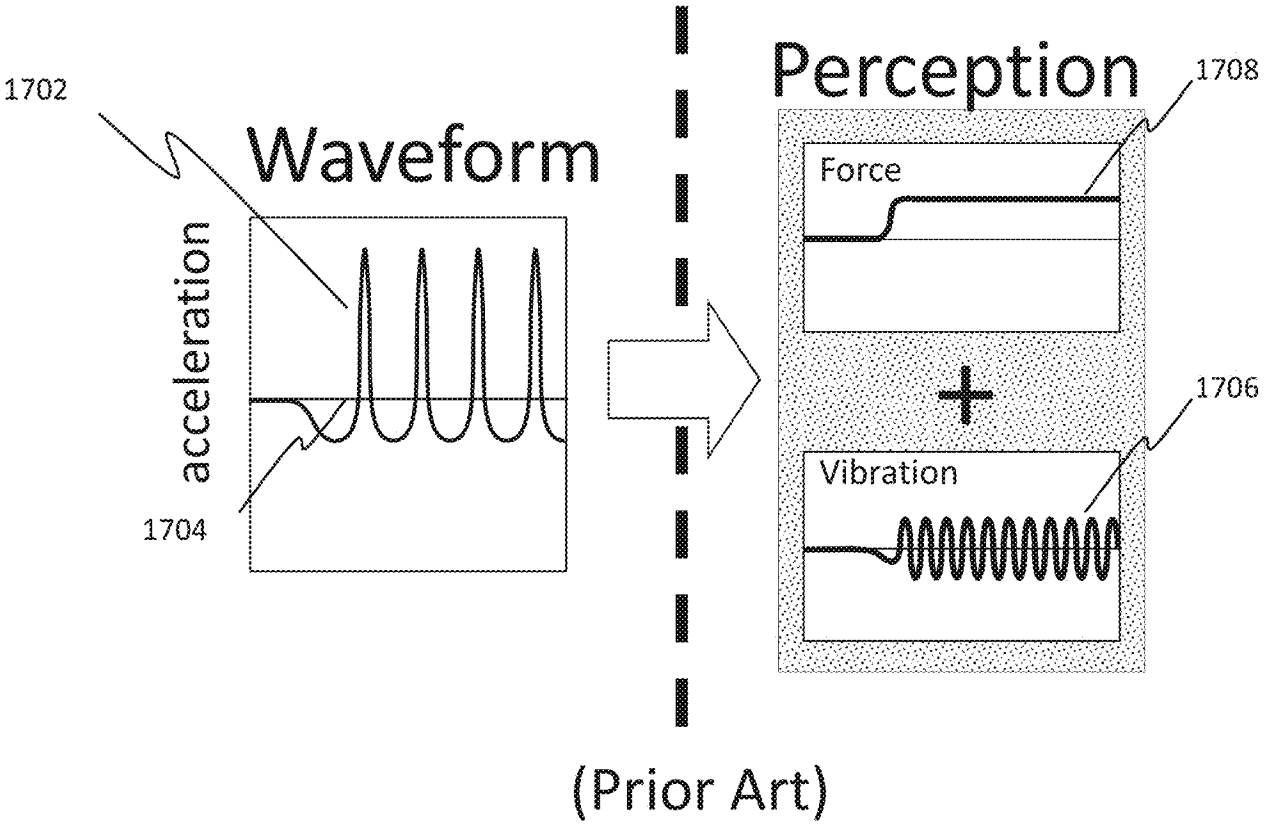
FIG. 17 shows a prior art illustration of a waveform that produces a sense of directed force.

A visual representation of this effect is shown in FIG. 17. An asymmetrical waveform 1702 presents brief, strong acceleration pulses in the positive direction, and longer, weaker accelerations in the negative direction relative to zero line 1704. It has been shown that such a waveform is perceived not as an asymmetric waveform per se, but as an effect having two components: a sensation of vibration at the frequency of the signal input to the tactor 1706, and a sensation of directed pulling force 1708. The technique works best over frequencies between about 7 Hz and 70 Hz, though is effective up to ~250 Hz. In the present invention, we show how to use this illusion to localize sound.

This tactile illusion provides a rich opportunity to convey directional information about sound. It means that a shear tactor located in a left or right ear cup can provide more than just right/left information by virtue of being on or off. It can also provide forward-back information by directing peak accelerations forward or backward. Thus additional directional cues can be derived from fewer tactors.

To do the requisite audio-to-tactile signal processing, it is useful to consider how acceleration pulses that evoke the tactile illusion of directed pulling appear when expressed in terms of velocity and position. This is accomplished by simple integration with respect to time, and it shows that an acceleration pulse is a velocity sawtooth, as illustrated in FIG. 18.

Consider a positively directed acceleration pulse 1802 that evokes a sensation of pulling in the positive direction, as shown in the upper left of FIG. 18 (*a*). Long periods of low acceleration in the negative direction alternate with brief spikes into positive acceleration. Integration of this acceleration signal with respect to time 1804 shows the velocity of this pulse to be a sawtooth wave with the steep part of the sawtooth 1806 directed in the positive direction. It is useful to express the pulse in this form because, as previously discussed, velocity correlates well with perception intensity, and transducers have been developed that respond as velocity sources. Thus, the waveform shown in 1806 is the presently preferred waveform to be fed to a tactor in order to generate directionally biased perception.

In FIG. 18*c*, for completeness, the integration is carried one step further, from velocity to position. Thus graph 1808 represents the characteristics of the positively biased waveform in terms of position over time. Graph 1808 shows that the tactor spends most time in one half of its working range and makes takes parabolic ramps to and from a moment of maximum slope change that occurs in the other half of its working range.

The graphs shown in FIGS. 18 *d, e*, and *f*, show the same graphs, as those in FIGS. 18 *a, b*, and *c*, respectively, except that the pulsatile signal is negatively directed so as to create perceived force in the negative direction.

It should be noted that the equivalent graphs for an un-directed low frequency tone (that is, a sine wave), look very different. The accelerations, velocities and positions—are all simply smooth sinusoids.

When tactors in a wearable device such as headphones are tuned to respond to voltage with velocity, then tactile directional cues may be produced by signal processing methods that turn a low-frequency sine wave (simple vibration) into a saw-tooth wave (directed vibration). The steep part of the sawtooth is the needed acceleration burst. When the position of a sound source is known, as in game software or mixing film audio, the position of the sound source is used to set the polarity and steepness of the burst.

Figure 19:
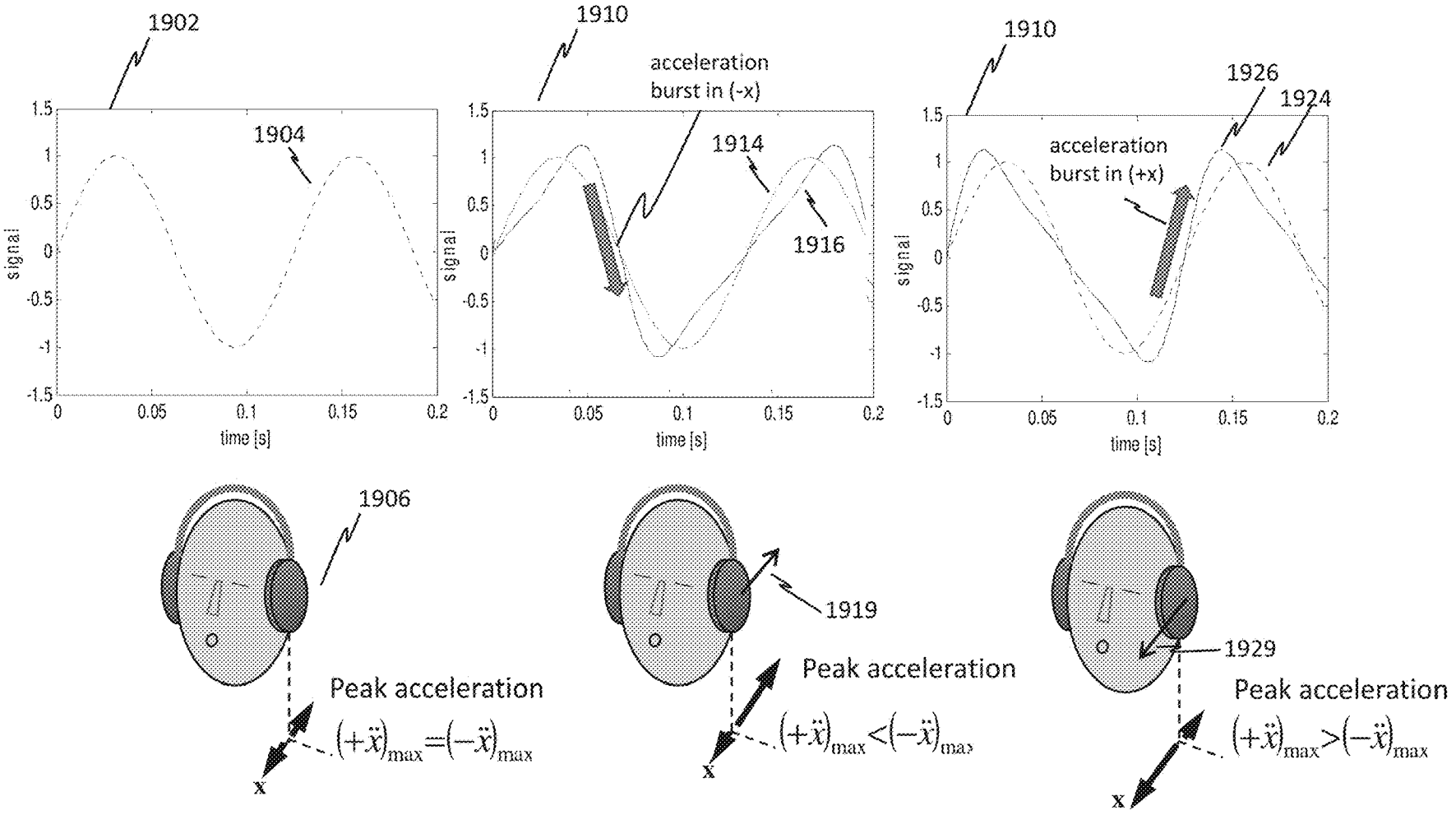
FIG. 19 shows a pictorial diagram illustrating an exemplary method for processing a non-directed waveform into a waveform that produces a sense of directed force, in accordance with various embodiments.

One method of turning a non-directed sine wave into a directed sawtooth is to add higher harmonics. Examples of how this processing affects a sine wave signal are shown in FIG. 19. Graph 1902 illustrates a sine wave 1904. The sine wave has no directional bias, and so the peak acceleration experienced by a person wearing headphone cup 1906 equipped with one or more tactors reproducing that sine wave is equal in both directions, and no net directional force is experienced.

Graph 1910 shows a reference sine wave 1914 identical to sine wave 1904 as well as that waveform processed in order to create polarity and directional cueing, which results in a rough sawtooth wave 1916. (A perfect sawtooth includes all harmonics, and is thus not achievable by a low frequency driver. As a practical matter, adding a few harmonics is currently deemed sufficient and even advantageous.) Rough sawtooth wave 1916 shows a slow rise and a fast fall. It is thus biased in the negative direction, and the person wearing headphone cup 1918 will perceive that the cup is pulling backwards relative to his head, as indicated by arrow 1919.

Graph 1920 shows both the reference sine wave 1924 identical to sine wave 1904 as well as that waveform processed in order to create polarity and directional cueing, which results in a rough sawtooth wave 1926. Rough sawtooth wave 1926 shows a fast rise and a slow fall. It is thus biased in the positive direction, and the person wearing headphone cup 1928 will perceive that the cup is pulling forward relative to his head as indicated by arrow 1929.

Exemplary Matlab code for transforming a non-directed sine wave into a directed one is presented in FIG. 20. The code accepts input signal (x) 2002 and an indicator of, for example, front or back directedness (z) 2004, where z=+1 indicates straight ahead, and z=−1 indicates straight behind. The code adds two higher-order harmonics to the signal to sharpen it into an output (y) 2006. In this example, the contribution of a higher harmonic sin(2θ) is calculated from the input signal sin(θ) by noting that $$2\sin(\theta)\cdot\cos(\theta)=\sin(2\theta) \quad \text{(Eq. 4)}$$

and that $$\cos(\theta)=d/dt(\sin(\theta)).$$

Thus, differentiation of the input signal, and multiplication of the result with the input signal itself is used to produce the desired harmonics. But it will be clear to one skilled in the art that any number of approaches to "sawtoothing" the sine wave can yield the desired result.

Figure 21A:
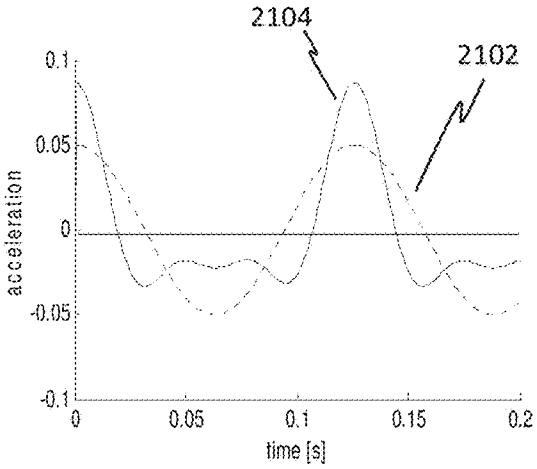
FIGS. 21*a*-21*d* show exemplary graphs of the effect signal processing transforming a sine wave into a directed one, in accordance with various embodiments.
Figure 21B:
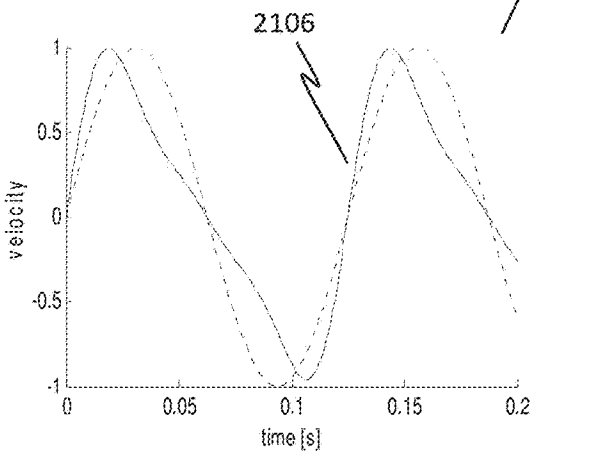
Figure 21C:
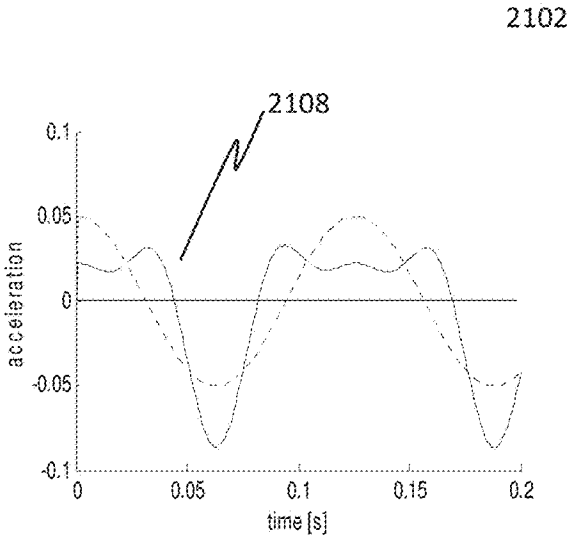
Figure 21D:
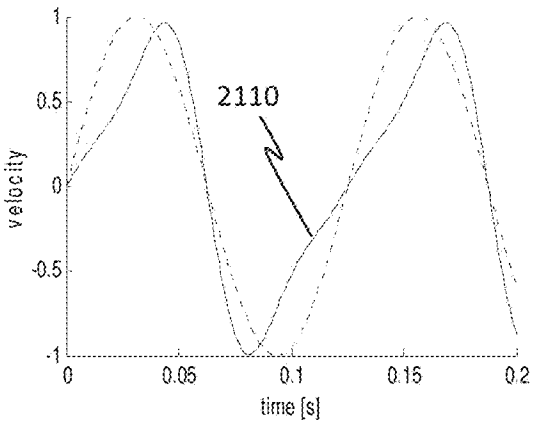

An example of the effect of such processing on a 15 Hz sine wave is shown in terms of the expected velocity and acceleration of a tactor-enabled headphone driven by that signal in FIGS. 21*a*-21*d*. As shown in FIG. 21*a*, a waveform that would have produced simple sinusoidal motion 2102 is converted by the code shown in FIG. 20 into one that produces positively directed acceleration pulses (z=+1) 2104. As shown in FIG. 21*b*, the effect is achieved by commanding the transducer, which acts as a velocity source, to follow the sawtooth with steep regions directed positively 2106, as calculated by the code. Transformation of the signal to produce negatively directed acceleration pulses (z=−1) 2108 is shown in FIG. 21*c*. The accelerations are produced by the transformed velocity command 2110 in FIG. 21*d*.

Figure 22:
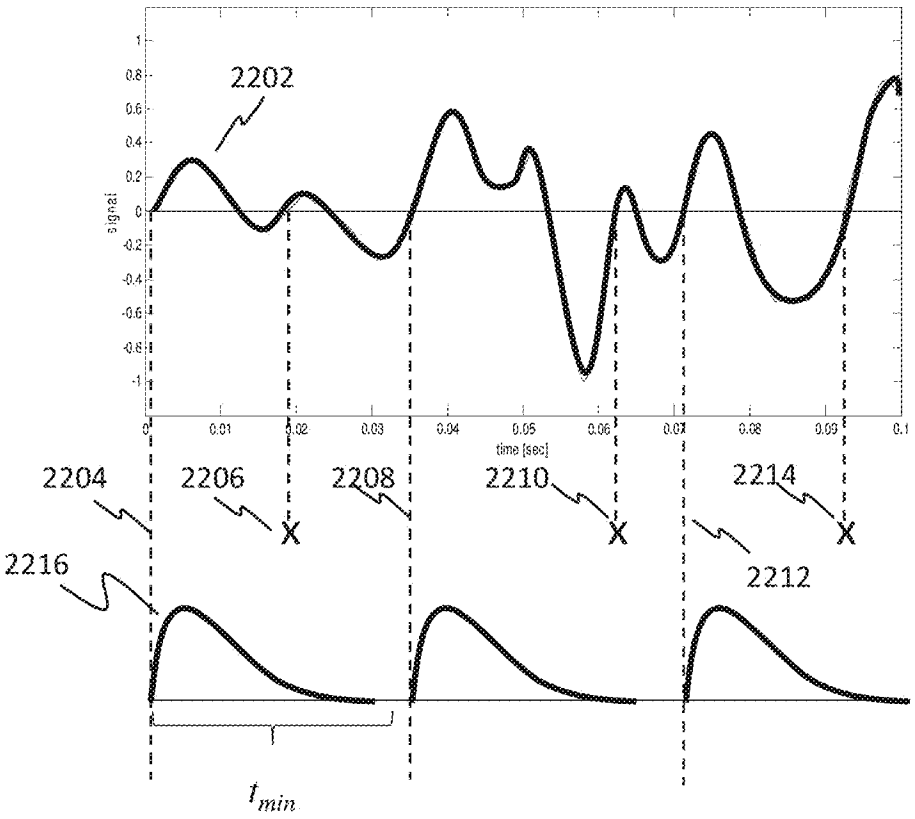
FIG. 22 shows a graph of another exemplary method for transforming a non-directed sine wave into a directed one, in accordance with various embodiments.

This harmonics-based filter (which synthesizes higher harmonics based on the frequency of the fundamental) is just one exemplary method for creating the same directed effect. One possible disadvantage of this particular approach is that the velocity calculation step is sensitive to noise. This may in some cases increase distortion. Another exemplary method for adding directionality that does not have those effects is to detect zero-crossings and add a polarizing bump to the signal when appropriately-directed crossings are detected. A graphic representation of this approach is shown in FIG. 22.

Audio waveform 2202 is a complex signal. The portion of the signal displayed includes 11 zero crossings. It should be noted that adding a positive pulse at an upward zero crossing produces a smooth, continuous, and positively-directed directional signal, while adding a negative pulse at downward zero crossing smoothly produces the opposite result. Thus when seeking to produce a directional cue, on average half of the zero crossings will be appropriate to modify and half will not. In the illustrated example, the six negative-to-positive crossings are at 2204, 2206, 2208, 2210, 2212 and 2214. A pulse 2216 of a given duration, $t_{min}$, is added when an appropriate zero crossing is detected at 2202. To prevent prematurely re-triggering the pulse, once a first pulse is triggered, additional zero-crossing are disregarded until $t_{min}$ has elapsed. Thus negative-to-positive crossings 2206, 2210 and 2214 do not receive the polarizing bump because they are too temporally proximate to the previous pulses. By this means, a series of directed asymmetric velocity pulses may be added to an audio signal at a frequency approximately equal to ($1/t_{min}$). By adding these pulses at zero crossings, audible discontinuities in the signal are avoided.

This approach has the advantage of simplicity and robustness. If a pulse shape and frequency that best evokes the haptic illusion of directed pulling is determined, for example by deconvolution, it guarantees that exactly this signal is added, and that it is added at approximately the best frequency. It is an approach that prioritizes the directed pulling sensation.

In contemplating the range of processing techniques that may produce the directed pulling sensation, this approach lies at one extreme. It is almost indifferent to the input signal. At the other end is the first algorithm presented, in which the sharpening harmonics are derived entirely from the input signal. In this range, one skilled in the art may imagine a variety of processing techniques, some that conform more closely to the input signal, and others that prioritize production of the directed tactile illusion. These two non-limiting embodiments merely serve to illustrate the range of techniques for processing audio into directed tactile sensation that will occur to one skilled in the art.

Pseudocode and an illustration of the zero-crossing method are provided in FIG. 23. An upward directed zero-crossing detector 2302 monitors the input signal for moments when the last point was below zero, and the next is above it. When this occurs it raises a flag by setting ("upzerocross=1"). A next block of code 2304 checks to see if the "upzerocross" flag is up, and if it is time to play a bump (testing to see whether $t_{elapsed}>t_{min}$). As long as this is true the code pointwise adds the bump to the input signal. A third block of code 2306 detects that the bump is completely played (i>bumplength) and, if it is, resets the flags to prepare for playing the next bump. It will be apparent to one skilled in the art that the introduction of a signed variable for bump direction and size, analogous to (−1<z<1) used in previous illustrations, may be introduced to trigger detection of downward going zero-crossings, and addition of negatively directed pulses. Likewise, intermediate values of this "z" direction variable will be suitable for scaling the size of the bump to vary the pulse intensity.

Many other synthesis or filtering methods are possible, and fall within the scope of the present invention. Generally speaking, appropriately-directed acceleration bursts consonant with the existing low-frequency audio (that is, appropriately related both harmonically and temporally) can be generated, where the polarity and sharpness of the bursts indicate the direction and proximity of the sound source.

An advantage of the "bump" method of adding these bursts is that the shape of the bump can be tailored to the step response of the wearable system. That is, the bump can be whatever wave shape best produces the desired acceleration burst on the body. The shape of this wave can be found, for example, by deconvolving the desired velocity profile with the step response of the system.

Despite best design efforts, an inertial tactor cannot be a perfect velocity source. There are several limitations on performance. The rate of velocity change is limited by peak power. The peak velocity is limited by damping. The velocity can go in one direction for only a limited time before the inertial mass hits a travel stop. The overall system of tactor, headphone, and head may be slightly underdamped, and therefore remain in motion after zero velocity is commanded. Furthermore, different users with different skin mechanics will introduce different stiffness and damping into the system, altering the system response. For all these reasons, inertial tactors are an imperfect velocity source.

In the presence of these limitations, the degree to which the system follows a desired velocity trajectory can be improved with signal processing. Deconvolution, for example, may be applied to a target tactor velocity signal, so that the tactor does the best possible job of reproducing it. A full discussion of deconvolution is beyond the scope of this disclosure, but briefly, the steps are these.

First, the deconvolution filter is found with the following steps:

(1) apply a voltage pulse (d) to a tactor in the system;

(2) measure the velocity response (b) of the system, for example via the signal of an accelerometer on an ear-cup, appropriately integrated in order to determine ear cup velocity;

(3) calculate the Fourier transform of the detected pulse (b);

(4) calculate the Fourier transform of the desired voltage pulse that was applied to the system (d); and (5) calculate the frequency response of the filter. The frequency response of the filter (f) is the frequency spectrum of the desired pulse, (d), divided by the frequency spectrum of the detected pulse (b).

A deconvolution filter that gives good results for most people may be found by testing tactor-equipped headphones on multiple people and averaging their deconvolution filters. Alternately, a user-specific custom filter can be determined by the system automatically upon startup. To do this the system follows steps 1-5 upon startup. To use the deconvolution filter, the following steps are undertaken:

(6) in suitably-sized blocks, the Fourier transform of the target signal is calculated, including both amplitudes and phases;

(7) in the Fourier domain, the spectrum of the target signal is divided by the Fourier spectrum of the deconvolution filter;

(8) the result of this division is transformed back from the Fourier domain to the time domain in order to get the corrected signal; and (9) the corrected signal is sent to the tactor.

In view of the above, one skilled in the art will understand that applying a deconvolution filter to an input signal can correct, to limited degree, deficiencies in the ability of a tactor to faithfully reproduce the target velocity signal. Limitations of the deconvolution approach include sensitivity to noise, and the introduction of lag. Thus, it is particularly appropriate for offline processing. A good application of deconvolution processing is to determine the voltage signal that best produces a velocity sawtooth that makes an acceleration pulse that evokes the tactile illusion of directed pulling.

A logical place to implement this kind of directional filtering is in the audio API of a game engine, for real-time processing. For offline work, the directional filtering can be embodied in plug-ins for sound editing software, such as in VST or AU plugins, for example.

Figure 24:
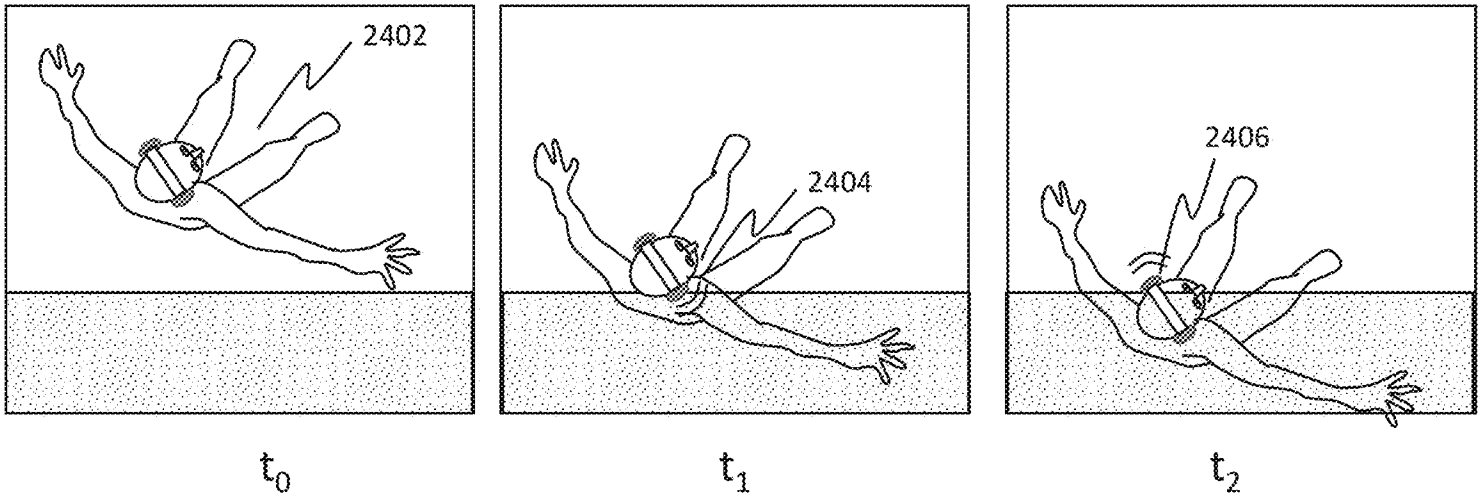
FIGS. 24-26 show pictorial representations of providing temporally based tactile sensations, in accordance with various embodiments.

As discussed above, asymmetric waveforms can be used to present directional effects with tactors. Additional effects can be presented (or other effects can be made more convincing) by using tactile timing cues for signaling the direction of a sound source. Because the speed of sound in air is fast (~343 m/s), the interaural time differences normally used by our audio cortex (that is, differences in arrival time of sound waves between our two ears) are short (sub-millisecond). Applying such short delay may be effective in synthesizing locational cues when applied to conventional drivers in headphones. Unfortunately, this timescale is too short for the tactile system, which is "blurry" by comparison the human body perceives tactile events less than about 20 milliseconds apart as simultaneous. One may imagine, however, that a time interval perceptible to the tactile system would occur if, for example, one could fall slowly into water, as illustrated in FIG. 24.

At time $t_0$, subject 2402 has not yet contacted the water. Tactor-equipped headphones would ordinarily not be called upon to produce any effect related to the impending event. At time $t_1$, the right side of the head of subject 2402 has entered the water. In order to simulate this effect, one or more tactors in right headphone cup 2404 would generate a pulse. At time $t_2$, the left side of the head of subject 2402 has entered the water. In order to simulate this effect, one or more tactors in left headphone cup 2406 would generate a pulse. The delay between the first pulse in right headphone cup 2404 and the second pulse in left headphone cup 2406 could reinforce the illusion of that event. That is, the water line might nudge a closer ear cup first at time $t_1$ and a further ear cup second at time $t_2$. In the absence of all other information, the relative timing of the events would provide some information about the orientation of the water surface relative to the head.

Absent specific preparation as described below, no preloading or other preparatory action is generally taken in the use of tactors or loudspeakers. The maximum force a tactor can generate is defined at least in part by its maximum travel and the maximum speed with which it can cover that distance. Tactors, such as those described herein, are likely to move more or less symmetrically about a resting position. In the simplified case in which a tactor is completely idle until time $t_1$, at which point it is called upon to deliver a single maximal impulse, only half of the total potential travel of the tactor is available.

A method for increasing the capacity of tactor to convey such an effect would be to use a low-velocity signal to give the tactor a "backswing," allowing it to reach maximum travel in the "minus" direction immediately before it is asked to deliver a maximal pulse in the positive direction, and vice versa in the opposite case. If the "backswing" is sufficiently slow, it will be imperceptible to the wearer, but this technique will effectively double the power available for single impulse without requiring a more massive tactor or a more powerful amplifier.

Delivering such an effect requires a preview capability: the ability (preferably in the digital domain) to insert a backswing into the signal stream before the event that is to be modified. Inserting this pre-pulse "backswing" is straightforward when processing sound files offline, such as in the production of sound for movies and music. In real-time spatial audio applications, such as computer gaming and virtual reality, a reasonable approach is to include the "back swing" at the end of the pulse. Although the first pulse in a train of pulses does not get the benefit of a back-swing, all subsequent pulses do, and no lag is introduced into the system. With this approach, the backswings will generally (but not always) be correctly oriented, since the direction of a sound emitter in a virtual environment changes slowly with respect to the frequency of the pulses. In situations with multiple sound emitters from multiple directions (requiring oppositely directed backswings), this approach degrades naturally to be no better or worse on average than performance without backswing.

Figure 25:
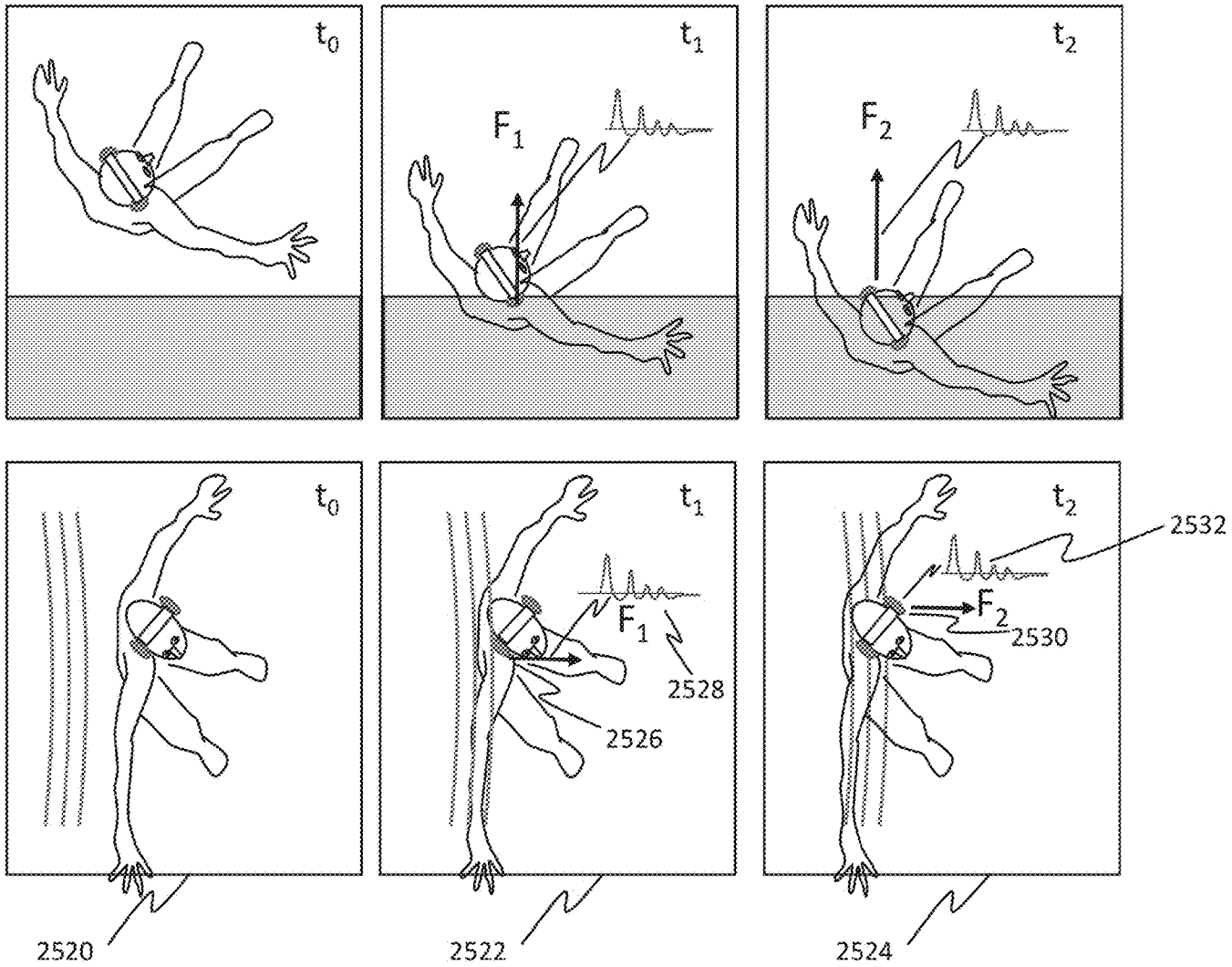

This general idea about timing and directional taction (Liquid Sound) can be extended from the situation of falling slowly into water to perceiving a very slowly moving shock wave in air, as shown in FIG. 25. Images 2502, 2504 and 2506 show the same conceptual scene discussed with respect to FIG. 24, as observed at times $t_1$, $t_2$ and $t_3$, respectively. At $t_1$, force $F_1$ 2508 pushes against the right side of the subject's head; the tactor in the right ear cup generates waveform 2510 in order to simulate that force. At $t_2$, force $F_2$ pushes against the left side of the subject's head; the tactor in the left ear cup generates waveform 2514 in order to simulate that force. From that conceptualization one can imagine how tactors can simulate a slow shock wave emanating from any given sound source. The key is to make the interval between arrival times long enough for the tactile system to perceive. Studies with low-resolution tactors applying tones to the back of the torso have shown that time intervals for delays between tactors in the range 20-120 milliseconds are most useful for conveying a sense of fluid tactile motion.

Accordingly, an aspect of the subject invention is to cue sound direction by processing audio so that amplitude of a tactor farther from a sound source is kept low for an interval long enough for the tactile system to perceive the onset difference (e.g. 50 milliseconds). This adds a tactually perceptible time difference cue to the acoustically perceptible interaural time difference cue that the nervous system already uses to localize sound. Thus in FIG. 25, at time to as shown in image 2520, the shockwave has not yet reached the (headphone-wearing) subject. At time $t_1$, as shown in image 2522, the shockwave has reached the right side of the subject's head, which is simulated by the tactor in the right headphone cup 2526, which produces waveform 2528. As the simulated shock wave reaches the subject's left ear at time $t_2$ as shown in image 2524, the tactor in left headphone cup 2530 produces waveform 2532.

Figure 26:
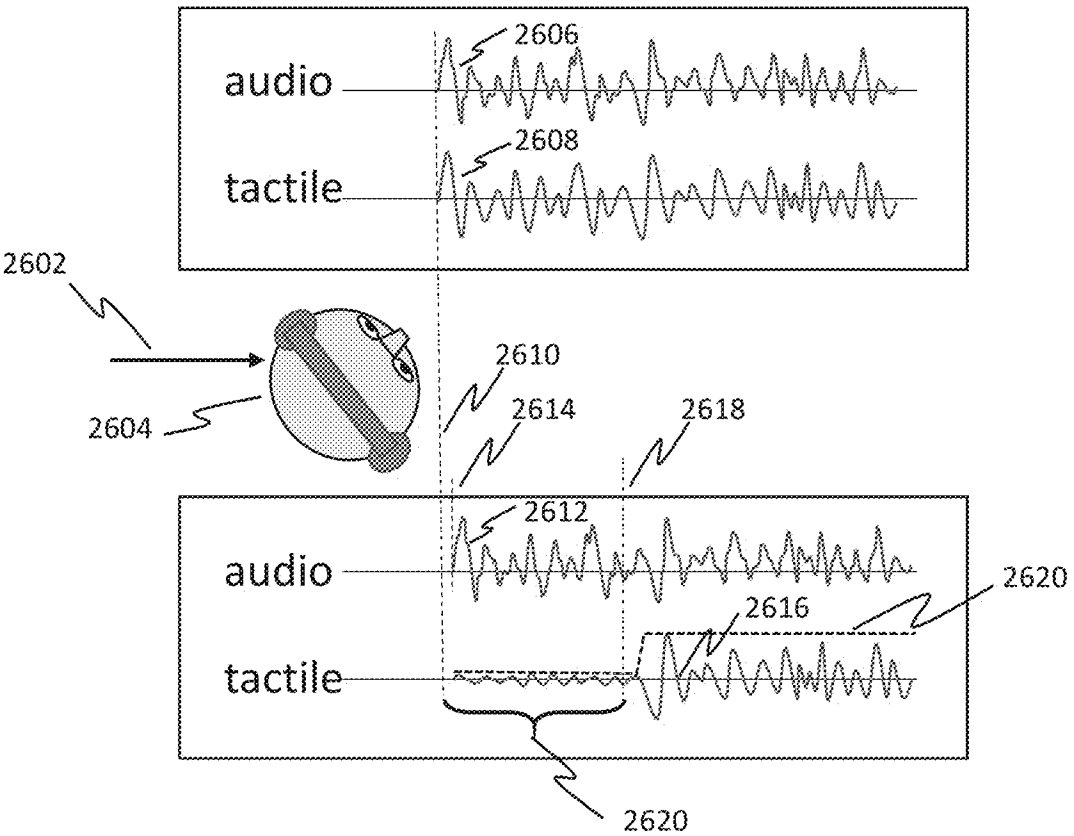

Another view of this method for delivering spatial cueing is shown in FIG. 26. What is represented is a method for rendering a tactile inter-aural arrival time cue that is long enough for the tactile system to perceive, so as to cue the direction of a sound 2602 arriving at the head 2604. The signals sent to the ear closer to the simulated sound source (in this case the left ear) includes audio signal 2606 and tactile signal 2608, which are both presented to this side without any delay at time 2610. The ear that is further away from the simulated sound source (in this case, the right ear) receives signals related to the same event, but with delays. This ear receives audio signal 2612 at time 2614, about 0.4 milliseconds after time 2610. The more distant ear receives tactile signal 2616 at time 2618. The delay 2620 between the closer tactile signal initiation point 2610 and the more distant side tactile initiation point 2618 is delay 2620, which may be two orders of magnitude longer than the delay in the audio signal, since the auditory system intuits direction from delays of around 0.4 millisecond, and the tactile system intuits direction from delays of around 40 millisecond.

The delay 2620 between tactile signal 2608 and tactile signal 2616 may be produced in a number of ways. One method is to apply an envelope filter 2620 to tactile signal 2616, with the duration of the "closed" phase of the envelope filter's action timed to equal the desired delay. However, for events of very short duration, this method may eliminate a significant portion of the desired signal. Thus another approach would be to produce the same signal in the delayed channel as in the non-delayed channel, but provide delay, a process best performed in the digital domain, though analog delay lines could also be used.

A number of variations on this general approach are contemplated. The signals sent to the left and right tactors may be the same, so that only the time delay distinguishes them. They may be different, so that additional cues are provided by other characteristics such as phase differences, amplitude differences and the like. More nuanced presentation is also possible if more than one tactor is present on each side. Each tactor may also use filtering and/or waveform synthesis in order to provide polarization of one or more of the signals, as described above. These techniques may be combined in order to enhance the effect.

Some previously discussed embodiments assume that the tactor is rigidly mounted to the cup of the headphone. This approach requires that the tactor move at least the entire mass of the headphone cup, and in many cases some portion of the mass of the rest of the headphone system, in order to produce motion at the wearer's skin. This approach is analogous to holding one's hand against the side of a bookshelf loudspeaker: in order to produce sensible vibration, the driver must not merely excite air, as loudspeakers are intended to do; it must shake the entire cabinet, which is considerably more demanding. Thus significant force is required to excite the entire headphone cup, which necessitates a relatively powerful motor and amplifier, as well as a large battery or other power source.

It would be advantageous to provide a method for producing tactive forces without having to excite the relatively large mass of the entire headphone assembly. An additional aspect of the subject invention is therefore the use of tactive cushions movable on actuated plates that are partially decoupled from the headphone cups, so that the cushions efficiently transmit shear to the skin without having to excite the mass of the rest of the headphone assembly.

It is clear that there are some advantages to this approach over vibrating an entire ear cup, as disclosed in application Ser. No. 14/864,278, now issued as U.S. Pat. No. 9,430,921. If only the cushion is moved, as opposed to the entire headphone assembly, the effective moving mass is reduced and less force is required for a given tactive output. Also, everything in the headphone that is not the cushion becomes a reaction mass (analogous to the cabinet of a conventional loudspeaker when producing sound waves), providing a heavier platform for the cushion to push off of, enabling the tactor to provide output at lower frequencies.

Figure 27:
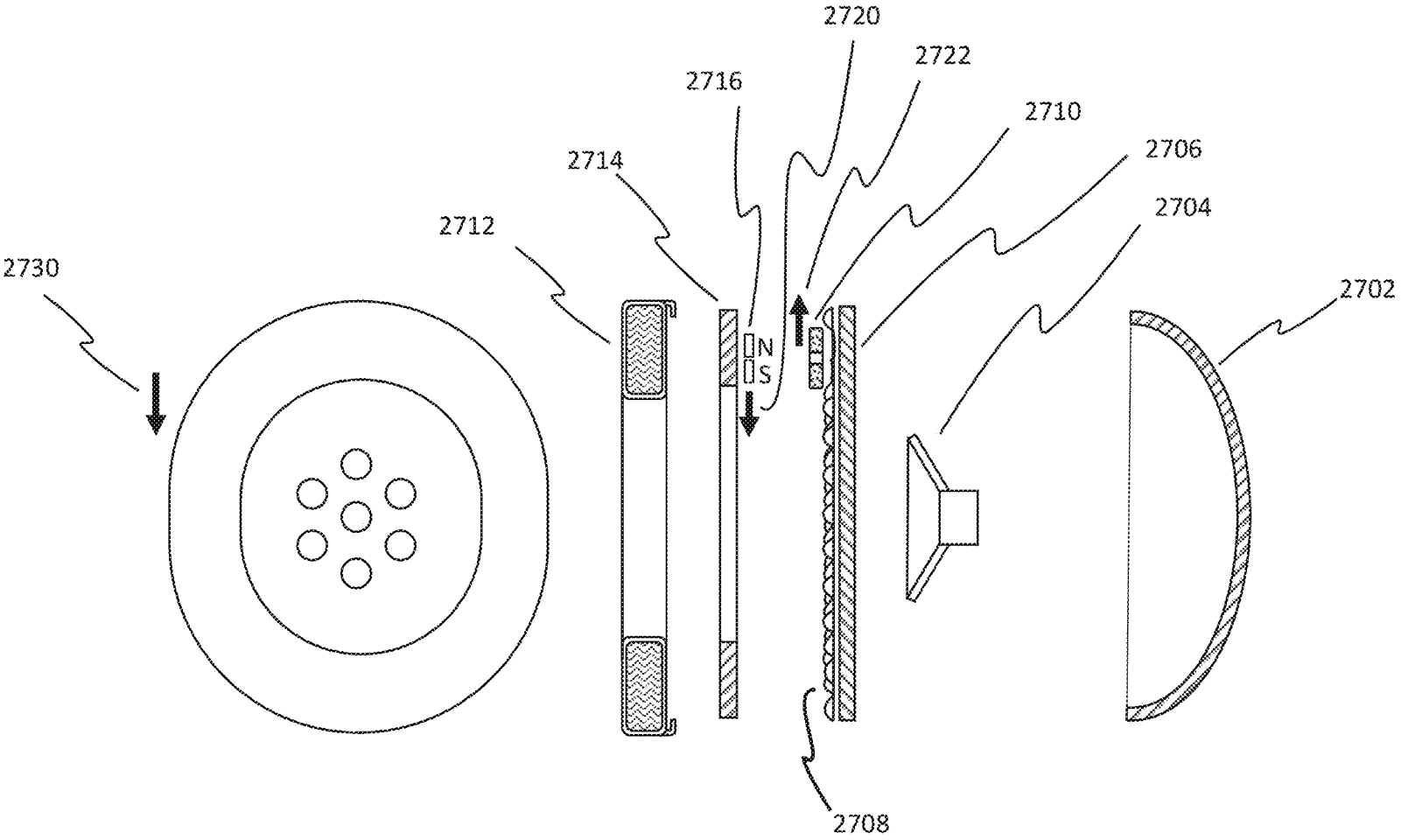
FIG. 27 illustrates simplified partial plan and exploded sectional views, respectively, of components that may be used in order to move a cushion independently of the headphone housing with taction, in accordance with various embodiments.

FIG. 27 illustrates simplified partial plan and exploded sectional views of components that may be used in order to move a cushion independently of the headphone housing with taction. Ear cup 2702 and sound baffle plate 2706 are rigidly connected to each other, and form the enclosure for audio driver 2704. (As previously discussed many variations on these structures are possible, including multiple drivers, open-backed headphones, etc.)

The conformable portion of cushion 2712 is rigidly coupled to moveable stage 2714. In a conventional headphone, the cushion would be attached to the cup and/or baffle plate 2706 so as to allow minimal shear motion of the cushion relative to the baffle plate, and to damp whatever motion is permitted. In the subject invention, moveable stage 2714 is permitted to move relative to baffle plate 2706 by suspension 2708, described in greater detail below.

One or more tactors are mounted so as to provide motive force to the moveable stage relative to the baffle plate. This may be accomplished, for example, by attaching magnets 2716 to moveable stage 2714, and electrical coil 2710 to the baffle plate. When current is applied to coil 2710 in the form of a waveform the magnets attached to the stage experience a force in one direction 2720, and coil attached to the baffle plate experiences an equal force in the opposite direction 2722. Where cushion 2712 and moveable stage 2714 together have significantly lower mass than baffle plate 2706 and all of the elements rigidly attached thereto, the primary result will be the desired motion 2730 of the stage 2714 and cushion 2712 (shown in plan view), applies shear traction to the skin of the wearer.

The suspension of a tactor as movable cushion must meet a daunting array of challenges. In the preferred embodiment, it should be thin, drop-proof, allow multiple degrees of freedom, limit over-travel, and be silent.

Figure 28:
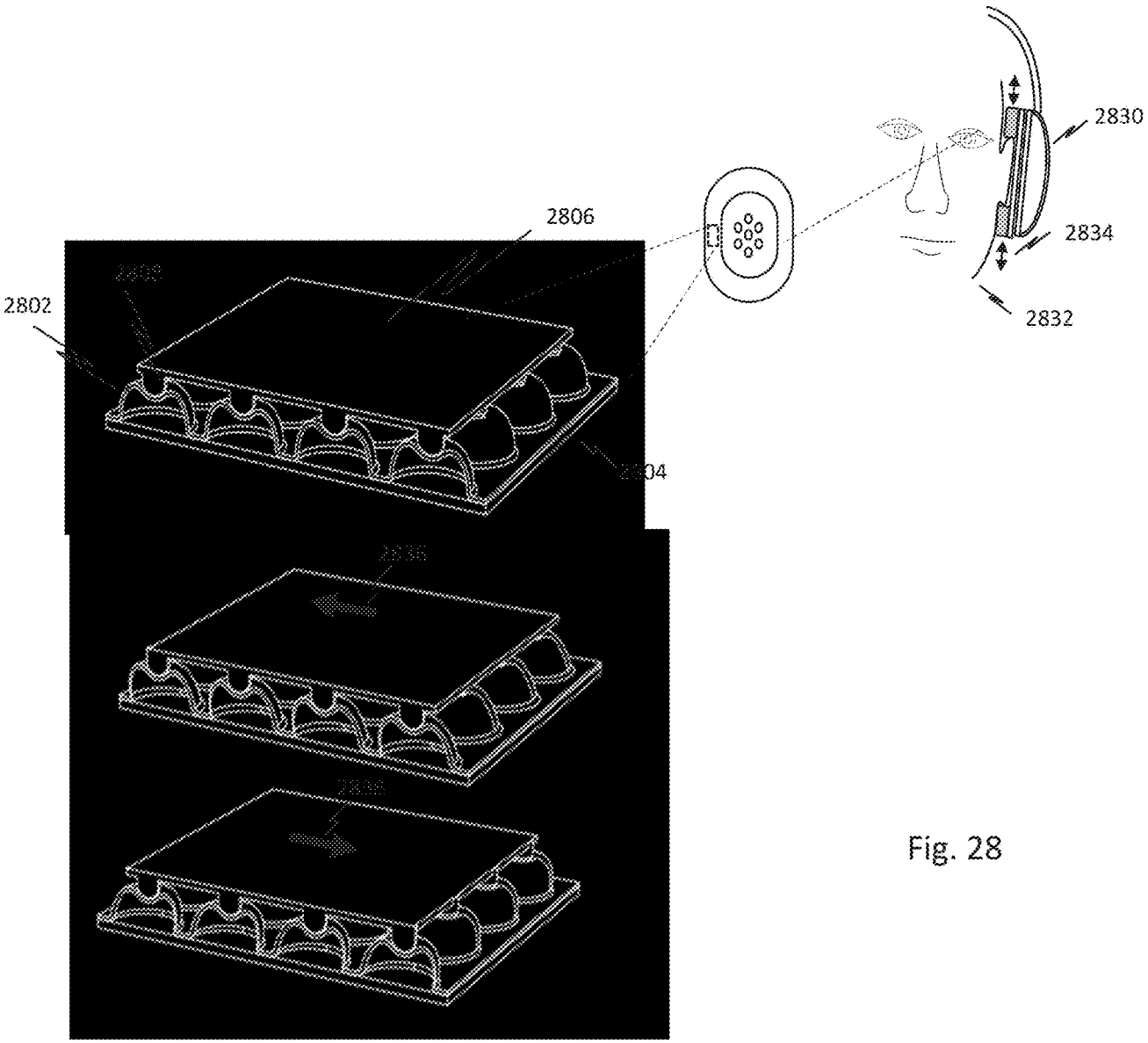
FIG. 28 shows perspective views of a suspension system that includes elastic domes resting on a first plate and supporting a second plate having projecting bosses that partially deform the domes, in accordance with various embodiments.

A first example of such a suspension is shown in FIG. 28. The suspension system includes elastic domes 2802 resting on a first plate 2804 supporting a second plate 2806 with projecting bosses 2808 that partially deform and ride domes 2802. Domes 2802 may be filled with air or fluid that may damp audible vibration. One of the plates may be, for example, the sound baffle plate of a headphone, and the other may be a movable stage carrying the cushion of said headphone.

Such a suspension system may be mounted so that both the first plate 2804 and second plate 2806 are mounted between headphone cup 2830 and the rest of the headphone system, so that both plates are roughly parallel to the sagittal plane of the listener's head 2832, and relative motion 2834 is enabled between the stage 2806 that carries the cushion and headphone cup 2830 along an axis parallel to the sagittal plane.

When tactive force 2836 is applied, plates 2806 and 2804 attempt to move relative to each other, and elastic domes 2802 deform as bosses 2808 move against the domes. When the opposite force is applied 2838, the domes distort in the other direction. Because the domes are elastic, they provide restorative force as well as a measure of damping.

Figure 29A:
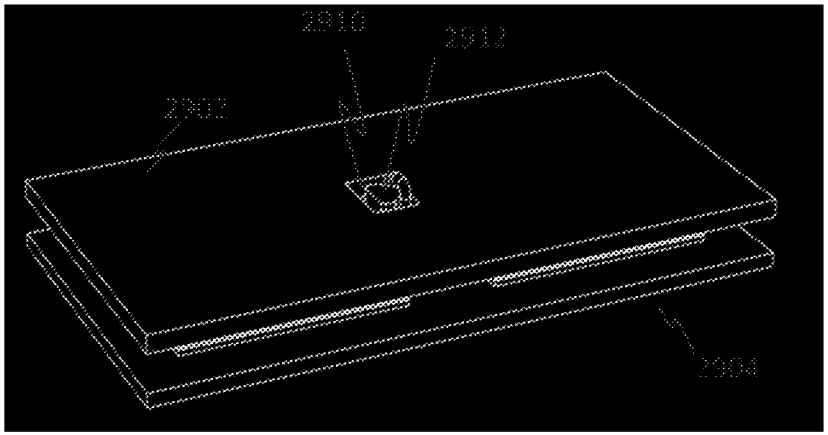
FIGS. 29*a* and 29*b* show alternative perspective views a suspension, in accordance with some embodiments.
Figure 29B:
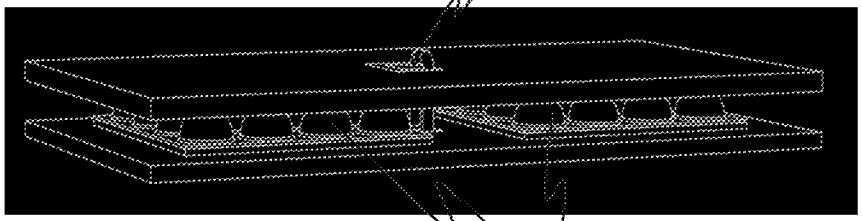

Such a suspension system may require restraining means so that the cushion assembly is generally attached to the cup assembly. One means for restraining the cushion assembly is illustrated in FIGS. 29*a* and 29*b*, which show alternative perspective views of suspension system 2900, in accordance with some embodiments. As discussed in relation to FIG. 28, the suspension system may include two plates 2902 and 2904. Suspension means 2906 located between them may not inherently prevent the two plates from separating. One mechanism for performing that function is an elastic loop 2908 firmly attached to one plate and protruding through an opening 2910 in the other plate. A guiding feature 2912, such as a hook or a loop sized to hold the elastic loop 2908 firmly attached to the second plate prevents the two plates from pulling apart. Movement of the cushion relative to the baffle plate may be produced by fixing a coil to the baffle plate and a pair of transversely-polarized magnets to the stage so that energizing the coil moves the stage and the cushion attached to it.

Components of a second suitable suspension are shown in FIGS. 30*a*-30*d*. As illustrated in exploded perspective view 30 *a*, suspension system 3000 includes an elastic ball bearing 3002 tethered in place with elastic tether 3004 so that it cannot contact the edge of the ball cage 3005. To further quiet the device, vibration of the tethers may be damped by a ring of damping material 3006. Ball cage 3005 may include features including tabs 3008 that retain damping ring 3006 and help it maintain contact with tethers 3004, and slots 3010 that may provide clearance for tethers 3004. Assembled tethered ball bearing 3012 is illustrated in FIG. 30 *b*.

One direction a tethered ball bearing allows is axial motion transverse to the orientation of the tether. Thus as illustrated in FIG. 30*c*, if ball 3002 is held by tether 3004 between plates 3020 and 3022, and there is some slack 3023 in tether 3004, then movement 3024 or 3026 that is transverse to the axis of the tether will be permitted, and ball 3002 will roll until elastic restoration force in tether 3004, which is no longer slack, counters this plate movement.

Although a tether as shown in FIGS. 30*a*-30*d* appears to orient the travel of ball bearing 3002 along a single axis, tether 3004 and ball 3002 can be dimensioned to permit sufficient plate travel in both x and y.

Figure 30D:
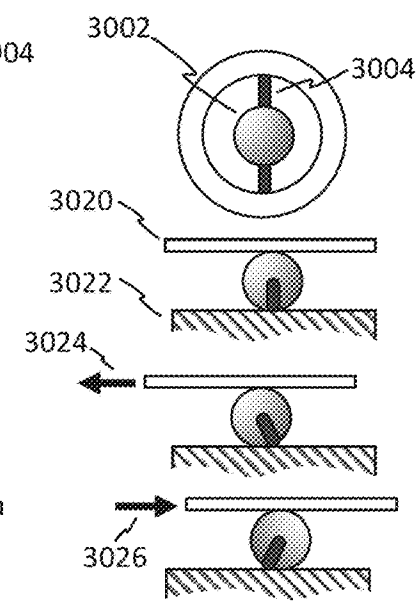
FIGS. 30*c* and 30*d* show plan and cross-sectional views of the suspension system component of FIGS. 30*a* and 30*b*, in accordance with various embodiments.
Figure 30C:
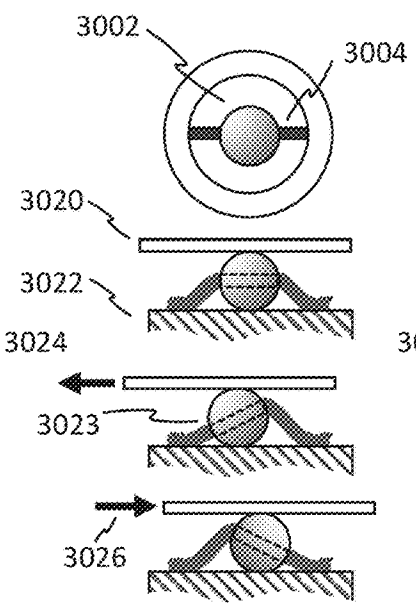
Figure 30B:
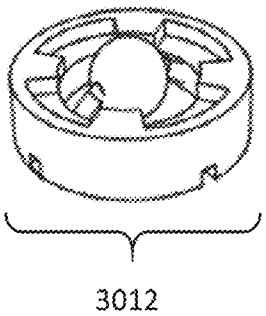
FIGS. 30*a* and 30*b* show perspective exploded and perspective views of a suspension system component, in accordance with various embodiments.
Figure 30A:
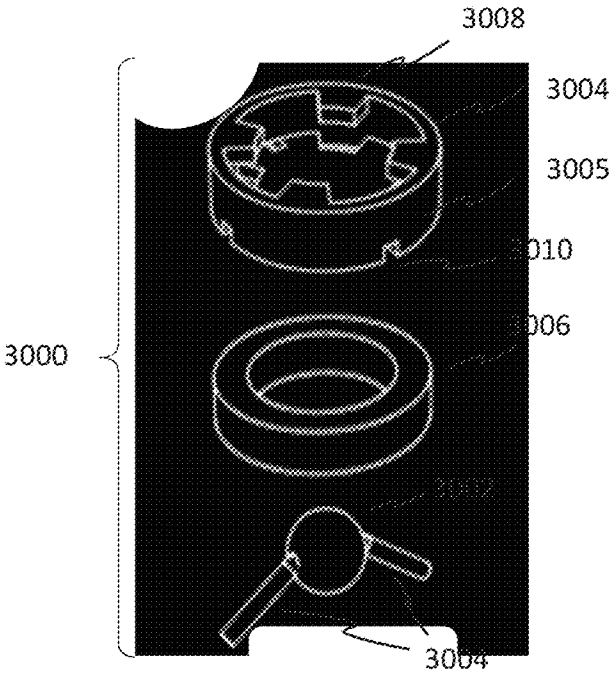

FIG. 30*d* illustrates how the tethered ball bearing permits movement along the axis of tether 3004. If ball 3002 is held by tether 3004 between plates 3020 and 3022, and there is some slack in tether 3004, then movement 3024 or 3026 that is in-line with the axis of the tether will be permitted and ball 3002 will roll until elastic restoration force in tether 3004 counters this plate movement.

Figure 31:
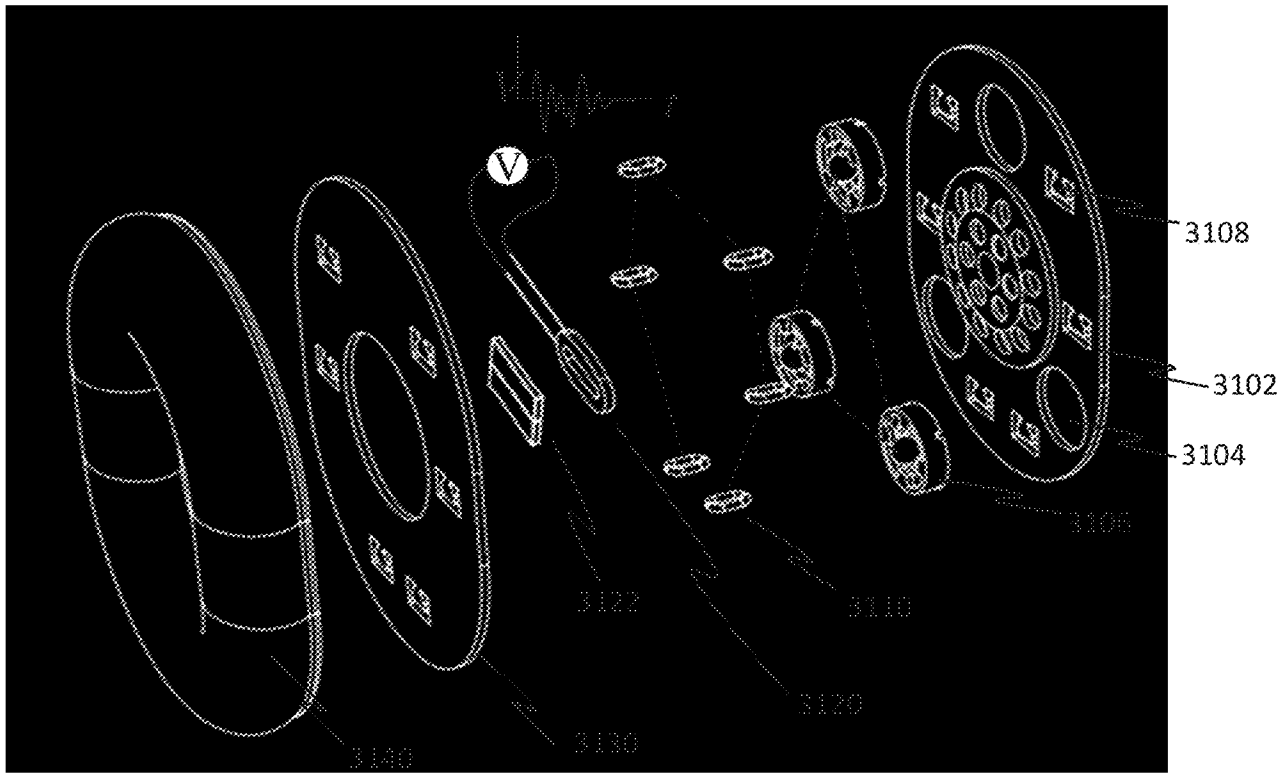
FIG. 31 shows an exploded view of an ear cup with three tethered ball bearings providing bounded relative motion, in accordance with various embodiments.

In some embodiments, multiple bearings may be arranged by receiving features in a baffle plate, so as to define a movement plane for a cushion stage. The bearings may be pre-compressed by elastic elements to prevent rattling and to elastically limit lateral travel of the stage. An exploded view of certain components of one side of a pair of headphones with three tethered ball bearings providing bounded relative motion is shown in FIG. 31.

Baffle plate 3102 attaches to main headphone structure, including the cups. It also provides locating features for other components, including recesses 3104 for each of the three bearings 3106, as well as tabs 3108 for retaining elastic pre-loading elements 3110. These pre-loading elements, which may be composed of silicone or other elastic material, may both pre-load the bearings in order to minimize noise generated by the bearings, and may also provide means for preventing separation of the overall assembly.

One or more tactors consist of at least a coil 3120 and at least a pair of magnets 3122. One of coil 3120 and magnets 3122 will be fixed relative to baffle plate 3104; the other will be fixed relative to moveable stage 3130, which is in turn attached to cushion 3140. Moveable stage 3130 may also include tabs for attaching elastic pre-loading elements 3110. When an appropriate signal is fed to coil 3120, relative motion between the two assemblies is created, limited by bearings 3106 and/or elastic preloading elements 3110.

An alternative embodiment of the tethered ball bearing would include a second tether orthogonal to the first tether and anchored to the plate that the first tether is not tethered to. This implementation would provide both the function of a bearing and the function of holding the two major assemblies together. A variation on this embodiment would use elastic tethers in addition to the elastic balls (potentially molded as a single component) so that the tethers themselves provide sufficient pre-load to address potential noise caused by relative movement of the assemblies.

Figure 32:
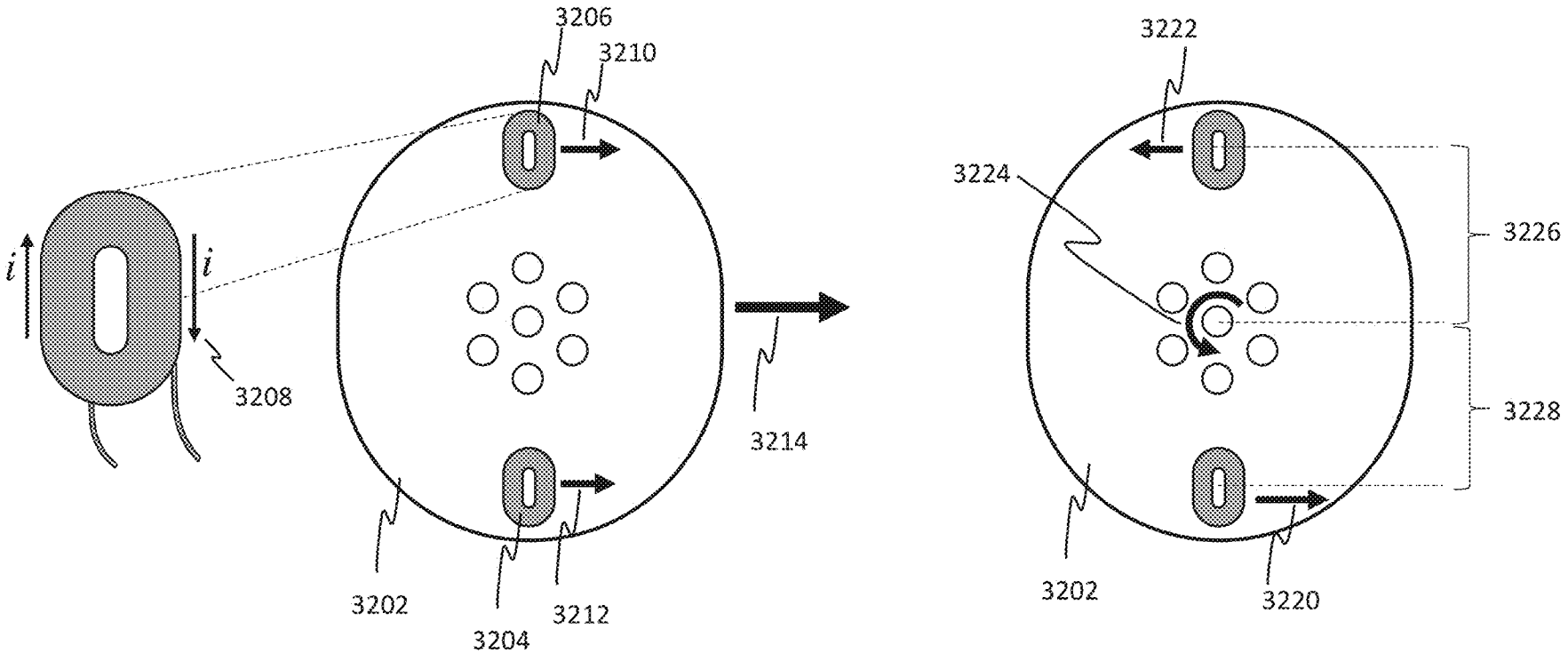
FIG. 32 shows a simplified plan view of a baffle plate, upon which conductive coils for two tactors are mounted, in accordance with various embodiments.

It is convenient that these suspensions allow translation in two axes and rotation to facilitate additional drivable degrees of freedom. For example, FIG. 32 illustrates a simplified view of baffle plate 3202, upon which the conductive coils for two tactors 3204 and 3206 are mounted. For purposes of this illustration, the magnets that form the other half of each of the tactors are assumed to be affixed to the moveable stage holding the cushion, none of which are shown for simplicity.

When current i 3208 flows through each of coil 3204 and 3206, motion relative to the magnets mounted on the opposite component is created. A positive voltage moves the system in one direction; a negative voltage moves it in the other. When two tactors are mounted as shown in FIG. 32, it is possible to produce both translation and torque.

If coil 3206 is driven to produce translational force 3210, and coil 3204 is driven to produce translational force 3212, and both force 3212 and 3210 are aligned, then the resulting action will be a translational force 3214 that is the combined force of the individual tactors (less system losses). However, if both coils are driven so that coil 3204 delivers force 3222 which is 180 degrees from force 3220 generated by coil 3706, the result is not translation but rotational movement 3224 (i.e., torque). In video games and virtual reality simulations, torque may be used, for example, to cue changes to the user's pitch orientation, such as the moment the orientation of a roller-coaster cart changes from uphill to downhill. The magnitude of that torque will depend on both the force of the individual tactors and the radii 3226 and 3228 that define the distance between each tactor and the center of rotation.

With additional coils, three degrees of freedom may be controlled individually; these may be thought of as (i) front-to-back motion, (ii) up-and-down motion, and (iii) rotation around an axis running between the wearer's ears. However, other orientations are also possible. Two exemplary coil layouts are shown, but many are possible and lie within the scope of the present invention.

Figure 33B:
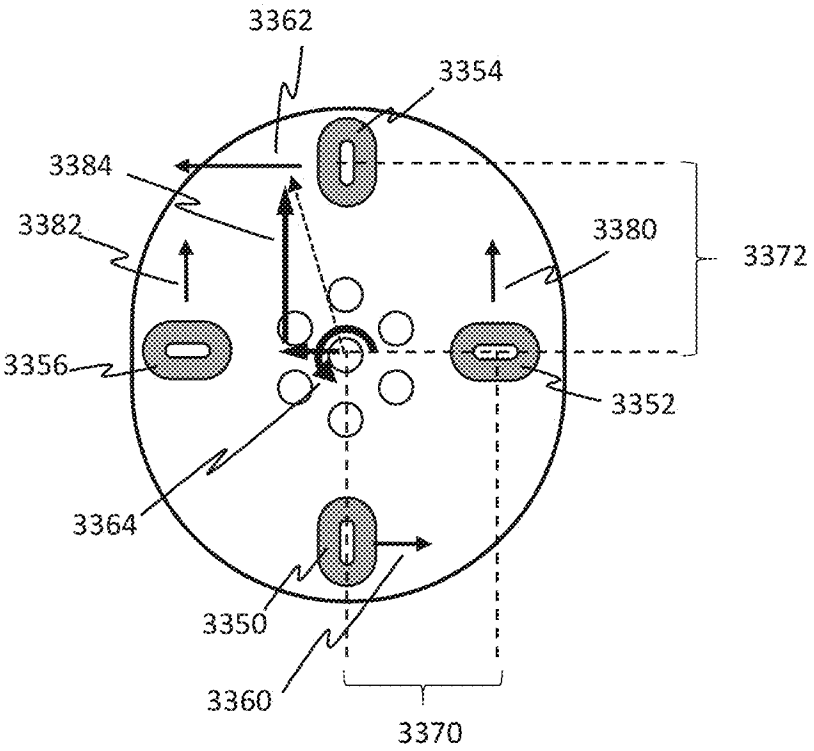
FIGS. 33*a* and 33*b* show simplified plan views of FIG. 33*a* illustrates how various vectors of movement can be accomplished with an array of three tactors and an array of four tactors, respectively, in accordance with various embodiments.
Figure 33A:
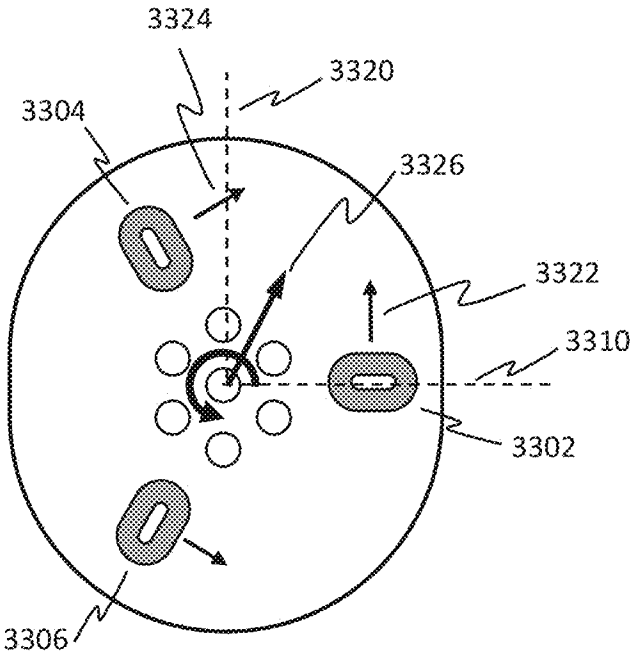

FIG. 33*a* illustrates how various vectors of movement can be accomplished with an array of three coils, coil 3302, coil, 3304 and coil 3306. Combining signals to the three coils can produce rotational displacement when all three coils are fed the same polarity signal. Translational movement can be caused in any direction that may be described in relation to axis 3310 and axis 3320 (effectively the x and y axes) by modifying the current to the various coils.

While three tactors will be generally less expensive than four tactors as illustrated in FIG. 33*b*, a three-tactor system has other drawbacks. Generating the appropriate control signals is computationally slightly more expensive given the sine and cosine terms required to get x and y motion. The three-actuator array is also somewhat inefficient, due to cancellation of forces when attempting to use multiple tactors to generate translational motion. Thus when coil 3302 generates translational force 3322 and coil 3304 generates translational force 3324 the resolved force 3326 is different from either of the two original forces.

A four-tactor array is illustrated in FIG. 33*b*. It includes tactors 3350, 3352, 3354 and 3356. When tactor 3350 is energized to create force 3360, and tactor 3354 is energized to produce force 3362, the result is torque 3364. The magnitude of that torque will depend on both the force of the individual tactors and the radii 3370 and 3372 that define the distance between each tactor and the center of rotation. Torque 3364 can be doubled if the other two tactors also generate forces that reinforce that motion.

Translational motion can be generated in any direction along the x and y axes through various combinations of signals to the four tactors. In an example case, current through tactor 3356 generates force 3382 and current through tactor coil 3352 generates force 3380 and those two forces combine to generate the vertical component of force 3384. The horizontal component of force 3384 comes from the net difference of oppositely directed forces 3360 and 3362 produced by the other two coils. If both of these actions take place simultaneously; that is, if tactors 3352 and 3356 both generating translational force 3384, and tactors 3350 and 3354 generate rotational force 3364, the resulting force 3390 both torque and a net force vector are simultaneously produced. Combining signals in this way permits the creation of force along any vector in the plane defined by the x and y axes, and simultaneous presentation of an arbitrary torque.

Figure 34B:
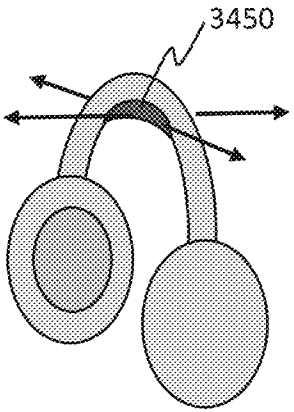
FIG. 34*b* shows a perspective view of tactors located in the headphone bow, in accordance with various embodiments.
Figure 34A:
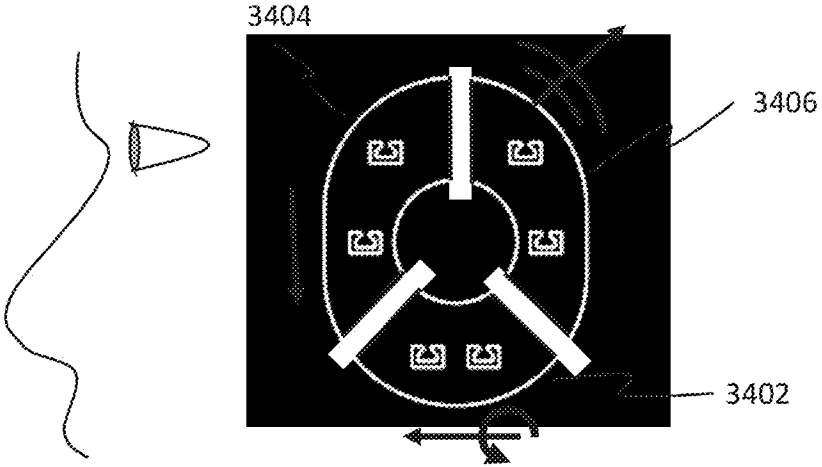
FIG. 34*a* shows a partial plan view of tactors mounted on separate plates, in accordance with various embodiments

As shown above tactors may be mounted on plates that move separately from the headphone cups. A further embodiment of the invention provides multiple moving segments, to provide additional tactile expressiveness, as shown in FIG. 34*a*. For example, a headphone cushion may be divided into three segments: stage segment 3402, stage segment 3404 and stage segment 3406. More or fewer segments can also be provided. Each segment may incorporate a single tactor, or one or more segments may incorporate multiple tactors. If each segment contains only a single tactor, segmentation provides the ability to stimulate different portions of the skin surrounding the ear. If each segment contains multiple tactors, as shown in FIG. 34*a*, more complex signaling can take place. As shown in FIG. 34*a*, segment 3402 generates torque and forward while segment 3404 generates a downward force and segment 3406 generates reciprocating forces along a third vector.

In addition to locating tactors in the cups of the headphone, it is also possible to locate them in other parts of the headphone, such as the bow connecting the cups, which often distributes the weight of the headphones to the top of the head, and thus provides another point of contact. As illustrated in FIG. 34*b*, tactors located in the headphone bow 3450 can be used to generate directional cueing in multiple directions as well.

One of the challenges associated with delivering taction transmitted through headphones is that the signal generator (the tactor) generally does not directly contact the skin of the user: it has to transmit its signal through the cushions used to locate the audio driver relative to the wearer's ear, and to provide comfort and (in most cases) noise isolation. Those cushions tend to consist of a pliable outer material such as leather, vinyl or fabric, and an inner component, which is generally resilient foam, but may also me comprised of liquid, air or other material. Some headphones provide only open-cell foam, and dispense with the separate outer layer. One purpose of the combined inner and outer portions of the cushion is to conform to the complex and irregular topology of the head in the immediate vicinity of the ear (or, in the case of on-ear headphones, the ear itself.) A second goal is to absorb sound—from outside the earphone, in order to provide a level of isolation, and in some cases to absorb unwanted reflections from hard surfaces inside the headphone. These goals are generally achieved by configuring the cushion assembly so that is soft and dissipative—that is, so that it will absorb vibration. This property works at cross-purposes with a tactor, in effect potentially throwing away a significant portion of the energy generated by the tactor before it reaches the listener.

When headphones include tactors as described herein, the headphone cushion may ride on a stage, moving in-plane, with the goal of applying shear taction to the skin. It may be desirable that the displacement of the stage not be consumed by the elastic compliance of the cushion. However, reducing losses by reducing compliance through existing methods is likely to cause sacrifices in the performance of the cushion in other aspects like conformance to the head or ear, sound isolation and comfort.

An aspect of the invention is to improve the performance of the taction system without significant adverse effect on the other aspects of cushion performance. This goal may be achieved by employing an anisotropic material as part of the construction of the headphone cushion; in other words, a material that is stiff in shear, so that it is effective in transmitting the sheer force of the tactor(s), but still compliant and comfortable in compression. A full discussion of anisotropic linear elasticity is beyond the scope of this specification, and may be reviewed elsewhere (for example see Piaras Kelly, Solid Mechanics Lecture Notes, Part I—An Introduction to Solid Mechanics, Section 6.3, pg. 157—Anisotropic Elasticity, University of Aukland, 2013). That said, a brief explanation is required in order to be clear about the sort of anisotropic material properties the present invention teaches.

For an isotropic material, the shear modulus (G) and Elastic Modulus (E) are related by Poisson's ratio (v), which captures volumetric compressibility of the material. For an isotropic material the ratio of shear modulus to elastic modulus is:

$$\frac{G}{E} = \frac{1}{2(1+v)}; \qquad \text{Eq. 8}$$

G=Shear modulus, [N/m$^2$]'

$F_x$=A shear force directed along the top surface of the material, [N];

$z^0$=thickness of the material, [m];

A=Area over which the force is applied, [m$^2$];

Δx=lateral shear displacement of the top surface of the material, [m];

E=Elastic modulus (also called Young's modulus), [N/m$^2$];

$F_z$=Force directed normal to the top surface of the material, [N];

Δz=Change in thickness of the material in response to the normal force, [m]; and v=Poisson's ratio $(\Delta x/x_0)/(\Delta z/z_0)$, which typically ranges from z=0.5 (incompressible) to z=−1 (completely compressible).

The present invention teaches headphone cushions comprised of anisotropic materials, where the ratio of shear modulus to elastic modulus is greater than it would be for an isotropic material. That is, where $$\frac{G_{xz}}{E_{zz}} > \frac{1}{2(1+\nu)}; \quad \text{Eq. 9}$$

Since typical foams have Poisson's ratio around 0.3, the present invention teaches the use of materials where the unitless ratio of shear modulus to elastic modulus (Gxz/Ezz) is greater than 0.4. Specifically, where:

$G_{xz}$=Shear modulus in response to a lateral traction in the x-direction that is applied on the top z-surface of the material; and $E^{zz}$=Elastic modulus in response to compressive traction in the negative z-direction on the top z-surface of the material.

The cushion material is oriented so that the (softer) z-axis of the material points at the wearer's skin, and the (stiffer) x-axis of the material points parallel to the skin, in the direction shear forces are to be applied to the skin by the cushion. Soft materials are of particular interest. Accordingly, the present invention teaches the use of anisotropic materials with elastic modulus in the range typical of cushioning foams, 10 kPa<E<10 MPa.

Figure 35C:
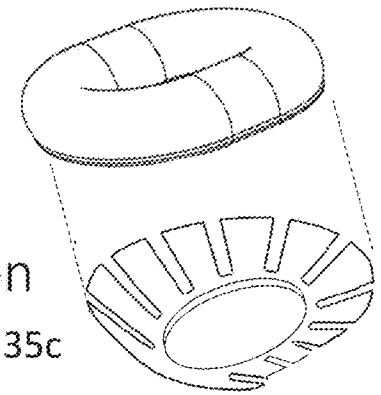
FIG. 35*c* shows an exploded view of incorporating an anisotropic structure into an ear cup, in accordance with various embodiments.
Figure 35B:
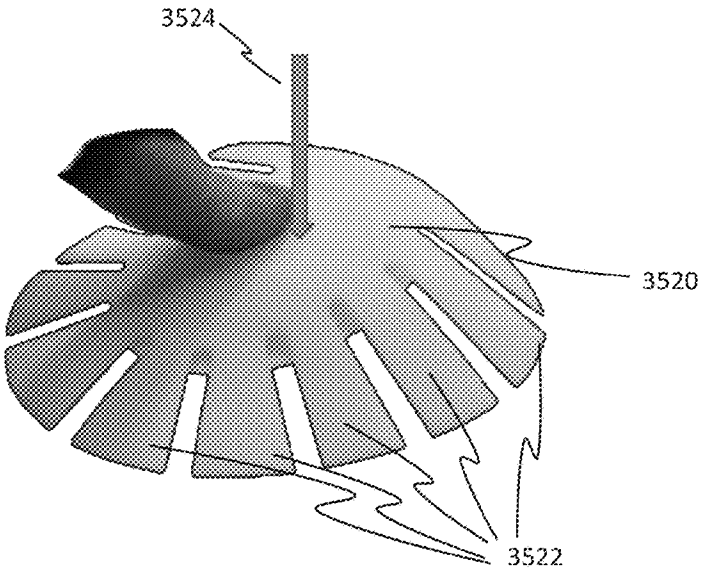
prior art Fig. 35b
FIGS. 35*a* and 35*b* show a cross-sectional view of the foam commonly found in headphone and a low-profile cushion support, respectively, as known in the prior art.
Figure 35A:
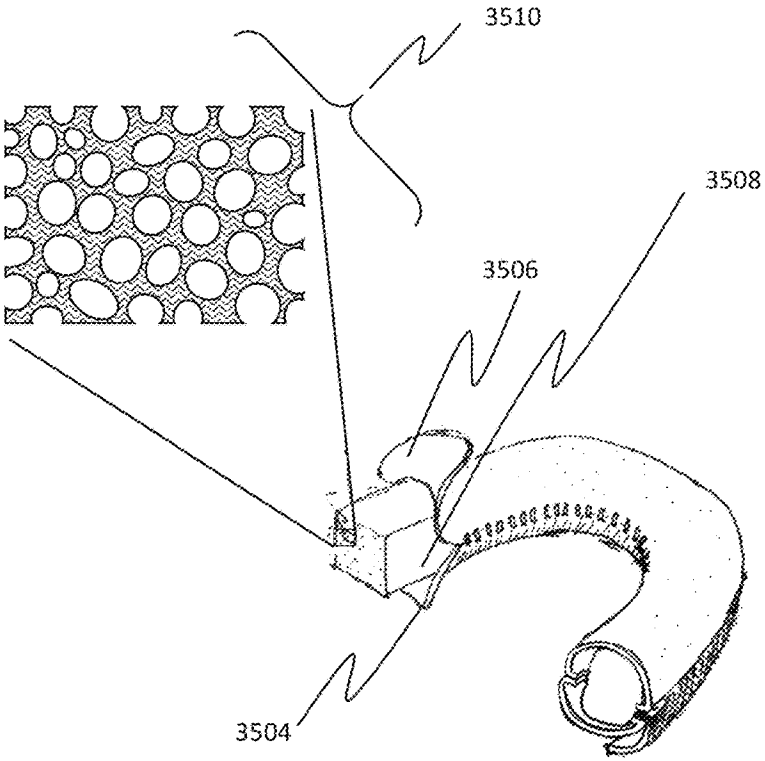
prior art Fig. 35a

A simplified cross-sectional view of the foam commonly found in headphone cushions is shown in FIG. 35*a*. Image 3502 is a cross-sectional view of an actual headphone cushion. It includes a backing fabric 3504, and a contact material 3506, which is what rests against the user's head or ear. Contact material 3506 may be fabric or leather or another material, with suitable comfort and appearance. Captured between backing fabric 3504 and contact material 3506 is foam 3508. Typically foam 3508 is an open cell polymer, which is more or less equally compliant in all directions. That is, the material of a conventional cushion is an isotropic foam. An illustration of a magnified cross-section of such foam is shown as 3510.

There has been at least one prior design applied to a headphone cup that may provide some anisotropic stiffness. Kokoon has marketed a design that includes a low-profile cushion support comprised of discrete flexures, as illustrated in FIG. 35*b*. The headphone cup includes a resilient plastic member 3520, comprising an array of separate "fingers" 3522 likely to flex so as to permit movement orthogonal to the plane of the wearer's head while resisting lateral movement along that plane. Although this construction was developed for improved ventilation and rather than shear stiffness, the geometry likely provides anisotropic stiffness. Plastic member 3520 flexes when force is applied along one axis 3524, but not when force is applied from other directions. In embodiments of the present invention, this geometry may be applied to the problem of creating anisotropic stiffness rather than providing ventilation. To be usefully applied to tactile headphones, the discrete finger geometry embodied by this prior art would likely need to be further slotted and thinned in order to provide adequate compliance in the direction orthogonal to the taction effects. And the center of the geometry would need to be removed, so that the structure was ring-shaped, to provide a cushion support, rather than a back housing. The general effect of this repurposing of the geometry into a cushion support may be inventive and is so shown in FIG. 35 *c*.

An aspect of the subject invention that overcomes some drawbacks of art shown in FIGS. 35*a* and 35*b* is the use of one or more suitable cushion filling materials. Foams with anisotropic properties are available, and may be created through a variety of means. Good anisotropic properties are also produced by a mat with fibers oriented principally in-plane. There is already commercial production of material with suitable anisotropy. Scotch-Brite™ pads made by 3M are one example. Thermoplastic foam, heated and pulled in plane so as to orient cell walls also has suitable properties.

Figure 36:
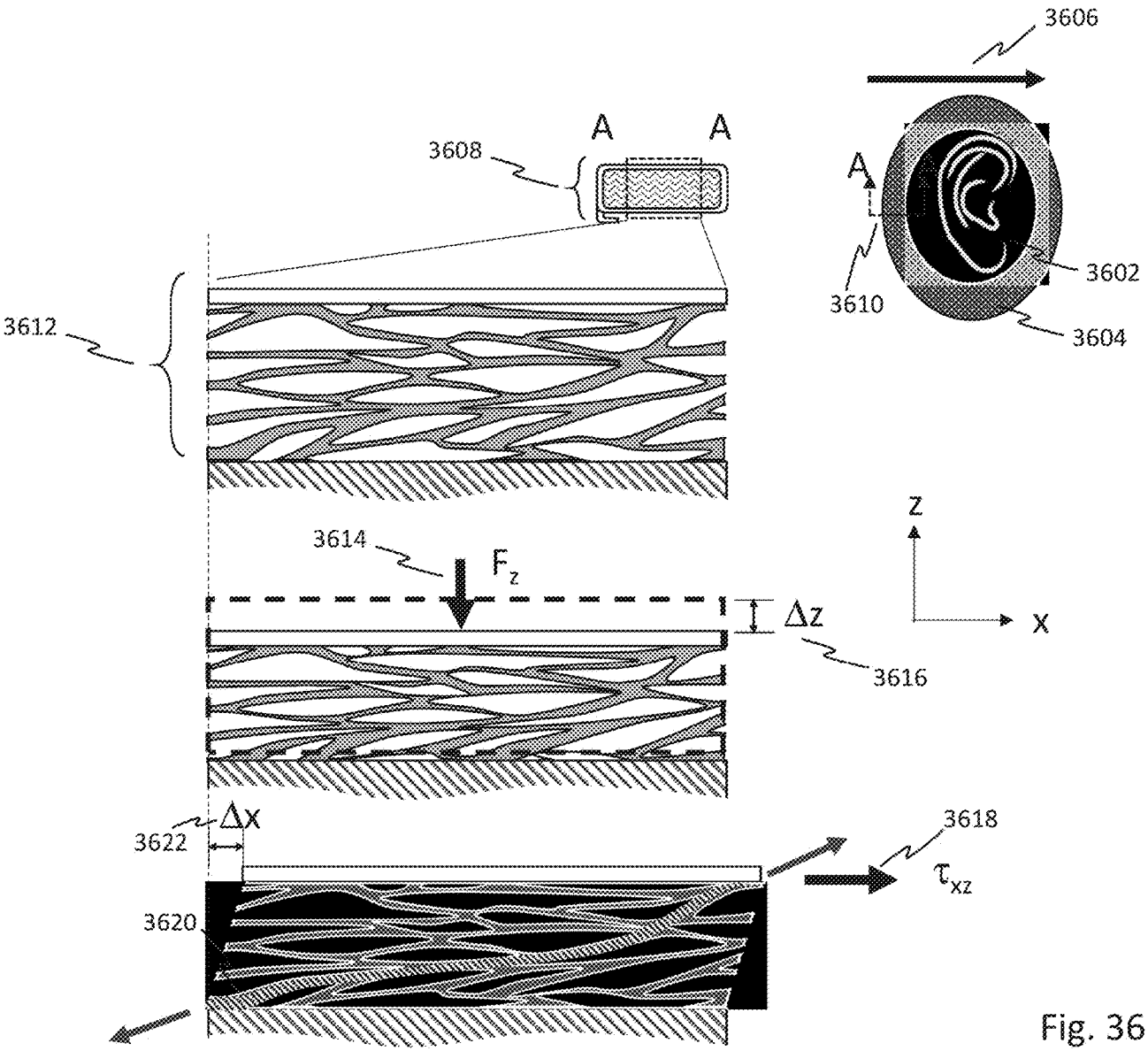
FIG. 36 shows exemplary pictorial diagrams that illustrate how an anisotropic material can enhance the taction capabilities of a headphone, in accordance with various embodiments.

FIG. 36 shows how an anisotropic material can enhance the taction capabilities of a headphone. Ear 3602 is contained within cushion 3604. Reciprocating Force 3606 shears the skin parallel to the sagittal plane. Orienting an anisotropic material within the cushion so that the cushion efficiently transmits force 3606 while remaining conformable in other directions.

Sectional view 3608 is taken from cushion 3604 through section A-A 3610. A magnified view of the material within the cushion is shown in 3612 in its relaxed state (that is, uncompressed). It illustrates a means for creating an anisotropic compressible material: its fibers (and the airspaces between these fibers) are not randomly shaped or oriented, but instead are elongated along the plane in which motion is to be resisted. Thus when force 3614 is applied transverse to the face of the cushion, material 3612 offers relatively little resistance to deformation 3616 (compression Δz). However, when shear traction 3618 is applied to cushion material 3612, multiple individual fibers such as 3620 are oriented so that they run in a plane relatively parallel to the force applied, and are relatively resistant to tensile deformation, so that overall movement 3622 (lateral displacement Δx) is relatively small. Thus a headphone cushion comprising an anisotropic material will improve the efficiency with which the output of tactors is conveyed to the skin of the person wearing tactor-equipped headphones.

Another aspect of the invention is a tactor capable of both inertial and impact actuation in multiple degrees of freedom. Inertial actuation may be thought of as the generation of vibrations with a tactor over a range of motion in which the relation between input signal and output is relatively linear—that is, that an increase in the magnitude of the input signal (generally measured in voltage) results in a proportionate increase in forces generated by the tactor. As a practical matter, a tactor as described in as disclosed previously in application Ser. No. 14/864,278, now issued as U.S. Pat. No. 9,430,921, will perform in inertial mode so long as its displacement does not cause it to make contact with its frame.

Figure 37A:
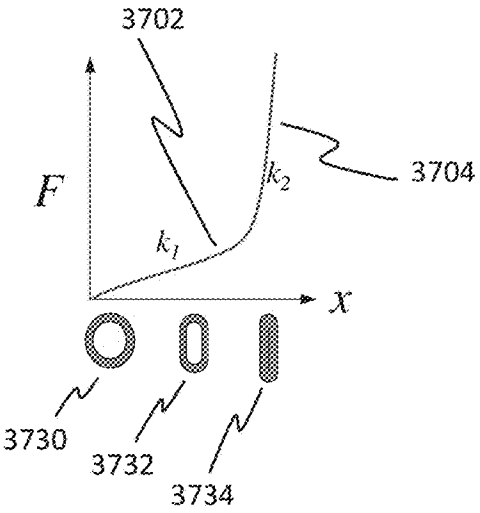
FIG. 37*a* shows a graph of a tactor operating as an impact device, in accordance with various embodiments.

When a tactor is driven with enough energy to cause it to make contact with its frame, the tactor is operating as an impact device. In impact mode, additional input force does not materially increase travel. The difference is illustrated in FIG. 37*a*. Applied force is shown on the y-axis and displacement is shown on the x-axis. In the inertial range 3702, displacement increases in a linear fashion with increasing input signal. In the impact range 3704, the moving mass of the tactor has exceeded the travel of its suspension system, and additional force will not significantly increase travel.

Single-axis impact tactors are already known from prior art, but can make noise unsuitable for headphones. They generally include a metal moving mass and a frame made of metal or other material, and the transition from inertial to impact mode creates undesirable noises as the mass hits the frame. Metal-to-metal collisions are particularly loud. Accordingly, an aspect of the invention is an inertial/impact tactor suspended by collapsible elastic elements that change spring rate more smoothly than a metal-to-metal collision, thereby minimizing acoustic noise.

Figure 37B:
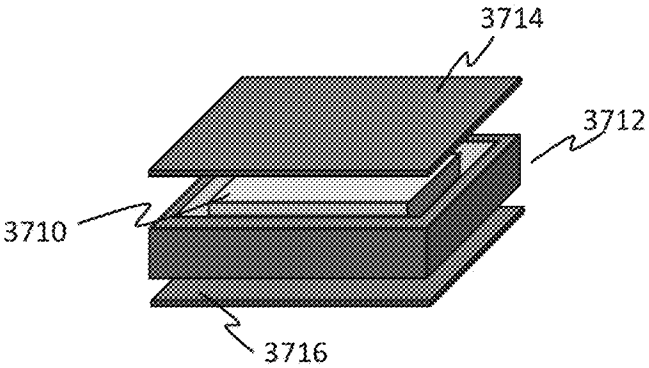
FIG. 37*b* illustrates a simplified exploded view of mechanical components of a tactor without collapsible elastic elements, in accordance with various embodiments.

FIG. 37*b* illustrates a simplified exploded view of the relevant mechanical components of a tactor without such collapsible elastic elements. Moving mass 3710 is held within frame 3712, and is restrained from movement other than that in the desired plane by end plates 3714 and 3716. When inertial travel limits are exceeded, mass 3710 will collide with frame 3712, generating unwanted noise.

Figure 37C:
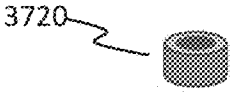
FIG. 37*c* illustrates a perspective view of an exemplary collapsible elastic element, in accordance with various embodiments.

FIG. 37*c* illustrates a perspective view of an embodiment of the collapsible elastic element 3720. One possible embodiment is a hollow cylinder made of silicone or another resilient and flexible material.

Figure 37D:
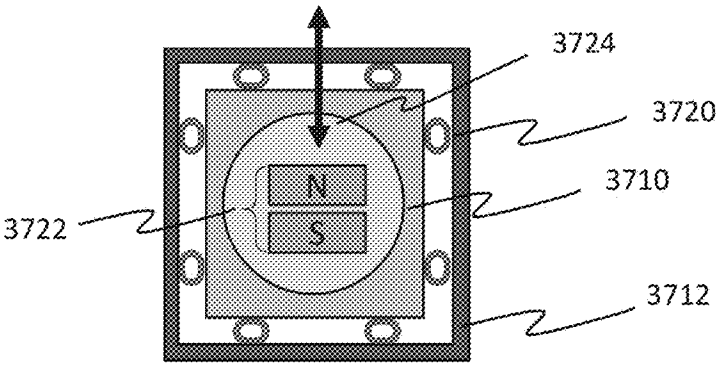
FIGS. 37*d* and 37*e* show cross-sectional views of tactors in which collapsible elements locate and suspend a moving mass inside a frame, in accordance with various embodiments.

FIG. 37*d* shows a sectional view of a tactor in which eight such collapsible elements 3720 locate and suspend the moving mass 3710 inside frame 3712. Magnets 3722 are oriented to enable the mass 3710 to move along the axis 3724. As mass 3710 travels along that axis, the two collapsible elements 3720 on one end compress against frame 3712, while the two collapsible elements 3720 on the other end expand.

The four collapsible elements on the sides orthogonal to the compressing and elongating collapsible elements are free to roll in order to maintain contact with both the frame 3712 and the mass 3710. Collapsible elements 3720 also provide a method for delivering impact taction while suppressing the undesirable noise associated with contact between hard surfaces. Where a tactor without a suspension such as described herein would sharply transition between inertial and impact regions with an audible "click" or other similar noise, collapsible elements 3720 may offer a smoother transition, permitting effective use of impact taction. If a fully relaxed collapsible element is round cylinder 3730, when force is applied a partially compressed collapsible element will begin to flatten 3732. If sufficient force is applied, the collapsible element will fully collapse 3734. If the collapsible element is made of a material that is itself compressible, such as silicone or similar materials, then additional force may provide slightly greater travel. However, the collapsible elements may also be made of incompressible materials, such as string steel. In that case it is possible that the collapsible element would reach a point at which no (relevant) force will yield additional travel.

Figure 37E:
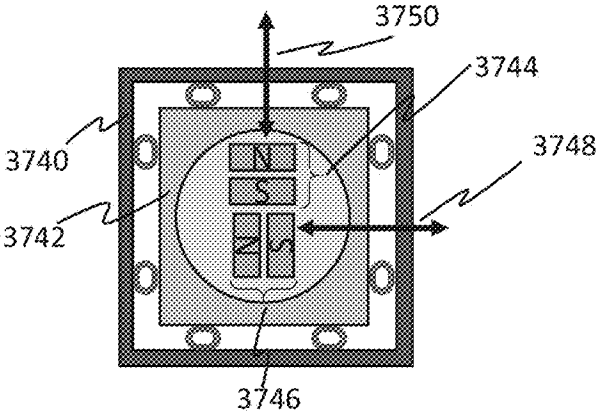

A further advantage of this arrangement of compressible elements is that motion in multiple degrees of freedom is supported. FIG. 37*e* illustrates one means by which this may be achieved. Frame 3740 and moving mass 3742 may be substantially similar to those shown in FIG. 37*c*. In order to generate movement along two axes, two motors are provided; this may be achieved magnet pair 3744 and magnet pair 3746, which is oriented orthogonally relative to magnet pair 3744. (Also required are two separate conductive coils, not shown for clarity.) Magnets 3744 (and their associated coil) provide motion along axis 3748; magnets 3746 (and their associated coil) provide motion along axis 3750. Such embodiments will also permit torsional taction, as well as more complex cueing involving hybrids of linear and torsional cueing.

Figure 38B:
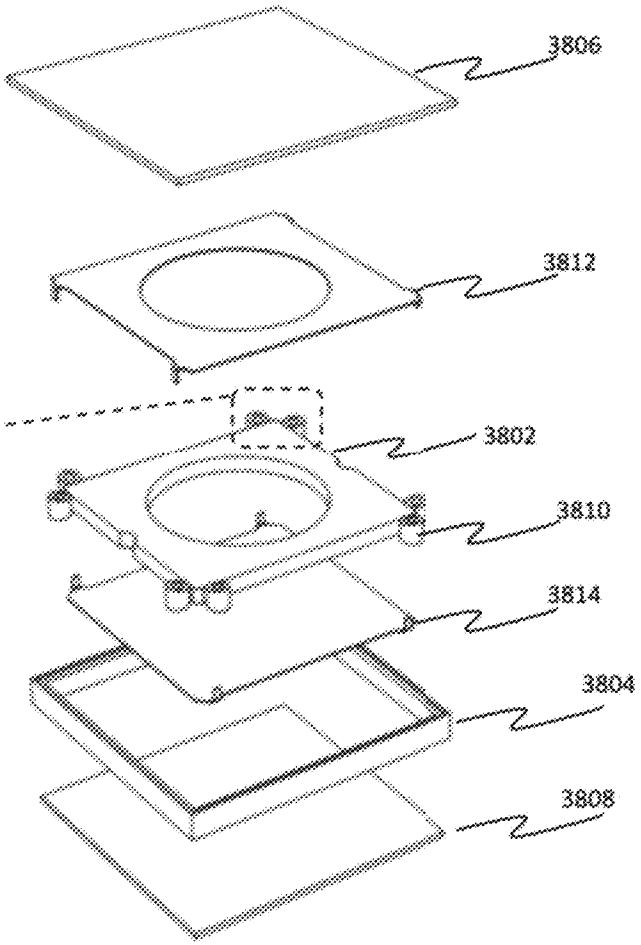
FIGS. 38*a* and 38*b* show detailed cross sectional and exploded views of a tactor, in accordance with some embodiments.
Figure 38A:
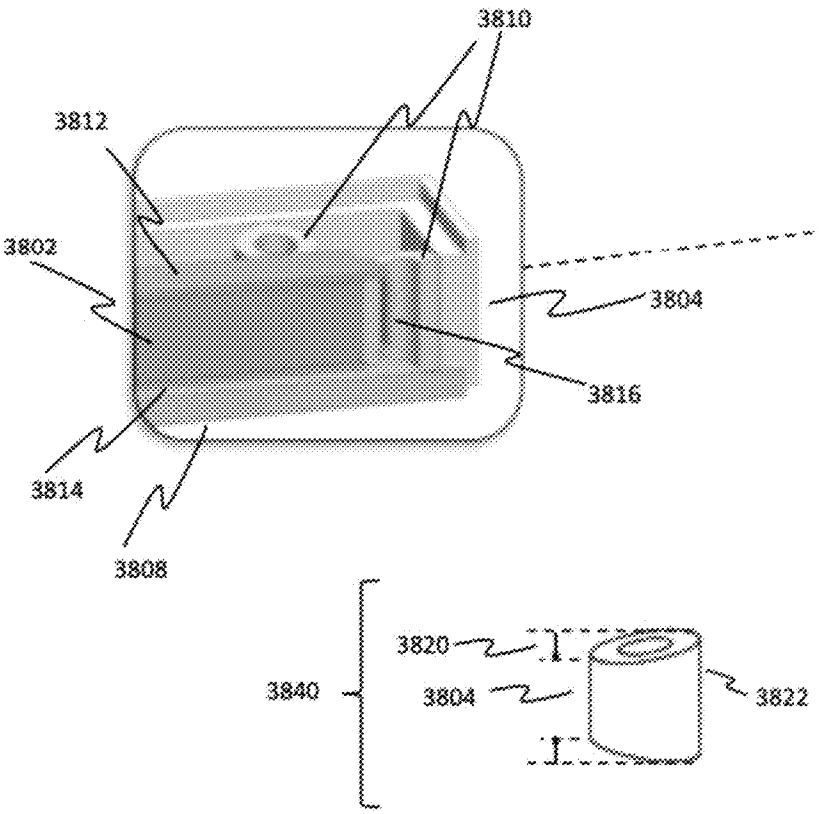

FIGS. 38*a* and 38*b* show detailed cross sectional and exploded views of a tactor, in accordance with some embodiments. Moving mass 3802 is located within frame 3804 as well as top cover 3806 and bottom cover 3808. Additional components related to the suspension of the mass include eight elastic elements 3810, as well as top retainer plate 3812 and bottom retainer plate 3814, both of which are fixed to moving mass 3802, and are used to retain elastic elements 3810. Each retainer plate includes four tabs or hooks 3816.

In this embodiment, elastic elements 3810 are beveled 3820 on both ends so that the elastic element has a short side and a long side. Elastic elements 3810 are oriented in the assembly so that the long side 3822 contacts the frame 3804 and the short side 3824 faces the moveable mass 3802. The reason for the bevel is highlighted in the detail view 3840. It provides the clearance that allows the mass 3802 and retainer plates 3812 and 3814 to move without scraping against cover plates 3806 and 3808.

Mass 3802 moves within frame 3804. Moving mass 3802 is fixed to retainer plates 3812 and 3814, which move with moving mass 3802. Each of the four hooks 3816 on the top retainer plate 3812 inserts into the cylinder of a respective elastic element 3810 from the top; each of the four hooks 3816 on the bottom retainer plate 3814 inserts into the cylinder of a respective elastic element 3810 from the bottom, so that each of the eight cylinders is retained by one hook.

It should be noted that multiple variations on the embodiments described are contemplated. Elastic members may be made of any resilient material, including metals that can function as springs. Elastic members may be shapes other than cylinders, such as leaf springs, coil springs, foam cubes, or other shapes and materials. Tactors and their housing can be shaped in a variety of forms other than squares or rectangles, such as circles, toroids, sections of toroids, etc. More or fewer elastic members may be used to suspend the mass and to elastically limit travel.

Together and separately, these improvements enhance perception of bass and improve spatialization of sound. Benefits for spatial reaction time and hearing health are demonstrated, in addition to numerous other benefits as previously described.

An ideal transducer, whether tactile or acoustic, would have a constant linear transfer function. In other words, the output of the transducer at different frequencies should generally be a simple function only of its input.

In the case of a loudspeaker, for example, the ideal is primarily thought of as flat frequency response over the full range of the speaker.

Both because ideal transducers are rare and expensive at best, and because a driver that delivers excellent performance in one context (e.g., an anechoic chamber) may be seriously flawed in another (e.g., a room with its own resonances, modes, reflections, etc.) a variety of techniques for improving the performance of a transducer have evolved over the years.

The simplest and probably oldest approach is the use of passive components (capacitors, resistors and inductors) to shape the output of a transducer or an array of transducers. For example, a two-way loudspeaker generally includes a few such passive components to send low frequency signals to one driver, and high frequency signals to another. Such a network can be a simple as a single capacitor in series with a high frequency driver and another in parallel with the low frequency driver.

In order to deliver significant low frequency tactile output through the mass of a complete headphone, a tactile transducer must itself have significant mass. That mass means that the transducer will have at least one significant resonant mode (at least in the absence of techniques to reduce such resonances). In addition to uneven response in the frequency domain, the presence of resonant modes leads to time domain nonlinearities, such as ringing and poor impulse response.

Figure 39:
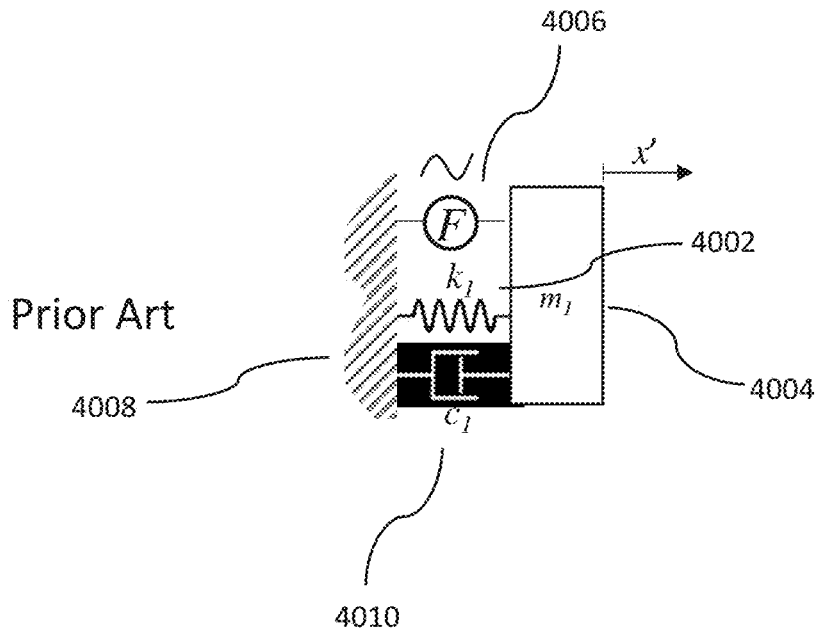
FIG. 39 is a schematic representation of an undamped tactile transducer clamped to a bench

FIG. 39 is a schematic representation of an undamped tactile transducer clamped to a bench. The transducer includes resilient member 4002, moving mass 4004, and motor system 4006, and a portion of the transducer is rigidly mounted to (effective) infinite mass 4008. When motor system 4006 converts electrical energy into kinetic energy, moving mass 4004 oscillates along axis x'. A small damping effect 4010 is provided by effects such as air resistance, so that oscillation will not persist indefinitely. In an otherwise undamped system, that oscillation will have a resonance that depends primarily on the properties of resilient member 4002 and moving mass 4004. Higher mass lowers the resonant frequency; a stiffer resilient member raises it.

Figure 40:
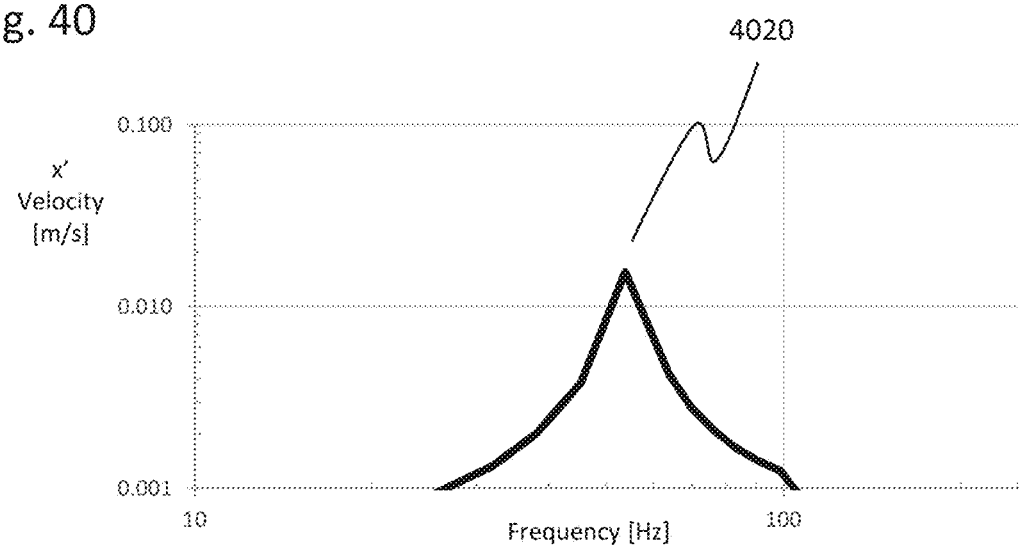
FIG. 40 illustrates the resonance of such an undamped tactile transducer.

FIG. 40 illustrates the resonance of such an undamped tactile transducer clamped to a bench, with frequency response on the X axis and response (measured as velocity of the inertial mass) on the Y axis. In this hypothetical example, which is typical of prior art, frequency response 4020 shows a fairly high Q (quality factor) resonance is present at 54 Hz.

Figure 41A:
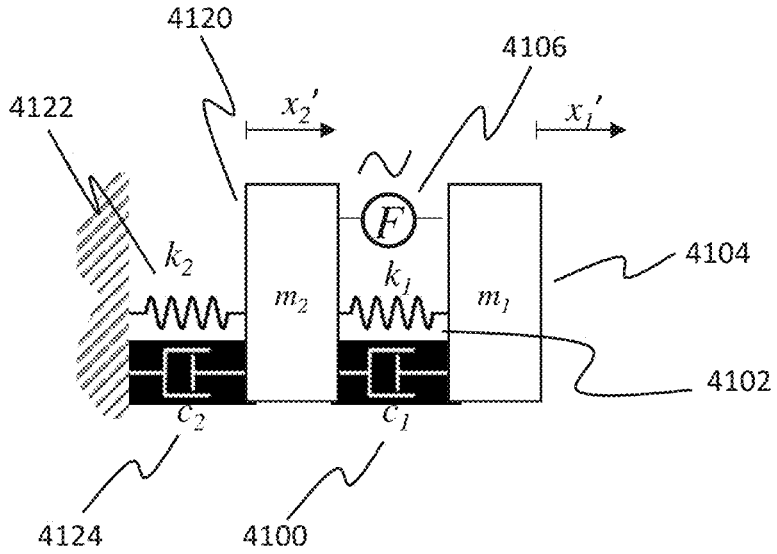
Fig. 41a Prior Art
FIG. 41*a* is a schematic representation of an undamped transducer mounted on a human body.
Figure 41B:
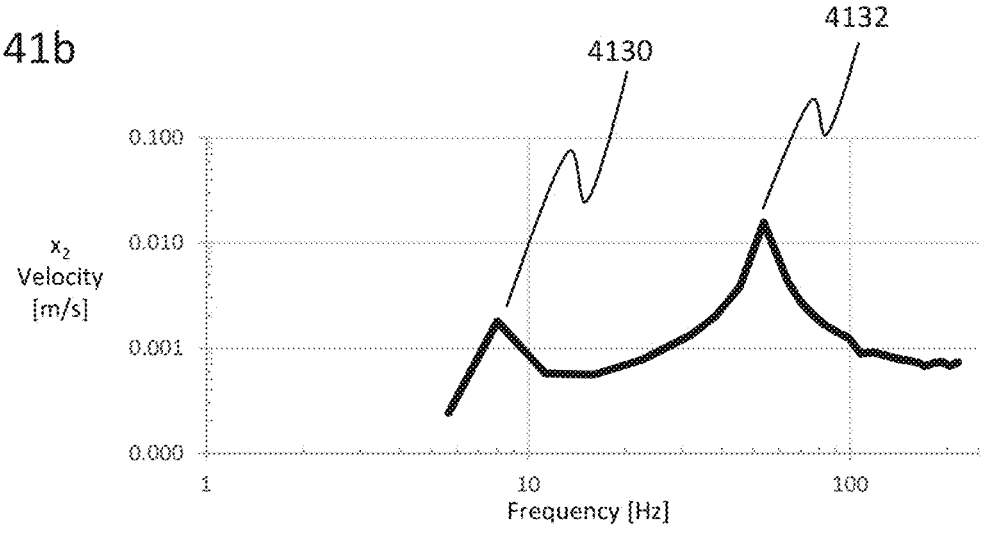
FIG. 41*b* illustrates the dynamics of an underdamped coupled oscillator system.

FIGS. 41*a* and 41*b* shows what happens when such a transducer is mounted on the body of a person in a body-contacting device such as a headphone or head-mounted audio-visual display.

FIG. 41*a* is a schematic representation of a similar undamped transducer mounted on the body of a person in a body-contacting device such as a headphone or head-mounted audio-visual display. The transducer includes resilient member 4102, moving mass 4104, and motor system 4106, and a small damping factor 4110. However, instead of being mounted on a rigid structure, the transducer is now connected with another moving system with its own properties of mass 4120, resilience 4122 and damping 4124. When motor system 4106 converts electrical energy into kinetic energy, moving mass 4104 still oscillates along axis x1'. However, the combined system now exhibits more complex resonant behavior. The dynamics of an under-damped coupled oscillator system occur, as illustrated in FIG. 41*b*. The inertial mass and suspension of the transducer comprise a first oscillator 4130. The second oscillator 4132 is comprised of the mass of the rest of the display riding the compliance of the cushion, skin and subcutaneous tissues. Accordingly, two resonances are observed at the device/skin interface.

Figure 42:
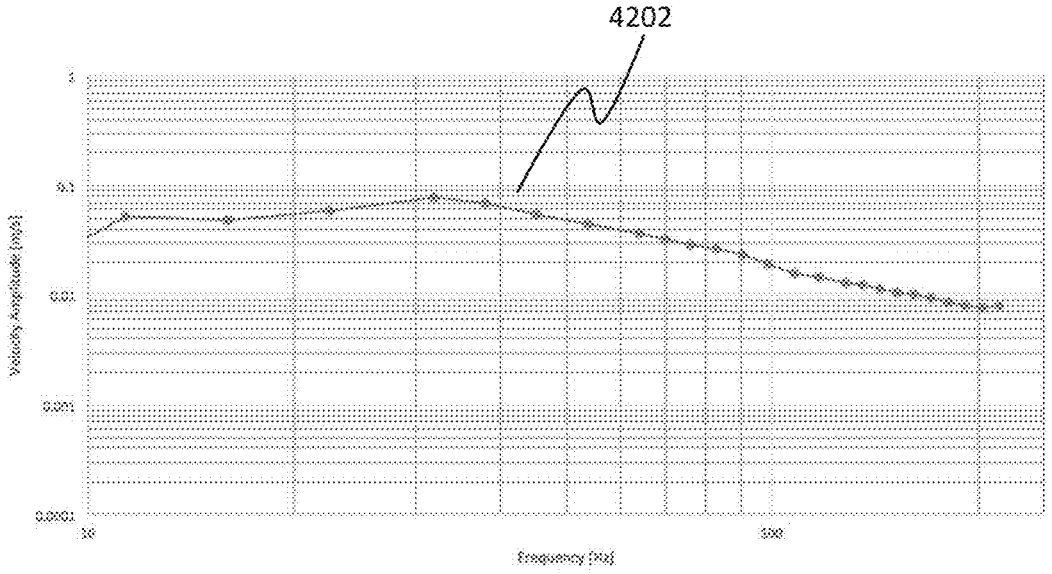
FIG. 42 illustrates a preferred frequency response for the transducer

FIG. 42 illustrates a more desirable frequency response for the transducer. Instead of the high-Q resonant peak shown in FIG. 40, it shows similar output 4202 across a wide frequency range. Such a transducer is described in U.S. Pat. No. 9,430,921.

Figure 43:
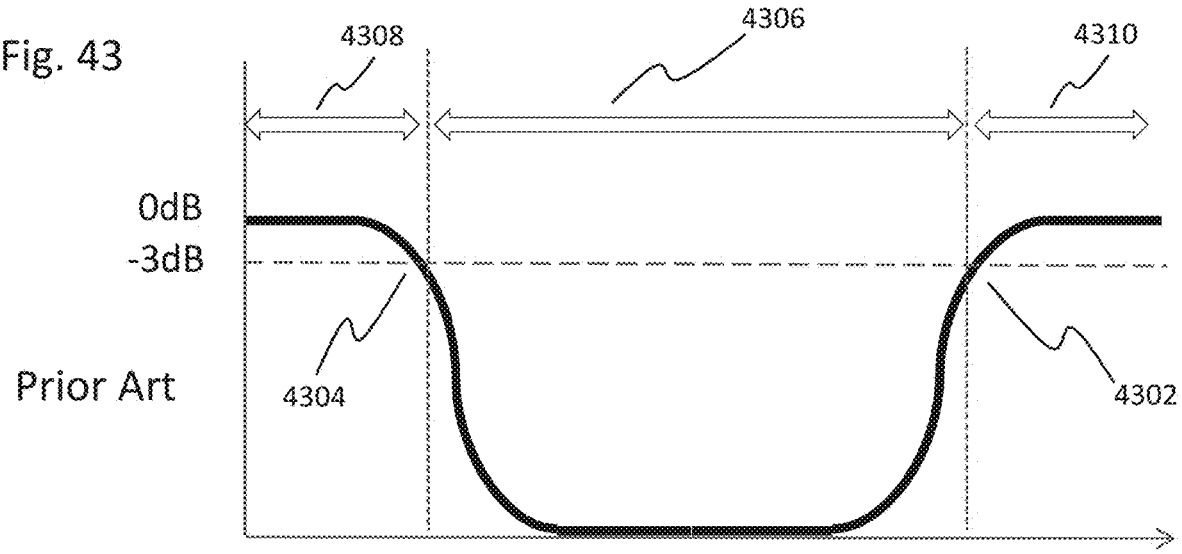
FIG. 43 illustrates a method for achieving a flat frequency response using passive components.

FIG. 43 illustrates one well-understood method for achieving a flat (or at least flatter) frequency response using passive components. By combining a low pass filter and a high pass filter such that the corner frequency 4302 of the high pass filter is above the corner frequency of the low pass filter 4304, a notch or stop-band filter is created. This creates a stop band 4306 that is between pass bands 4308 and 4310. If the corner frequencies and Q factor of the filters are correctly matched to the resonant behavior of the transducer, and the signal sent to the transducer is processed through the notch filter, the result is a flatter frequency response.

Figure 44:
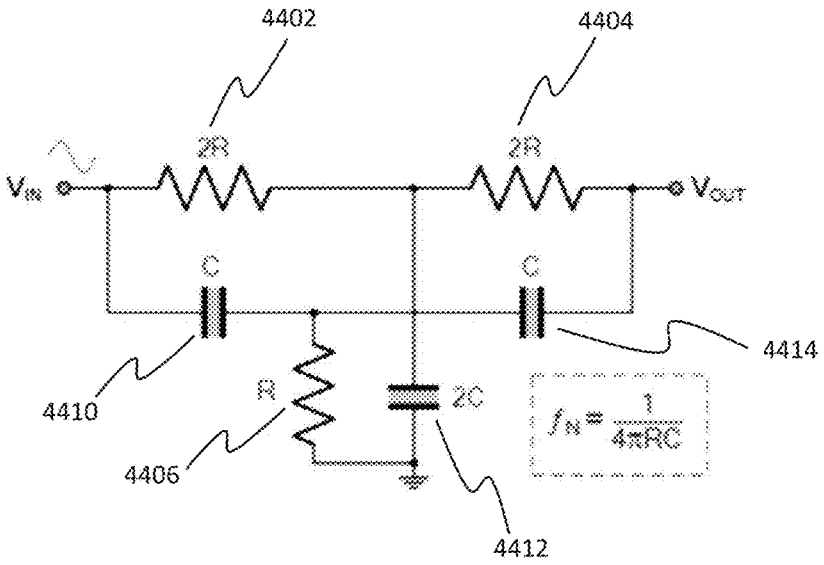
FIG. 44 illustrates a circuit diagram of passive components that can be used to operate as a notch filter.

FIG. 44 illustrates a circuit diagram of one arrangement of passive components that can be used to operate as a notch filter. It includes resistors 4402, 4404 and 4406 with capacitors 4410, 4412 and 4414 to provide notch filtering.

Passive components can also be used in more complex networks to compensate for anomalies in frequency response, to adjust the impedance the overall system presents to the amplifier that drives it, to create higher order crossover slopes, etc. Such techniques are well-known in the art.

One way of compensating for transducer resonance is to mechanically damp the transducer, as described in U.S. Pat. No. 9,430,921. An alternative approach is to electrically damp the output of the transducer.

Figure 45:
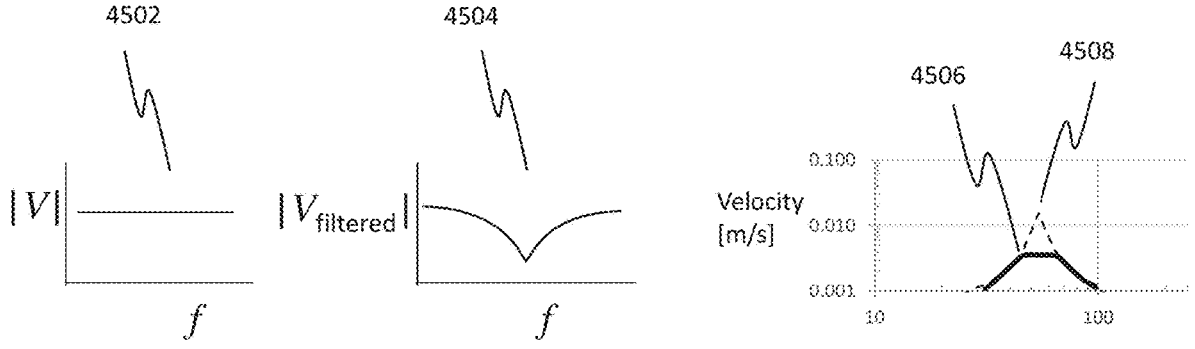
Prior Art Fig. 45
FIG. 45 illustrates the effect of a notch filter on frequency response.

One approach to electrical damping is to apply attenuation at the frequency of the known resonance of the transducer to the signal prior to transmission to the transducer. Thus, for example, if the tactile transducer has a primary resonance of 10 dB at 50 Hz, a notch filter as described above that provides 10 dB of attenuation at 50 Hz will (assuming that the Q factor of the filter matches the Q factor of the resonance) reduce or eliminate the ringing of the transducer in addition to reducing the frequency response errors as shown in FIG. 45.

Given a transducer with an undamped frequency response as shown in FIG. 40, and a flat target response 4502, passing the signal through notch filter 4504, the resulting output of the filtered transducer 4506 shows a significant reduction in resonant behavior relative to the unfiltered output 4508.

It should be noted that many highly resonant transducers (such as linear resonant actuators) are only capable of producing significant power at their resonant frequencies. Applying notch filtering to these transducers is likely to render them useless, because they have so little output at frequencies other than their mechanical resonance.

Such passive networks have been used for decades, and can be reasonably cost-effective in many applications. However, they have a number of disadvantages. High-quality passive devices can be bulky and expensive. In general, only relatively coarse corrections can be made with passive networks. The wide production tolerances of many passive components (and of the audio or tactile drivers themselves) can lead to significant mismatches between the anomalies to be corrected and the changes effected by the passive networks. And perhaps most significantly, a purely passive network cannot adapt itself to actual operating conditions of the device they are connected to. Thus a network/transducer combination that is tuned for flat response on a test bench is likely to have very different performance in a system that includes, for example, the mass and compliance of a complete headphone, and the mass and compliance of a wearer's head.

Figure 46:
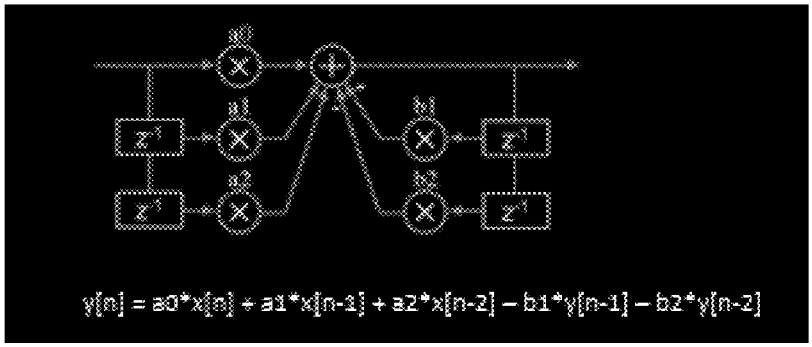
FIG. 46 illustrates an infinite impulse response filter.

FIG. 46 illustrates one of many methods of digital frequency response shaping familiar to those skilled in the art. In this instance an infinite impulse response filter (IIR) is employed. Constants a1, a2, b1, b2 are chosen to provide a suitable notch in the gain of a biquad filter that operates on the current input and a few stored inputs and output values.

where a0=0.9593257513671171 a1=−1.9169261881817297 a2=0.9593257513671171 b1=−1.9169261881817297 b2=0.9186515027342342 fs=8000 Hz

Figure 47:
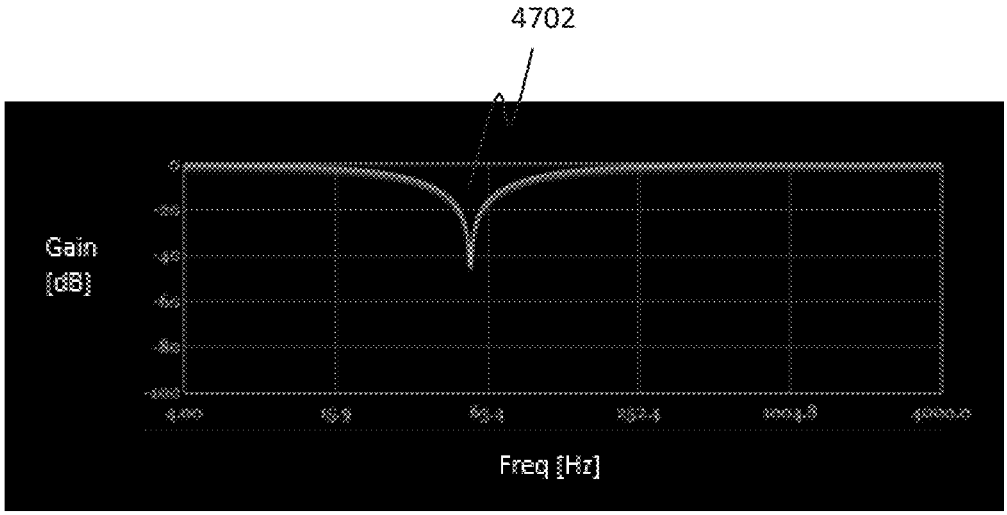
FIG. 47 illustrates a frequency genersted by an infinite impulse response filter.

The resulting frequency response from such an IRR filter is shown in FIG. 47. It shows a notch 4702 centered at 54 Hz. For a transducer that has a high-Q resonance at that frequency, such a filter can substantially reduce that resonant peak.

Frequency response correction can be implemented as an open-loop system—that is, with static parameters optimized for the assumed transfer function of the system based on optimization at the time the system is designed. This approach has a number of potential drawbacks. First, the key parameters of the system to be optimized will have tolerance ranges, as will the components used to correct for them. Thus in production, mismatches are likely, reducing the effectiveness of the networks. Second, even if the components are perfectly matched, the performance of the system in practice is the sum of additional factors such as the shape and size of the ears and head of the user. In addition, the goal should be to optimize the combined outputs of the tactile transducer and the acoustic transducer, as experienced by the user. It would thus be desirable to provide a means to measure the combined outputs—both tactile and acoustic—in real or near-real time, and dynamically optimize their combined output.

Altering frequency response in the digital domain offers a number of advantages, particularly in devices that already include digital signal processing capability. Complex filter topologies are possible, unit-to-unit variation (of the filter parameters) is largely eliminated, and the need for expensive and bulky inductors and capacitors may be eliminated. Digital signal processing also permits more sophisticated frequency response shaping, and allows the flexibility to easily permit adjustment of output at multiple frequencies.

Another objective of altering the output of audio drivers is to increase their linearity by comparing the input signal to the driver's output, and using any detected undesired differences to alter the signal sent to the driver. Such systems can compensate for a number of potential limitations. For example, the moving portions of most loudspeakers have a specified maximum range of motion. For a variety of reasons, most drivers are not fully linear through that range of motion. Mechanical suspensions may stiffen at extreme extensions of travel; the relationship between the magnetic field and the coil within it may change; the acoustic loading of an air suspension or the room in which the speaker is operating may change the mechanical impedance of the system at high volume levels, etc.

One method for applying error correction involves sensing the back electromotive force generated when a magnet moves relative to an electric coil (or vice versa). One such system is disclosed in U.S. Pat. No. 4,764,711). In such a system, current-sensing means can be connected to the wires transmitting voltage and current to a motor (such as a loudspeaker). The motion of the coil relative to the magnet modulates the voltage output by the current sensor. This modulation provides a means for sensing error in the fidelity of the output of the motor relative to its input: by monitoring the coil current relative to the amplifier voltage, it is possible to compute the relative velocity of the coil or coils relative to the magnet(s). When the velocity of the motor differs from the commanded velocity, that error can be used to generate an error-correction signal to be transmitted to the motor to improve the match.

A motor converts electrical energy into kinetic energy (and heat), and loudspeakers and tactile transducers are motors. Thus it is possible to use back EMF to improve the accuracy with which an audio or tactile transducer produces an output signal relative to an input signal.

However, such an error correction system may have limitations. The error signal read by the correction circuit is the sum of all electromagnetic forces acting on the coil of the driver being measured. Thus if another tactile or acoustic driver is proximate to the tactile driver being monitored, the varying magnetic field generated by the second transducer can modulate the magnetic field measured by the sensor read by the back EMF.

Another limitation of the back-EMF as an error-correction signal is that it is only loosely coupled to the desired control variable. The currently preferred control variable for a tactile transducer is force or motion at the skin/device interface. Back EMF from the coil is not a direct measurement of this variable.

Active correction has been applied to loudspeakers, and offers a number of advantages. One such system was developed by Velodyne, as illustrated in U.S. Pat. No. 4,573,189. It includes an accelerometer attached to the moving portion of the loudspeaker. A comparator circuit receives both the input signal and the output of the accelerometer. The comparator circuit detects nonlinearities between the input and output, and adjusts the signal sent to the driver to correct for them. This approach can significantly reduce distortion.

A perfect tactile transducer would produce a housing velocity proportional to the low-pass-filtered voltage of the acoustic signal. The dynamics of a real tactor/display/body system, however, make the uncorrected output likely to deviate from this ideal response, causing an error. Closed-loop feedback reduces this error. Housing motion can be sensed by the accelerometer, integrated to determine velocity, and this signal is inverted and scaled to produce an error correction signal. The error correction signal is combined with the primary input and fed to the amplifier driving the tactile transducer. Thus the signal from the accelerometer may be used to reduce distortion generated by the tactile transducer.

Figure 48:
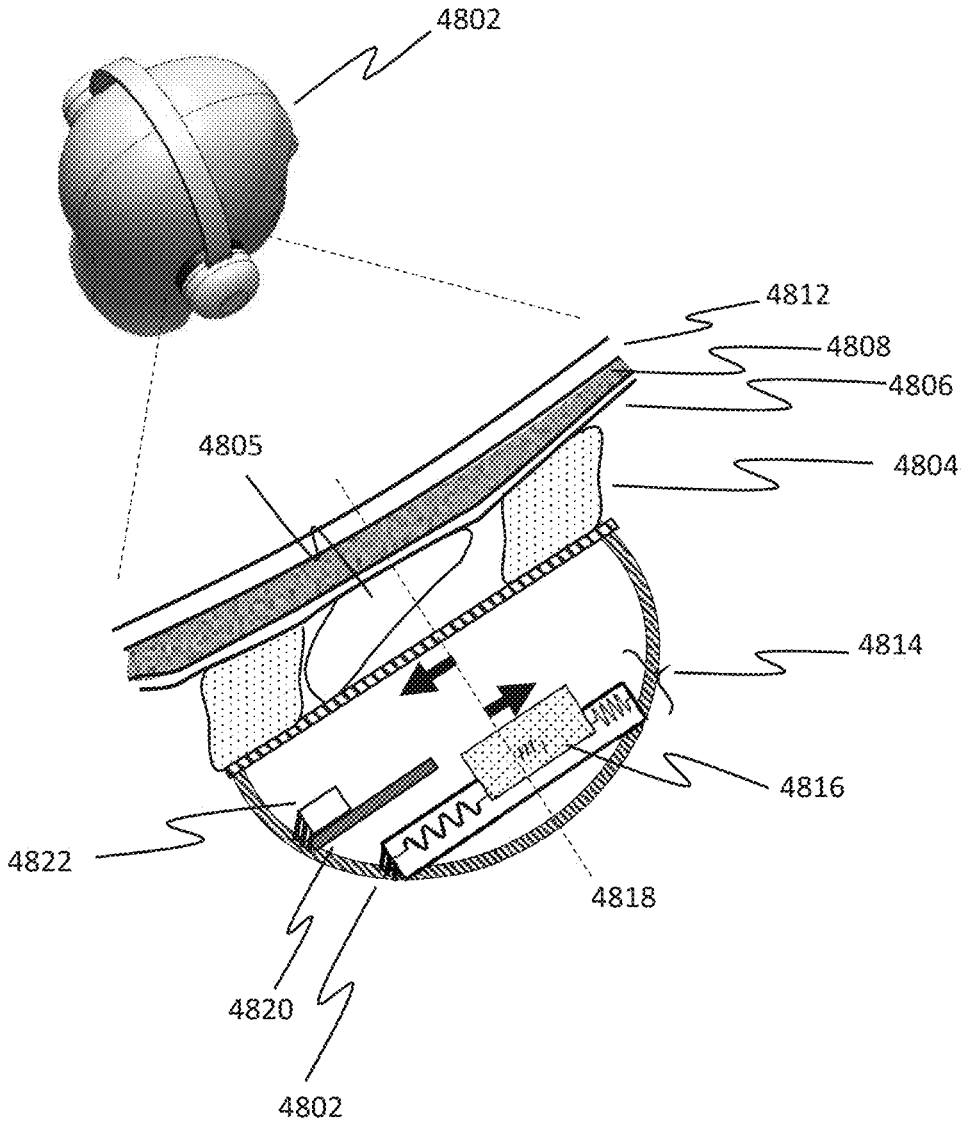
FIG. 48 is a cross-sectional view of an implementation of closed loop control of a headphone-mounted tactile transducer.

One aspect of the present invention applies active correction to tactile drivers that may be applied in headphones, virtual reality/augmented reality headsets and other devices. FIG. 48 illustrates one possible physical implementation of closed-loop control of a tactile transducer in a headphone or VR/AR or similar device. FIG. 48 is a cross-sectional view of one headphone cup, ear cushion, ear and a portion of the wearer's skull for one embodiment of the subject invention.

Earcup housing 4802 contains active and passive components in desired locations relative to the wearer's head 4801. Cushion 4804 surrounds ear 4805 holds the cup against the wearer's head, and transmits tactile forces to the wearer's skin 4806 and subcutaneous tissue 4808, which is in turn anchored to the wearer's skull 4812. Tactile transducer 4814 is mounted to earcup housing 4802 so that when inertial mass 4816 moves transversely to axis 4818, earcup housing 4802 also moves transversely to axis 4818, but with opposite phase.

Mounted within earcup housing 4802 is circuit board 4820. In addition to drive electronics, amplification and other related circuitry, circuit board 4820 includes at least one accelerometer 4822. Accelerometer 4822 is oriented so as to measure acceleration transverse to axis 4818, and provide an electrical signal to compensation circuitry as described further below.

Similarly, one or more accelerometers fixed to the housing of a wearable display is a useful source of sensor feedback for closed loop control.

Figure 49:
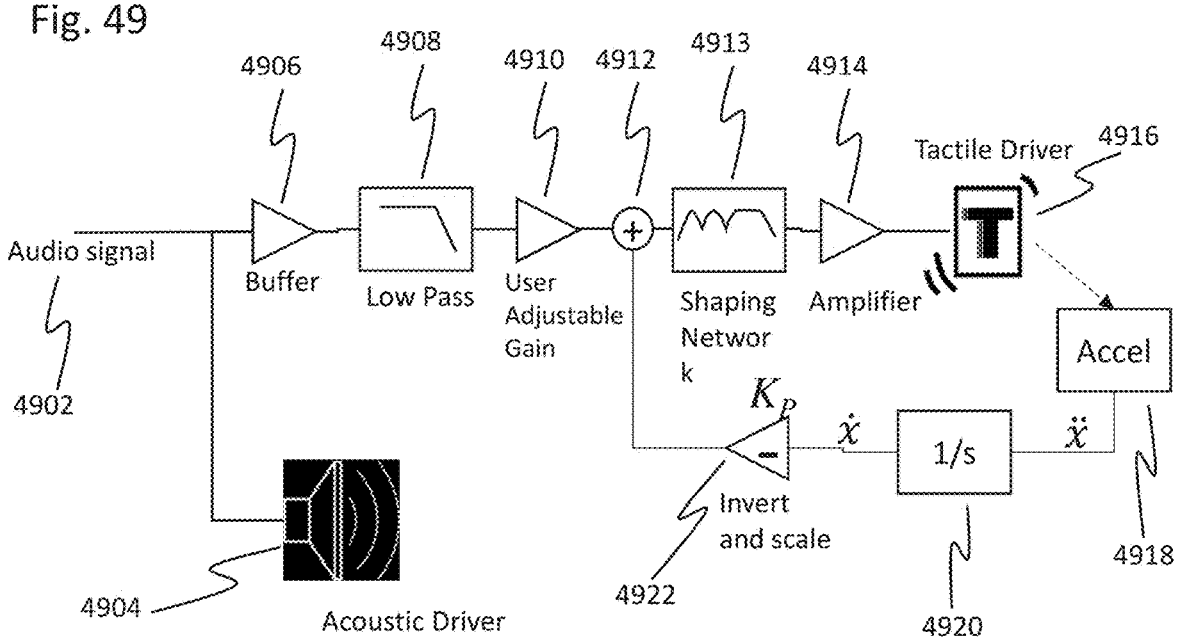
FIG. 49 is a simplified block circuit diagram of an exemplary closed loop control of a headphone-mounted tactile transducer.

Just as acoustic power in air is proportional to air velocity, mechanical power in skin is proportional to skin velocity. Accordingly, to transfer power uniformly to the skin across a range frequencies, velocity is a preferred process variable to control. To achieve this, accelerometer output can be integrated in the digital or analog domain to determine housing velocity, and a closed-loop velocity controller can be implemented to make housing velocity track input. An appropriate signal for the tactile driver is derived by low-pass filtering the acoustic signal bound for the acoustic driver, to extract frequencies below about 200 Hz, which are felt with the skin as well as heard with the ear. For simplicity of illustration, an example of an analog proportional controller based on this error signal is shown in FIG. 49.

Input signal 4902 is sent to both acoustic driver 4904 and to buffer 4906. (The signal to the audio driver may be full range, or may pass through a high pass filter to reduce overlap between the tactile and acoustic drivers.) After the buffer, the signal may be passed through a low-pass filter 4908 to optimize the signal for the bandwidth of the tactile transducer. The signal may then be adjusted with gain control 4910. The signal then moves to summing junction 4912, and then to amplifier 4914, and tactile transducer 4916. Optionally, a shaping network 4913 may be included to adjust the frequency response of the tactile transducer. The vibrational effect of transducer 4916 is sensed by accelerometer 4918. The output of accelerometer 4918 is processed by integrator 4920 and then module 4922, which inverts and scales the correction signal so that it can be fed back to amplifier 4914 through summing point 4912.

One method of implementing such correction is to mount an accelerometer to one of the moving internal components of the tactile transducers. Alternately, the accelerometer can be mounted to the housing of the transducer, or equivalently to a PCB fixed to the housing of a body-contacting device. Accelerometer 4918 can be one of several types well-understood in the relevant arts, such as a piezoelectric MEMS device.

Figure 50:
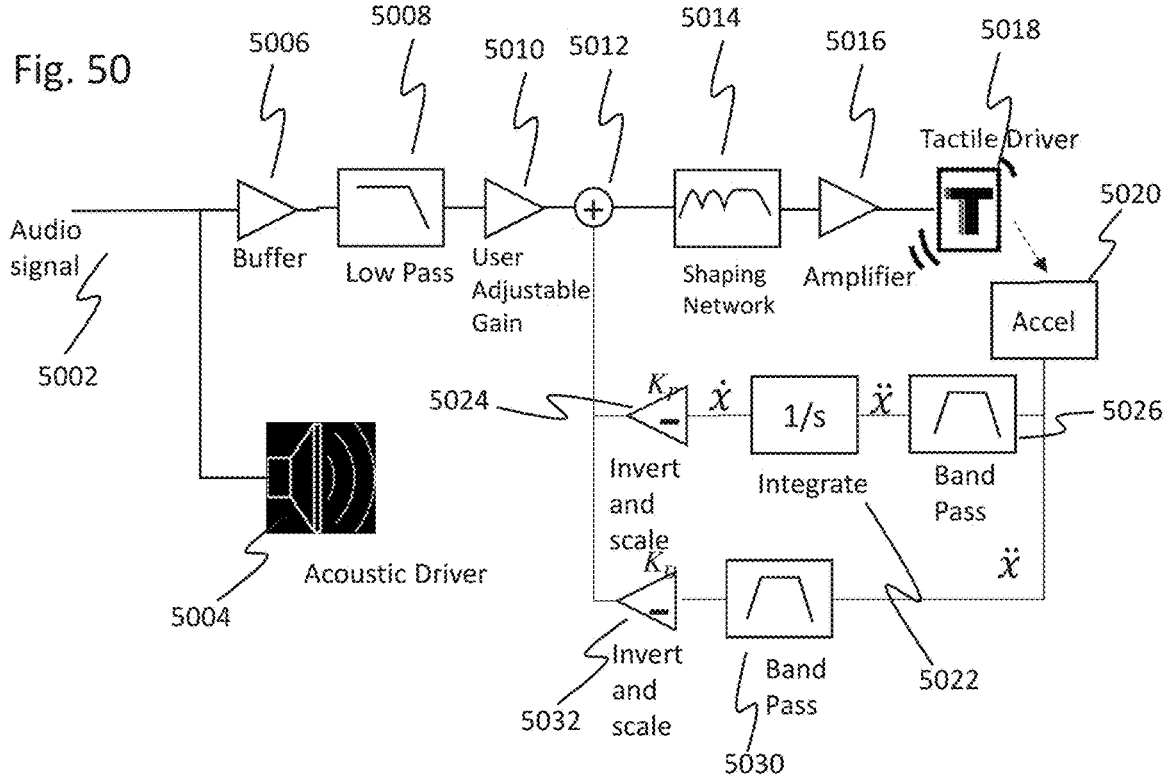
FIG. 50 is a block circuit diagram of another exemplary method of providing closed loop control of a headphone-mounted tactile transducer.

FIG. 50 shows a more detailed implementation of accelerometer-based correction. A shaping network is included. This implementation includes compensation for additional factors in order to further improve the accuracy of a tactile transducer.

Input signal 5002 is sent to both acoustic driver 5004 and to buffer 5006. (The signal to the audio driver may be full range, or may pass through a high pass filter to reduce overlap between the tactile and acoustic drivers.). After buffer 5006, the signal may be passed through a low-pass filter 5008 to optimize the signal for the bandwidth of the tactile transducer. The signal may then be adjusted with gain control 5010. The signal then moves to summing junction 5012, and then optionally to shaping network 5014. It then is sent to amplifier 5016, and tactile transducer 5018. The vibrational effect of transducer 5018 is sensed by accelerometer 5020.

As in FIG. 49, the output of accelerometer 5020 is processed by integrator 5022 and then module 5024, which inverts and scales the correction signal so that it can be fed back to amplifier 5016 through summing point 5014.

The accelerometer signal can be further processed to improve its accuracy. Gravity exerts a constant pull (at least when a user is at rest). Sudden movements of the user's head can also generate movement that could reduce the accuracy of the correction signal. It may be therefore useful to filter those effects from the error-correction signal. This can be accomplished with a band-pass filter 5026 tuned to reject gravitational acceleration (for example, $f_{low_corner}$<5 Hz) and impacts (for example, $t_{high_corner}$>300 Hz). Furthermore, both acceleration and velocity signals may be used by the controller, with proportional gain KP and derivative gain $K_D$ provided by additional filter 5030 and inverter-scaler 5032. This implementation provides closed-loop proportional-derivative control (PD-control) of velocity. As will be familiar to those skilled in the art, the inclusion of these derivative signal enables reduced overshoot as the system tracks the velocity setpoint.

Figure 51:
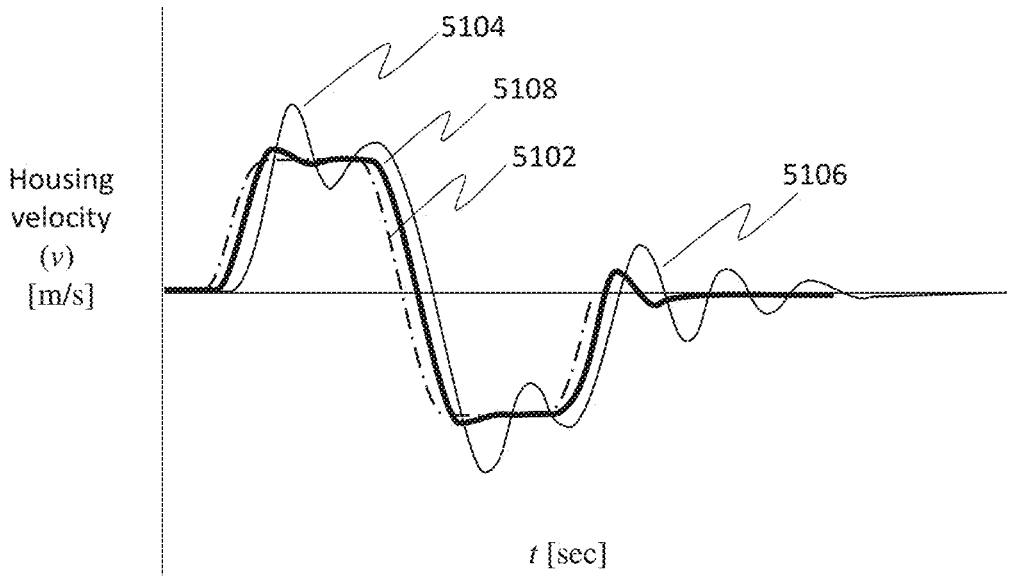
FIG. 51 is an illustration of the time domain effect of closed loop control of a headphone-mounted tactile transducer.

FIG. 51 illustrates the potential benefit of such a circuit on the response of the tactile driver. Shown are three versions of a tactile transducer signal, overlaid to demonstrate differences. Dotted line represents 5102 represents the input signal. Divergence from the input represents a form of unwanted distortion. Thin solid line 5104 represents a possible real-world uncompensated output of a damped tactile transducer. It shows ringing 5106, which represents potentially significant distortion. Thick line 5108 represents the output of the tactile transducer as compensated by the type of network described in FIG. 50. Ringing is significantly reduced, and response time is slightly reduced.

An alternative approach to controlling tactile output is to directly sense the motion of the moving mass of the tactile transducer, for example using a device such as an optical sensor or Hall effect sensor. In this approach, the sensor may be attached to the moving mass, or to the frame or other structure that moves relative to the moving mass when the tactile transducer is active.

As will be familiar to practitioners skilled in the art, the control elements outlined above in analog form can be economically implemented in the digital domain in a microcontroller. The shaping filter, for example, may be stably implemented as a Finite Impulse Response (FIR) filter with tap coefficients chosen to suppress unwanted resonances and bring up under-represented frequencies. The bandpass filters and integrators may be conveniently implemented in IIR (Infinite Impulse Response) biquad form, or in other digital forms suited to the capabilities of a given microcontroller. Anti-aliasing filters before and after the computation may be used to reduce discretization artifacts associated with conversion between digital and analog signals.

On the sensor side, another approach is to close the loop using a sensor signal that is related to the force that the body-worn device imposes on the skin. A force sensor may be situated, for example, between the rigid housing of a worn device and a cushion, to provide a measurement of contact force. Thin, commercially-available Force-Sensitive Resistors (FSRs) and force-sensitive capacitors (FSCs) are suited to this purpose. Methods used in sensing contact force of robot grippers can also provide suitable indications of skin contact force. For example, if a hole is provided in the rigid housing and cushion cover so that the cushion foam is exposed to light from an underlying infrared emitter-detector pair, compression of the foam cells could be discerned optically as a change in reflected light. Or, if such a housing port is provided with a deformable dome, deformation of that dome can be tracked optically from reflected light. Or, if the dome is fitted with a small magnet, the deformation may be tracked with Hall effect sensors. By employing multiple sensors at the base of the dome, both shear and normal force may be determined. The sensing point may be brought still closer to the body surface. For example, a flexible force sensor may be situated beneath the cushion cover and on top of the cushion foam or other internal resilient material. Or, if the cushion is comprised of an electrically conductive material, and in direct contact with the skin, then the state of contact of the cushion with the skin may be sensed electrically as a change in capacitance or resistance of the entire electrode, or as changes between segments of that electrode. By these means and others, the contact force at the interface of skin and cushion may be measured and fed back to a tactor velocity controller.

Another alternative approach is to employ one or more microphones to measure acoustic output. An advantage of this approach is that it is capable of addressing not only the nonlinearities of the acoustic transducer, but also unwanted interactions between the tactile transducer and the acoustic transducer. A tactile transducer generates movement of the earcup of the headphone. That movement can change the effective volume of the chamber defined by the earcup and the wearer's head. Those volume changes can generate acoustic signals that are both perceptible and can either cancel or increase the bass signals generated by the acoustic driver. If sufficiently large in their movement, they can also affect higher frequencies by moving the acoustic driver relative to the eardrum, which Doppler shifts the frequencies produced by the acoustic driver when they are received at the ear drum. Since velocity of tactile actuation (0.01 m/s typical) is small (less than one part in one thousand) with respect to the sound velocity in air (~345 m/s) this distortion is not generally a problem. Acoustic effects due to changes in the chamber volume, however, can be significant. To produce low frequencies (e.g. f=10 Hz, □=62 rad/s) at a perceptible tactile intensity (|v|=0.01 m/s) requires housing displacement of amplitude A=(|v|/□)=0.2 mm. This displacement approaches the magnitude of the maximum working throw of a headphone acoustic driver (typically around 1 mm). So, if a component of this displacement vector slightly lifts or lowers the housing away from the ear, or if motion of one side of the chamber is impeded by the wearer's mandible, then this housing displacement can produce a significant change in chamber volume, and therefore a significant fluctuation in pressure.

To control the acoustic output to the user in the presence of this disturbance, Automatic Noise Cancellation (ANC) may be employed. ANC is known in the art, and is generally employed to mask external sound. Here, that technology can be used to reduce acoustic distortion generated by the tactile transducer. A microphone is located inside the housing or ear chamber of a headphone. It measures the instantaneous sum of the outputs of both the acoustic and the tactile transducers. The difference between the commanded and measured pressure provides an error signal that can be used to adjust the current to the acoustic driver. Before summation, a delay is introduced to the microphone signal to compensate for the finite speed of sound in the air between the driver and microphone. Appropriately timed feedback of this error signal to an amplifier powering the acoustic driver makes it possible to compensate for the unwanted disturbance of the tactile driver, significantly improving acoustic fidelity.

To the extent tactor-induced changes in chamber pressure are related to skin velocity, excess pressure measured at the ANC microphone can also provide a feedback signal for the tactile controller. In practice, however, the relationship between excess chamber pressure and tactile velocity of the cushion has proved to be complex. This may be because tactile motion of an ear cup housing can involve simultaneous motions parallel to the skin (x), normal to the skin (z), and rocking (θ). Each of these degrees of freedom has a different effect on chamber pressure. Furthermore, it is natural for each degree of housing motion freedom (x, z, θ) to have a different transient response associated with the compliance and inertia of each direction, which will naturally depend on variables including the dynamics of the wearer's body. Despite these difficulties, with boot-up calibration to the user, for example to an impulse response, excess microphone pressure may be used as a tactor feedback signal.

Figure 52:
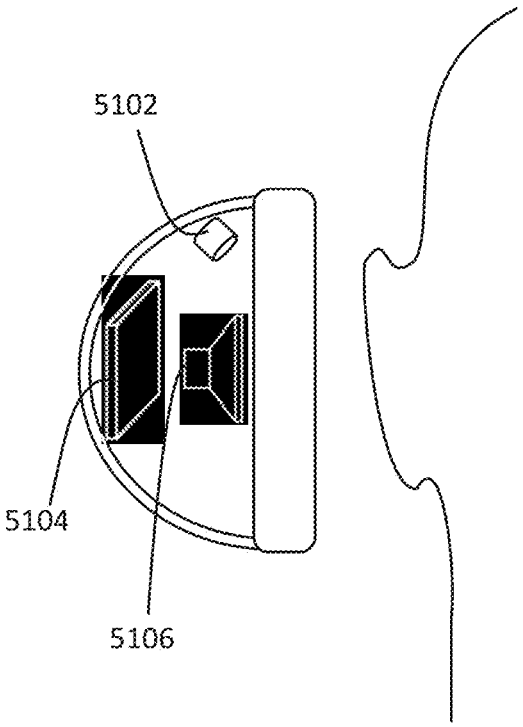
FIG. 52 illustrates components of a microphone-based implementation of closed loop control of a headphone-mounted tactile transducer.

FIG. 52 illustrates an implementation of this approach. A microphone 5202 is located inside the earcup. It detects the combined output of both tactile transducer 5204 and acoustic transducer 5206 and uses it to null unwanted acoustic signal from the tactile transducer.

FIG. 52 illustrates an implementation of this approach. A microphone 5202 is located inside the earcup. It detects the combined output of both tactile transducer 5204 and acoustic transducer 5206 and uses it to null unwanted acoustic signal from the tactile transducer.

Figure 53:
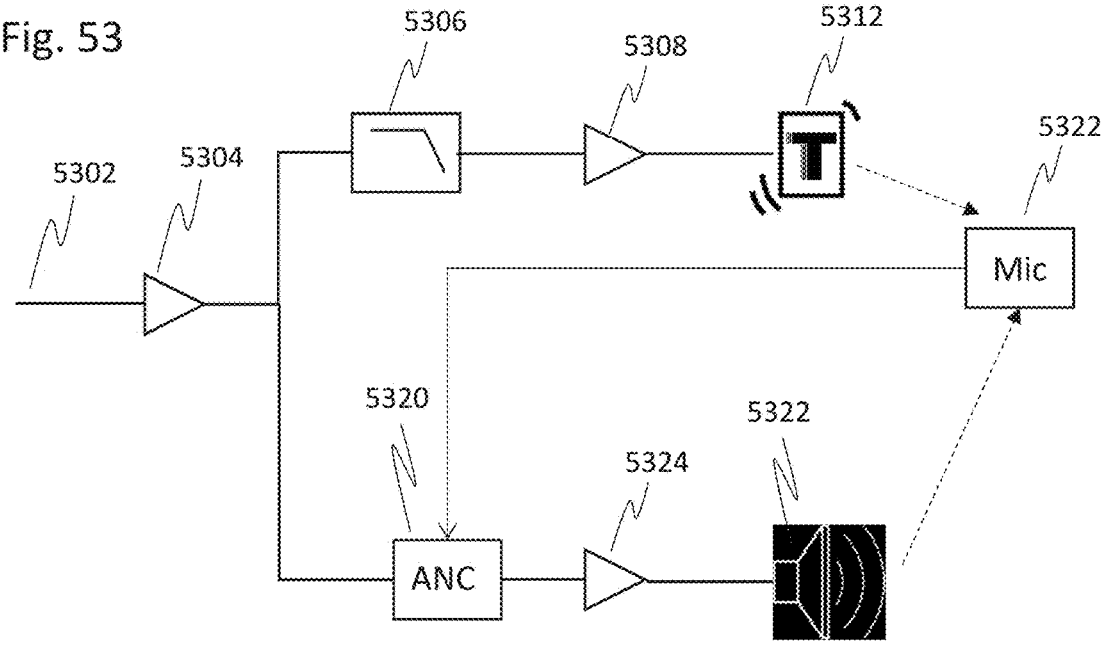
FIG. 53 is a simplified block circuit diagram of a microphone-based implementation of closed loop control of a headphone-mounted tactile transducer.

FIG. 53 illustrates a simplified circuit diagram for an embodiment of this aspect of the invention. Audio signal 5302 is fed to buffer 5304. It is then split. It is fed to low pass filter 5306, and tactile gain adjuster 5308. It is then fed to amplifier 5310 and on to tactile transducer 5312. The signal from buffer 5304 is also fed to noise cancelling module 5320, which combines input from one or more microphones 5322, which detect the acoustic output of both acoustic and tactile transducers, with the audio signal to cancel out unwanted signals, and feeds the corrected signal to gain module 5324 and the acoustic driver 5326.

Figure 54:
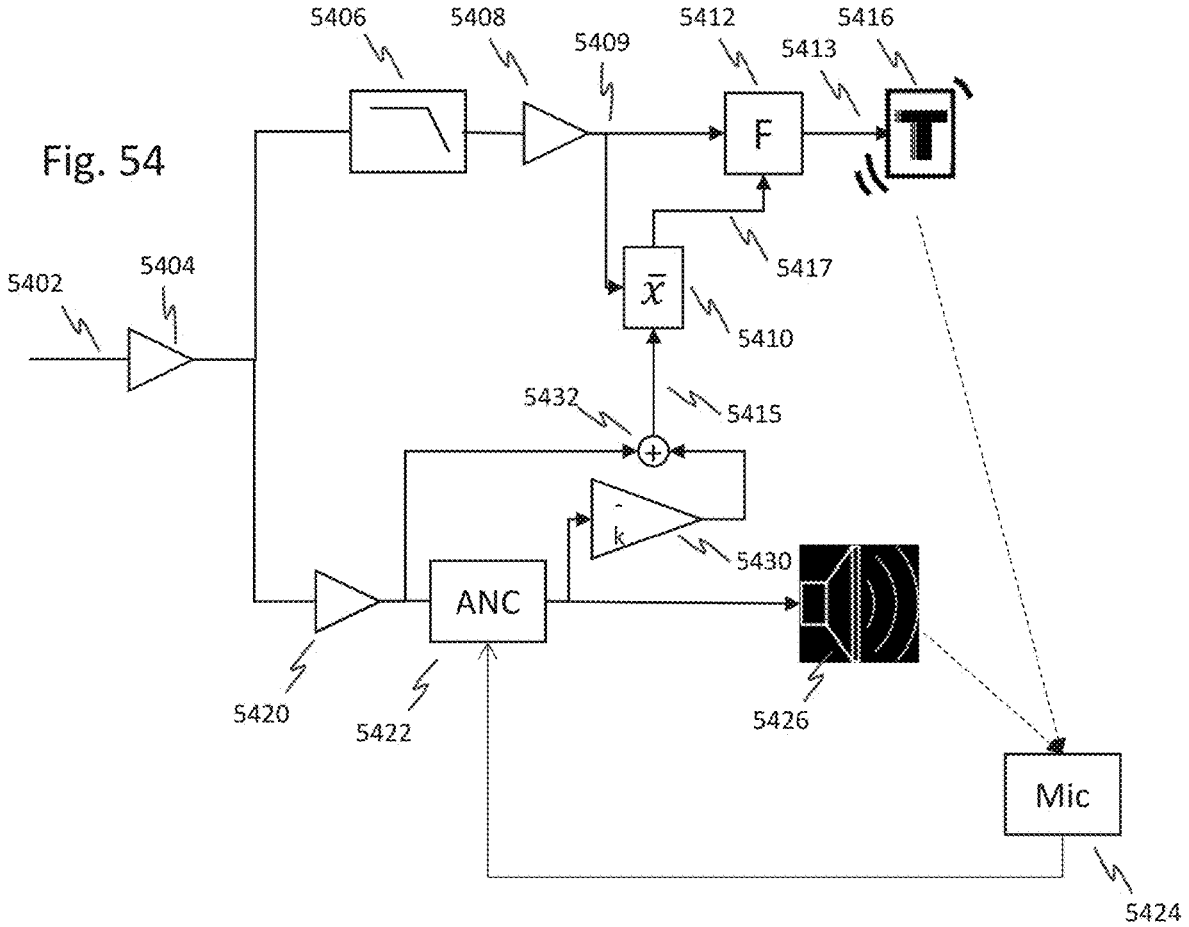
FIG. 54 is a block circuit diagram of another exemplary method of providing closed loop control of a headphone-mounted tactile transducer including a microphone.

FIG. 54 illustrates a simplified circuit diagram for an embodiment of the invention that includes means employing a microphone located inside the earcup to correct for excess sound pressure generated by a tactile transducer, and to provide closed-loop control of the tactile transducer. Audio signal 5402 passes through buffer 5404 and is then split. It is fed to low pass filter 5406, and tactile gain adjuster 5408. The resulting tactile command signal 5409 is also split, and goes to both tactile state estimator 5410 and tactile state controller 5412. The state controller adjusts the tactile command based on the state estimate provided by the state estimator to produce a corrected tactile drive signal 5413, that is is then amplified and fed to tactile transducer 5416. The signal from buffer 5404 is also fed to acoustic gain adjuster 5420, and then to noise cancelling module 5422. Noise cancelling module 5422 combines input from one or more microphones 5424, which detect the acoustic output of both acoustic and tactile transducers with the audio signal to cancel out unwanted signals, and feeds the corrected signal to the acoustic driver 5426.

The embodiment disclosed in FIG. 54 also includes inverting/scaling means 5430 and summing means 5432 for determining excess ear cup chamber pressure 5415 that is related to the position and velocity of tactile transducer 5416 and surrounding ear cup. This sensor-based feedback signal is sent to the tactile state estimator 5410. State estimator 5410 combines a model of the forward dynamics of the system with noisy sensor data 5415, to provide an improved estimate of the position state and velocity state of the ear cup and tactor. A Kalman filter or similar estimator is an appropriate means of embodying state estimator 5410. The state estimate signal 5417 is in turn fed to state controller 5412, so that under conditions in which the tactile transducer is generating excessive motion, tactile output can be reduced. Likewise, in instances where excess sound pressure arises from external acoustic sources, it can be canceled by sound generated by motion of the tactile transducer.

Figure 55A:
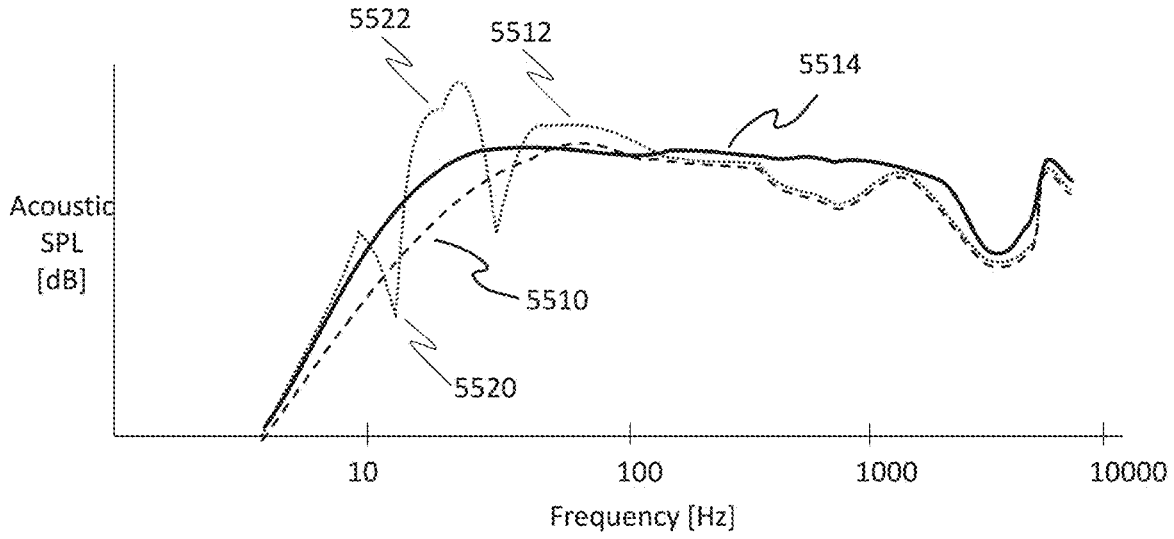
FIG. 55*a* illustrates the potential benefits of closed loop control of a headphone-mounted tactile transducer in the frequency domain.
Figure 55B:
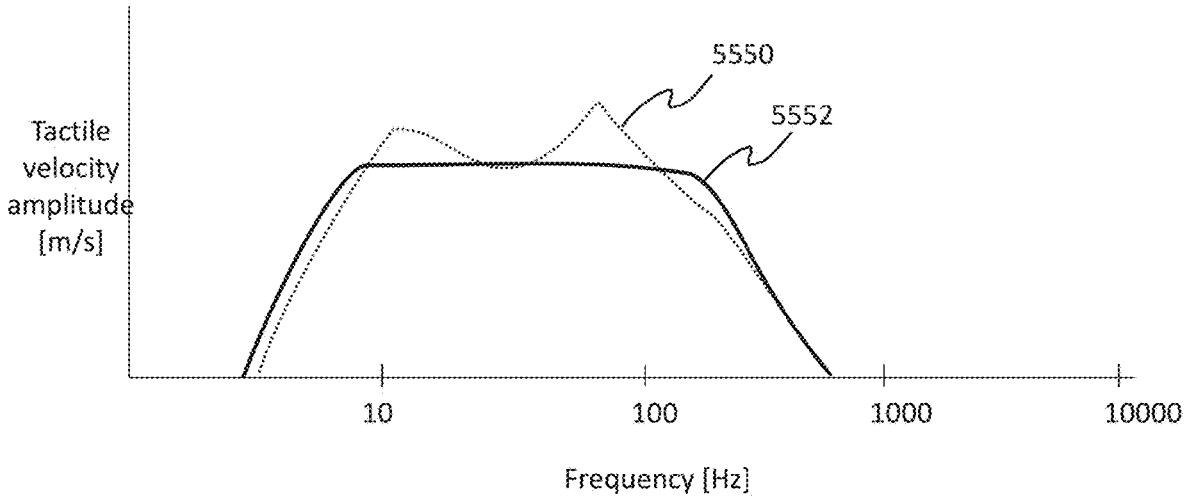
FIG. 55*b* illustrates the potential benefits of closed loop control of a headphone-mounted tactile transducer in the time domain.

FIGS. 55*a* and 55*b* illustrate how an embodiment of the illustrated invention can improve the linearity of the overall response of a device including both tactile and acoustic transducers. FIG. 55*a* compares the frequency response curves (measured acoustically) in the relevant range for a given headphone using uncorrected acoustic driver only 5510, both acoustic driver and uncorrected tactile driver 5512, and with corrective filtering according to an embodiment of the subject invention 5514. When operated together without corrective filtering, as shown in 5512, interactions between the two transducers can result in undesirable cancellations 5520 and reinforcements 5522 that result in distortion.

FIG. 55*b* shows a similar improvement in fidelity when measured in the realm of tactile velocity amplitude. Uncorrected output 5550 without feedback is non-linear. Output with feedback 5552 is much more linear.

An additional application for such a feedback system is to enable the use of tactile transducer with audio or audiovisual head-mounted systems that use means for sensing head position and or movement.

Virtual reality and augmented reality headsets generally rely on sensors to determine the orientation and relative movement of the head of the person wearing the device. This is important in order to create the illusion of being in an alternate space (in the case of VR) and to present contextual information in the correct location (in the case of AR). The same is true of headphones that seek to create the illusion of a virtual sound field such that when the headphone wearer turns her head, the source of a given sound remains fixed in the virtual environment. To the extent that these devices rely on motional sensors, which may include but may not be limited to accelerometers, the addition of tactile transducers could interfere with the accuracy of the determination of the instantaneous position of the wearer's head.

One solution to this problem is to provide an error correction signal tied to tactile output to the processor that performs the head position calculations. This error correction signal could be predictive or a true form of motional feedback. In the first case, a model of the motional response of the device for a given tactile signal can be provided to the positional algorithm, thereby allowing it to compensate for that predicted tactile-generated motion. In the second case, one or more accelerometers can detect actual tactile-generated motion and thus apply a correction factor to compensate.

It should also be noted that frequency response is not the only aspect of sound reproduction that is important. In order to reproduce sound with maximum fidelity, sounds need to not just be produced at the right levels, they must also be reproduced at the right time. One of the complexities associated with passive equalization is that it generally changes temporal signal relationships as well. In a multiple driver system, than can cause complex conditions in which the output of multiple drivers produce the same frequencies. This can result in cancellation at some frequencies and reinforcement at others. When two drivers reproduce the same frequency, the resultant output (measured at a given point, such as the listener's ear) can be equal to the sum of the individual outputs of the two drivers if the signals arrive in phase (zero degrees of phase difference), or the second driver can completely cancel the output of the first driver, if the signals arrive precisely (180 degrees) out of phase, or anywhere in between these two extremes if the offset is somewhere between 0 and 180 degrees. These effects can have significant adverse effects on fidelity.

A major advantage of tactile bass transducers is that tactile drivers use a different neural pathway than audio transducers use, so (with pure tactile transmission) such cancellation/reinforcement effects do not occur. However, in some implementations of tactile transducers in a headphone or VR/AR headset or similar device, the movement of the tactile transducer may also generate audible signals. This audio output may be directly generated by the movement of the transducer, or it may be generated by movement of the earcup and cushion against the wearer's ear, or some other mechanism. Such interactions can materially alter the overall frequency response of the combined system. Those interactions can be difficult to predict a priori. Differences in the size and shape of the wearer's head, the mechanical properties of the ear cushions, the components forming the mechanical connection between the two earcups can affect these interactions.

It would be advantageous for a combined tactile/audio head-mounted system to provide a means to detect and correct for unwanted interactions between tactile and audio driver output.

Another aspect of temporal fidelity that such control circuits can improve is the impulse response of its drivers. An ideal transducer does not store energy: for a speaker or tactile transducer, electrical energy would be immediately converted to motion, and that motion would stop as soon as the electrical input signal stopped. In reality, transducers have mass, and when combined with the suspension systems used to locate the moving portion of the transducer, they become energy storage devices. Worse, the amount of energy stored varies with frequency, and energy that is put into the system at one frequency may be subsequently released at one or more different frequencies.

These effects can be partially mitigated through use of mechanical damping, such as with fluid damping. But with the advent of powerful and inexpensive digital processing circuitry, it is possible to further improve the time domain performance of both audio and tactile transducers.

It would be desirable to provide a means for digitally controlling the output of tactile transducers, and the combined output of tactile and audio transducers in a mixed system, to improve time domain performance.

One method for electronically tailoring the output of the tactile transducer is to apply filtering that compensates not only in the frequency domain but also in the time domain. A finite impulse response (FIR) filter can be used to improve the impulse response of a transducer in several ways. An FIR filter can reduce the tendency of a transducer to ring at its resonance. An FIR filter can also improve impulse response by boosting the first cycle of a given signal while attenuating subsequent cycles. And they can correct phase anomalies to reduce unwanted cancellation or reinforcement between the tactile and acoustic drivers.

Figure 56:
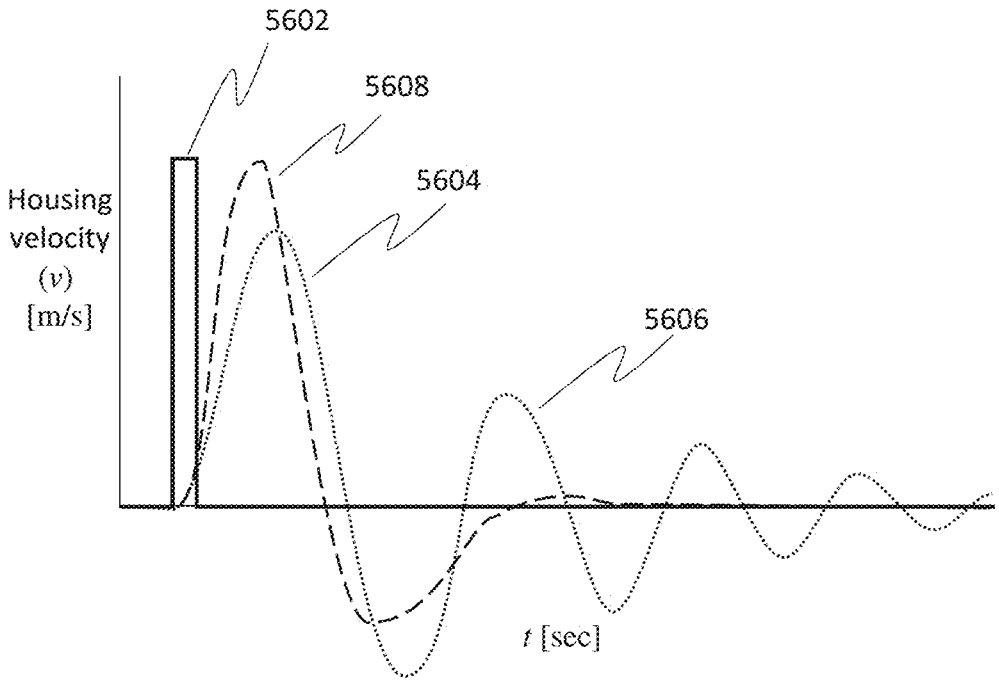
FIG. 56 illustrates the effect of an FIR filter on the time domain response of a tactile transducer.

This feature of the instant invention is illustrated in FIG. 56. A signal comprising a single impulse 5602 is fed to a tactile transducer. An uncompensated real-world transducer produces response 5604, which diverges from the input signal in multiple ways. The inertia of the mass-spring system prevents the transducer from moving quickly enough to deliver the full energy of the impulse in a single cycle. Instead, some of that energy is dissipated over time, which produces ringing 5606. The transducer does too little and then too much. The initial lag reduces the ability of the transducer to produce the leading edge of transients; the subsequent ringing produces perceptible blurring, and overhang.

The output of the same tactile transducer when it is fed a digitally generated error correction signal may look like 5608. The rise time of the impulse has been improved, and the ringing significantly reduced.

A finite impulse response filter generates an error correction signal to be combined with the input signal 5602. The error correction signal provides additional in-phase energy corresponding with the initial impulse in order to make the initial impulse output more closely resemble the input impulse. The correction signal provides out-of-phase energy to the portion of the waveform following the initial impulse in order to reduce ringing. The resulting output 5608 more closely represents the input.

Finite impulse response filtering can also be used to flatten frequency response and reduce the resonant peak of a tactile transducer, thereby reducing or eliminating the need for mechanical damping. Thus finite impulse response filtering may also improve the efficiency of a tactile transducer relative to mechanical damping, because mechanical damping is likely to reduce output at a wide range of frequencies, while finite impulse response filtering can be applied selectively, only reducing output at certain frequencies.

Figure 57:
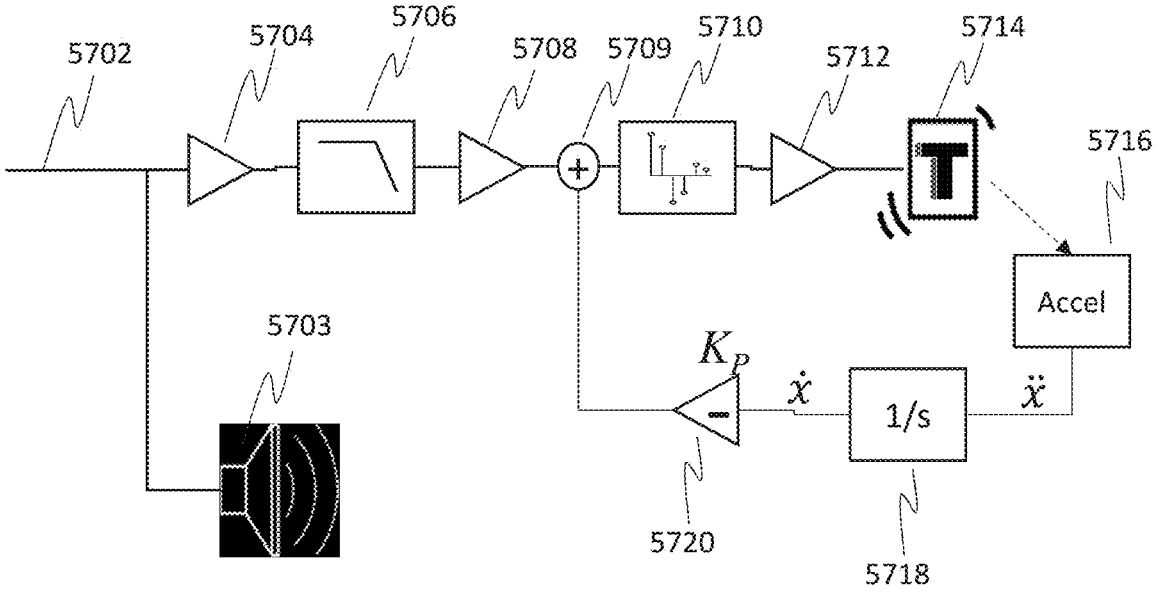
FIG. 57 is a simplified block diagram of an FIR filter applied to a tactile transducer.

FIG. 57 shows tactile signal processing in which a Finite Element Response filter is applied in the signal path to speed the leading edge of the impulse response, reduce unwanted ringing, and even out the frequency response. Input signal 5702 is fed both to acoustic driver 5703 and buffer 5704. The output of the buffer is then fed to low pass filter 5706, user gain adjustment 5708, and moved forward to summing point 5709. It then moves to FIR filter 5710, amplifier 5712 and tactile driver 5714. The tactile output of driver 5714 is measured by accelerometer 5716. The output of accelerometer 5716 is processed in integration module 5718, inverted and scaled in inverter 5720, and fed back to summing point 5709.

When tactile drivers are combined with acoustic drivers, additional complications are introduced. A tactile driver may have acoustic output of its own, which can interact with the acoustic output of the primary driver. In addition, in a closed back headphone, a chamber is defined by the space enclosed by the headphone cup, cushion, and the wearer's head. If the movement of the tactile transducer modulates the volume of that chamber, then the effect will be similar to movement of a transducer moving at that frequency, with a potentially strong acoustic component added to the tactile output. That acoustic output can interact with the acoustic output of the main driver (and the tactile output of the tactile driver) in undesirable ways. It can cancel acoustic output at some frequencies and augment it at others.

A development in the field of headphones in recent years is the emergence of active noise-canceling headphones. The basic principle these headphones employ is that a sound wave can be cancelled by generating its inverse. Thus in general these headphones use a microphone to detect noise in the environment, and active signal processing and amplification to generate an inverse signal to be produced by the acoustic driver of the headphone, thus substantially reducing the amplitude of the undesired sound at the wearer's ear. In some designs the microphone is located on the outside of the headphone, so that it (ideally) only receives the external sounds the system is supposed to attenuate. In other systems, there may be a microphone located inside the earcup.

One limitation of ANC is that it is most effective for periodic noise. This is inherent in the fact that ANC is always generating output that lags behind its stimulus. For periodic signals, this is not a serious problem, but for transient signals with wave periods on the order of the feedback lag, ANC is of limited value. Because the noise prevalent in one of the most common uses for noise cancelling headphones (air travel) is largely periodic, they can work well in those contexts.

Another significant challenge for conventional noise cancelling headphones is that the cancellation can only operate within a somewhat constrained frequency spectrum. The acoustic drivers in most headphones have limited output at low frequencies. They are therefore limited in their ability to attenuate low frequency noise that can annoy listeners [Leventhall, 2004].

HG Leventhall. Low frequency noise and annoyance. Noise and Health. 6(23):57-72 (2004).

It would therefore be advantageous to provide a means for extending the low frequency capabilities of noise cancelling headphones Tactile transducers such as those described above can be capable of significant output at extremely low frequencies. Those transducers can be utilized to cancel external noise at low frequencies that are not easily cancelled by acoustic drivers.

Figure 58:
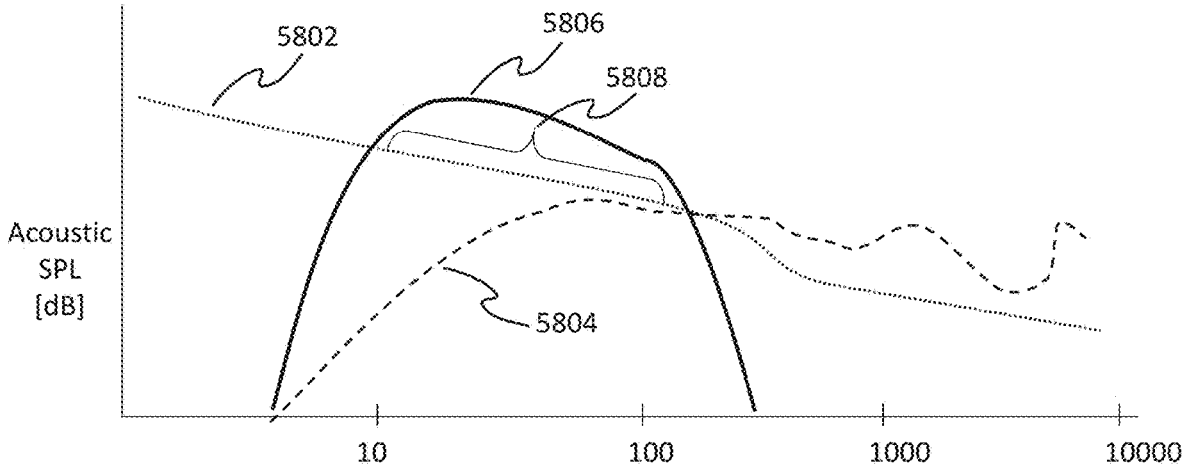
FIG. 58 is an illustration of the benefit of tactile transducers on the noise-cancelling capabilities of headphones with ANC.

FIG. 58 illustrated the improvement in isolation potentially achievable with an embodiment of the subject invention. Dotted line 5802 indicates the spectrum of noise in a given environment. Dashed line 5804 indicates the limits of driver output for a given conventional acoustic driver. ANC cannot exceed the capabilities of the acoustic driver; thus noise outside the performance envelope of the acoustic driver in a conventional noise cancelling headphone cannot be attenuated. Heavy line 5806 indicates the audiotactile performance envelope of a tactile transducer such as those described herein. Incorporation of such a driver in a noise cancelling headphone could produce a significant benefit in noise reduction 5808.

Combining ANC, acoustic transducers and tactile transducers permits an additional benefit. It is also possible to reduce not only the effects of outside noise, but unwanted acoustic noise generated by the tactile transducer. In brief, the presence of a microphone inside the headphone cup makes it possible to detect interaction between the output of the two transducers, and to alter the output of one (or both) of them in order to reduce or even eliminate adverse interactions, as described above, and shown in FIG. 53.

Another issue that can arise when combining tactile and acoustic drivers (or using tactile drivers in conjunction with acoustic content generated by other systems) is that the dynamic range commonly used in recorded audio (that is, the range between the very soft and very loud sounds in a recording is roughly 80 dB, while the comfortable tactile dynamic range appropriate for applications such as headphones and VR headsets is significantly smaller—on the order of 20 dB. That difference makes matching a tactile driver with an acoustic driver challenging. If no mechanism is used to compensate for that difference, at least one of two issues will arise: either quiet acoustic signals will have no tactile component, or there will be no difference in tactile output between moderately loud acoustic sounds and the loudest acoustic sounds (or potentially both will occur if the tactile transducer is set so that its dynamic range corresponds with the middle of the acoustic range).

Figure 59:
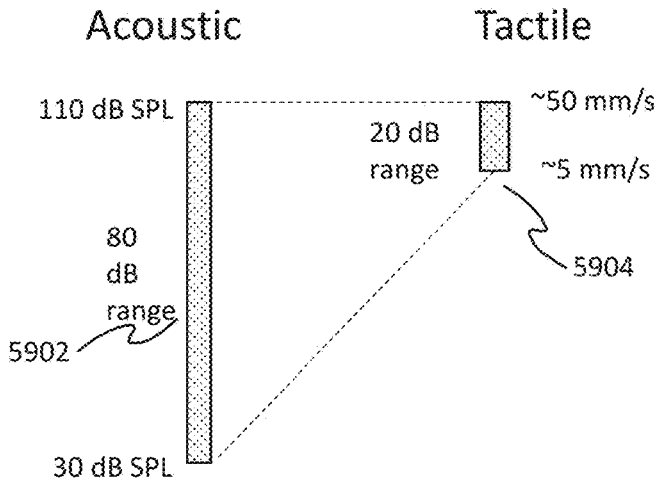
FIG. 59 illustrates the difference between the useful dynamic range of acoustic and tactile sensory systems.

FIG. 59 graphically illustrates the problem. Acoustic recordings may have an 80 dB dynamic range 5902 between minimum and maximum levels. Tactile dynamic range 5904, bounded by perceptibility at the low end and discomfort at the high end, is roughly 20 dB.

It would thus be desirable to implement a means for mapping the output of a tactile driver to the relatively wide dynamic range of music and other audio content when perceived acoustically.

Figure 60:
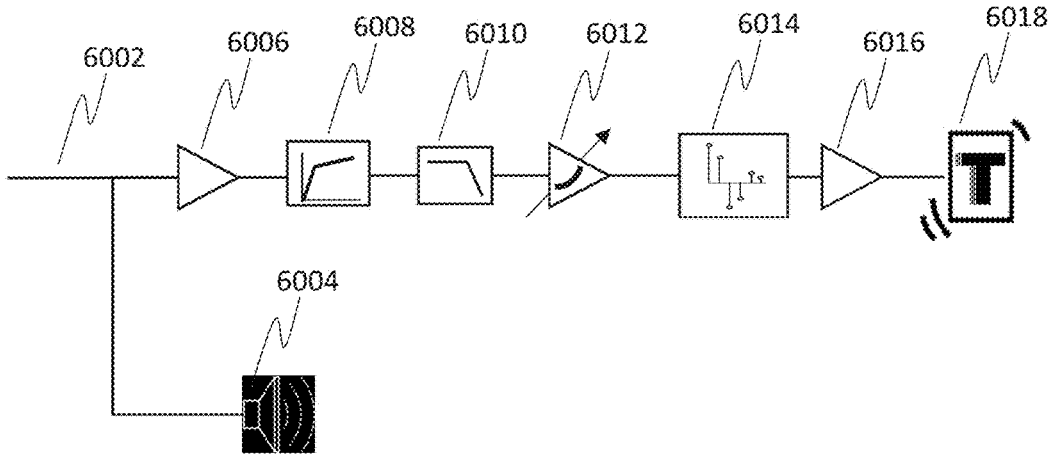
FIG. 60 a simplified block circuit diagram of a system for matching tactile and acoustic dynamic range.

An embodiment of the present invention accomplishes this goal by applying a form of dynamic range compression to the signal prior to amplification and transmission to the tactile transducer. For example, FIG. 60 shows a simplified block circuit diagram for a system for matching tactile and acoustic dynamic range. It optionally includes a compressor to bring soft audio signals up into the range of tactile perception. It also optionally includes a non-linear mapping of the tactile intensity control knob to tactile amplifier gain. Just as the nonlinear sense of acoustic intensity is handled with logarithmic taper potentiometers, the nonlinear tactile sense of intensity may also be afforded appropriate user controls.

Analog or digital input signal 6002, sent from an audio amplifier, Bluetooth receiver, USB interface IC, or similar, is transmitted both to acoustic driver 6004 and to buffer 6006. It is then passed to dynamic compressor 6008. It then passes through low pass filter 6010, and non-linear user-adjustable gain control 6012, finite impulse response filter 6014 (if used), amplifier 60616, and finally to tactile driver 6018.

Figure 61A:
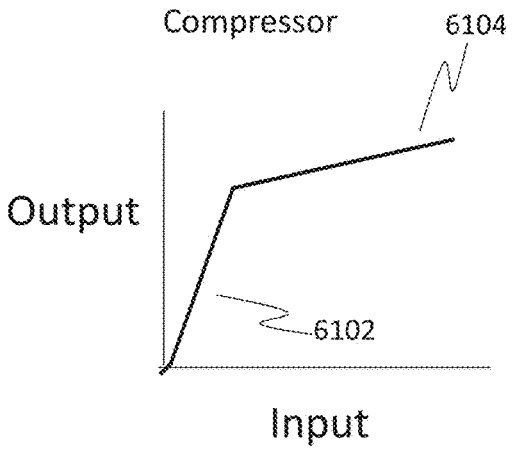
FIG. 61*a* illustrates a possible input-output function for matching the dynamic range of tactile transducers to acoustic drivers.

FIG. 61*a* illustrates a possible input-output function for compressor 6008 in FIG. 60. In the currently preferred embodiment, the compression applied to the tactile signal provides for a large delta in output (that is large gain for small signals) (such as 30 dB or 40 dB of output) for inputs at low levels (such as 20 dB) 6102, and a small delta (e.g. an output of 100 dB with an input of 99 dB) at high levels 6104.

Figure 61B:
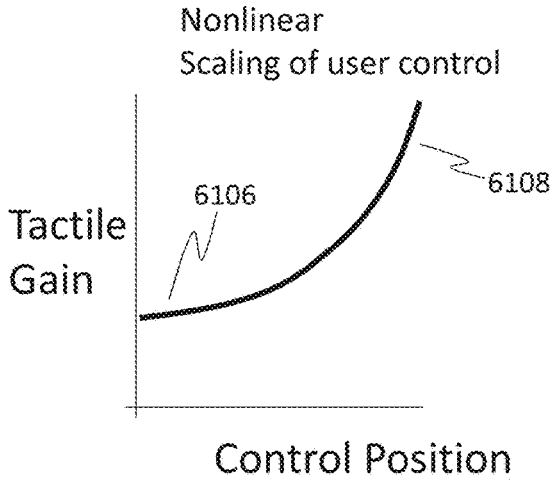
FIG. 61*b* illustrates a possible input-output function for non-linear user adjustable gain for tactile transducers paired with acoustic drivers.

FIG. 61*b* illustrates a possible input-output function for non-linear user adjustable gain 6012 in FIG. 60. In the currently preferred embodiment, the user-adjustable gain control provides a relatively smooth transition from small changes in output (e.g. from 0.3 to 0.4 Volts amplitude, or a 25% difference) for change in intensity control position at low drive levels (e.g., changing intensity knob or slider or other control settings from 20%-40% of overall travel) 6106, and large changes in output (e.g. from 2 to 4 Volts amplitude, or a 100% change) for equivalent changes in intensity control position at high drive levels (e.g. from 80% to 100% knob travel) 6108.

In many applications, it will be undesirable for a tactile transducer to produce audio-frequency output. If tactile transducers in headphones or devices like VR/AR headsets are sent audio-frequency signals, they may produce audio-frequency output that the user will hear. One situation in which audio-frequency signals may be unintentionally sent to a tactile transducer is if a stage in the electronic circuit feeding signals to the transducer is overloaded, also known as clipping. Such a clipped signal is likely to contain considerable high-frequency energy. Because the ear is exquisitely sensitive to frequencies in the 1 kHz-5 kHz range, special care should be taken to avoid sending clipping signals to the tactile transducers. Clipping signals can also arise from compression. For example, in gaming impulse sounds like shots often occur after long periods of silence. Clipping signals can also occur if a tactile transducer is intentionally over-driven. Overdriving a tactile transducer may be a useful technique for increasing its peak output in certain circumstances. However, it would be desirable to suppress from its drive signal any frequencies from approximately 200 Hz up into the kilohertz range. Fortunately, this can be accomplished with a soft saturation filter.

Unlike some other approaches to limiting, which operate on a "look-ahead" basis and thus introduce latency, a soft saturation filter has no look-ahead, and is continuous in its first few derivatives. One computationally efficient way of providing the soft saturation function is to apply a cubic roll-off above a given threshold.

Figure 62:
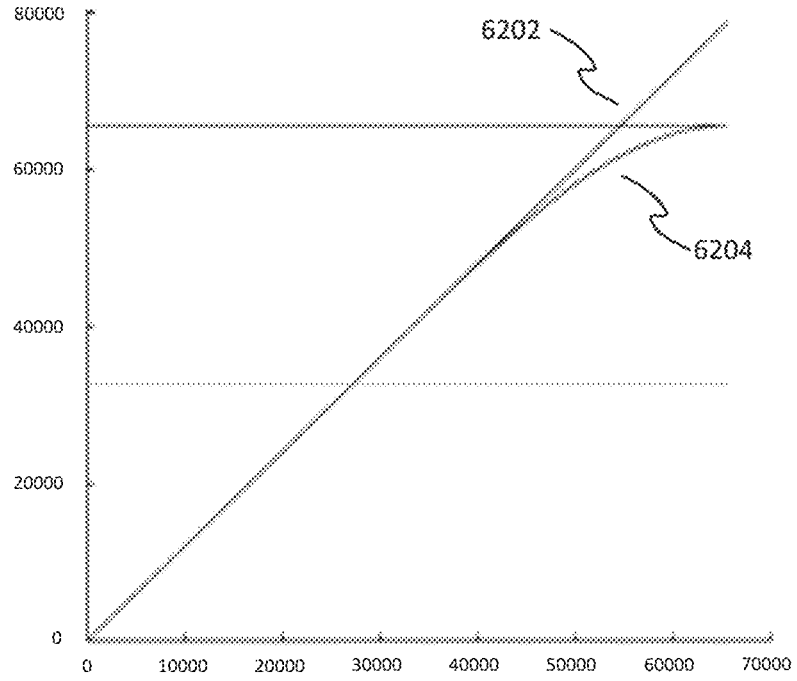
FIG. 62 illustrates the effect of an exemplary soft saturation filter.

FIG. 62 illustrates the effect of an exemplary soft saturation filter. In the absence of the soft saturation function, input function 6202 would equal output. Soft saturation filter output 6204 shows that as in the input signal rises above threshold 6206 output is increasingly reduced relative to the input signal.

The soft saturation output limiting shown in FIG. 62 can be produced by the code below, which implements the cubic roll-off above the threshold (t), and compensates for the 3:4 gain associated with the filtering:

```
s = 0:2^16;
t=2^15;
n=0.75*(2^32);
y = s;
for i=1 :length(y),
    if s(i)<t, y(i)=s(i);
    else y(i) = (s(i) - (((s(i)-t).^3)./n)); end
end
where:
s(i) = input signal at instant (i)
t = threshold
n = gain correction factor
y(i) = output signal at instant (i)
```

Tactile drivers can enhance the immersiveness of almost any kind of sound reproduction experience. Headphones as described above can add to the experience of watching movies, especially in the home theater context. But modern movie sound tracks tend to provide more than 2 channels of audio—in some cases, many more channels. High-end home theaters, like modern traditional theaters, can present a rich, 3-dimensional soundscape. Conventional stereo headphones cannot reproduce that complex soundfield (unless uncommon techniques like binaural recording are employed). Although many attempts have been made to provide the multichannel experience with headphones, convincing experiences have proven elusive. And an important part of the experience of going to a large movie theater is the large acoustic space and its carefully engineered loudspeaker system.

Movie theaters and their sound systems can be designed to present powerful low-frequency sound effects. But those approaches to delivering deep bass can have drawbacks. Low-frequency systems capable of high pressure levels in such venues can be large and expensive, and require very powerful amplifiers. Perhaps more significantly, it is extremely difficult and expensive to prevent low frequency energy from leaking from one theater to another. It can be distracting and annoying to patrons watching a move in one theater to hear the low frequency portion of the soundtrack of a different movie playing in the next theater.

It would therefore be advantageous to provide a system that would permit a user to achieve tactile low-bass stimulation while still being exposed to a outside sounds, including a multichannel sound field.

Figure 63:
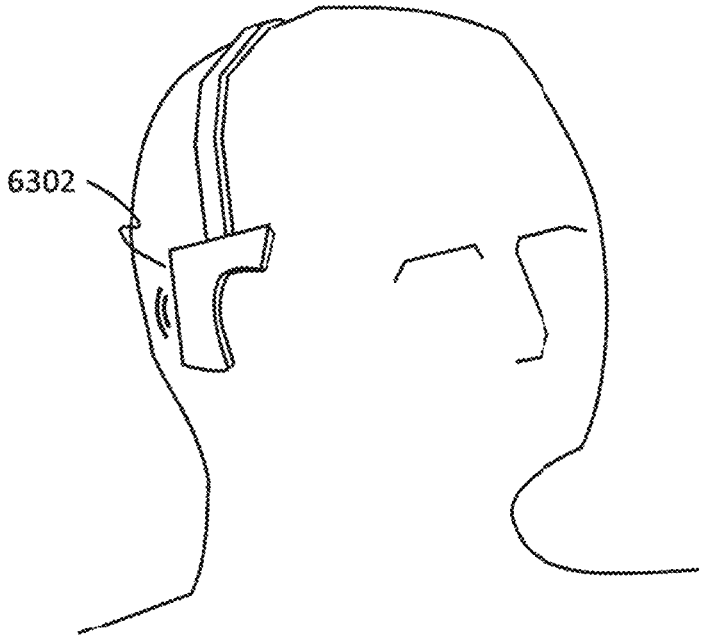
FIG. 63 illustrates an exemplary tactile transducer-equipped headset that permits a user to achieve tactile low-bass stimulation while still being exposed to a outside sounds

FIG. 63 shows a headset that provides this capability. Instead of an earcup that completely covers the wearer's ears, a housing 6302 contacts the user's head without covering the ear. A variety of shapes for such a housing are possible, including a ring surrounds the user's ear. Alternatively the housing that contact area can be in the form of a semicircle, an arc of less than 360 degrees, a straight vertical line or another shape. Each such housing includes one or more tactile transducers. The headset may also include a radio receiver, so that the headset may be used wirelessly in an environment such as a movie theater. Alternatively, the headset can be connected by wire to, for example, an armrest much as is frequently used on airplanes. Rather than feeding the headset the full range of frequencies to the headset, only tactile frequencies may be transmitted and reproduced. In one possible implementation, the arrival time of the tactile signal may be dependent on the location of a given seat in a large theater, so that the tactile signal is properly synchronized with the arrival time of the acoustic sound delivered by the main speaker systems.

Alternatively, tactile transducers may be included in devices that contact other parts of a wearer's body, such as the neck or shoulders or upper back.

When combined with a multi-channel sound system in an environment such as a movie theater, a headset or other device as disclosed can be used to deliver an immersive experience that includes the full range of frequencies down to infrasonic range without the bleeding between theaters or other rooms that are common when those frequencies are produced acoustically.

The same approach can also be implemented with a more traditional open back headphone. Because an open back headphone is (more or less) acoustically transparent to the outside environment, the same approach can be employed. As long as the headphone is largely open acoustically, the effect can be similar. However, in order to deliver this functionality, it will be necessary to either (i) transmit only the tactile frequencies to the open-back headset, or (ii) equip the open-back headset with a switch or other means for turning off the acoustic transducers in the headphone. If provided with a personal volume control for acoustic output, such a device would also permit customization of sound levels on a per viewer/listener basis, as opposed to the one-size-fits-all level that normally is found in a movie theater, concert venue, etc.

An additional capability that may be employed with such an open back headphone is to direct specific sounds to the headset in higher frequency ranges. Thus for example, if a character on screen is whispering to another character, that whisper could be directed not to the speakers mounted on the walls of the theater, but to the appropriate transducer in the headset.

As discussed above, another area in which tactile low-frequency drivers can be desirable is gaming. One specialized case which provides a demanding test of headphones is that experienced at elite competitive levels of gaming. E-sports tournaments between top teams can now take place in arenas in front of thousands or even tens of thousands of fans. Team play requires coordination and communication between team members. Gaming headsets generally include microphones to facilitate the required conversations. When those fans are cheering, the ambient noise levels can be high enough to interfere with the ability of team members to hear each other. So when playing before a crowd, elite gamers may resort to wearing both in-ear and over-ear headphones simultaneously in order to maximize isolation from that noise, using the over-the-ear headphones passively only for their noise-isolation.

As discussed above, tactile transducers can improve performance in gaming because the tactile neural pathway provides faster reaction times. It would therefore be advantageous to provide a way to enable tactile stimulation in the two-headphone context.

One aspect of the invention is to include circuitry and components that enable a tournament mode in over-the-ear headphones incorporating tactile transducers. Those components could include hardware or software switching to mute or attenuate the audio driver, but leave the tactile transducers active. This approach can also be applied to an over-the-ear headphone that also includes active noise cancellation. Preferably tournament mode in such a device would mute game sounds, but ANC would remain active.

As discussed above, one method for enhancing the frequency response of a tactile transducer as described is to provide mechanical damping of its primary resonance with a fluid such as a ferrofluid.

One challenge associated with that approach is that the performance characteristics of the transducer can be dependent on the precise amount of fluid deployed. Too much fluid may overdamp the transducer, thereby reducing output unnecessarily; too little fluid may not adequately reduce the resonance.

Accurately dispensing small quantities of fluids (which may be on the order of microliters) can be challenging in a production environment. It would therefore be advantageous to provide a method for reducing the criticality of the quantity of fluid used to damp the transducer.

Figure 64:
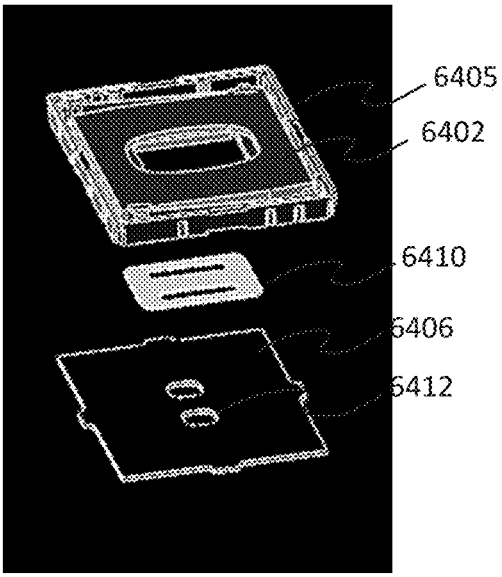
FIG. 64 illustrates a configuration for a tactile transducer that reduces the criticality of the quantity of damping fluid in a fluid-damped transducer.

FIG. 64 shows a configuration for a fluid-damped tactile transducer that reduces the criticality of the quantity of damping fluid. Moving member 6402 is retained by resilient members 6404*a* and 6404*b*, and moves within a space defined by frame 6405 and plates 6406 and 6408. Damping fluid 6410 is dispensed into the gap between mass 6402 and plate 6406. The degree of damping effected by the damping fluid is a function of several factors, including the viscosity of the fluid and the contact area between the fluid and both the moving mass and the opposing plate. When the surface of both plate 6406 and mass 6402 are effectively continuous in the relevant areas, there is a roughly linear relationship between the amount of fluid and the effect on frequency response.

Providing openings 6412 in plate 6406, reduces the contact area between the mass and the plate. It also provides volume into which unneeded damping fluid can flow without affecting damping.

Numerous researchers have begun to examine the effects of various forms of stimulation intended to affect brain wave activity. Specifically, it is believed that brain waves associated with different states of awareness or relaxation have differing frequencies. For example, the waves associated with relaxation are commonly called alpha waves, and are thought to have a frequency range of 8-12 Hz, while the waves generally associated with alertness, called beta waves, have a frequency range of 12 Hz and higher.

A number of people have experimented with the use of headphones to generate signals based on the frequencies of the brainwaves they seek to encourage. It is believed that by externally generating these signals at the desired frequency, it is possible to help the brain itself to generate waves at the same frequencies, and thereby entered a more relaxed state, in a process called brainwave entrainment.

One of the challenges in generating these waves using the prior art is that the desirable waves are at frequencies that are below the normal range of audio transducers. A further challenge is that even if a traditional acoustic transducer can be made to generate the required frequencies, the human ear is not very sensitive to them. For these reasons, brain wave entrainment has generally been attempted using the phenomenon of interaural beats. Interaural beats take advantage of psychoacoustics to combine a frequency played in one ear with a different frequency played in the other ear to synthesize a third signal that exists only in the listener's brain. If, for example a 200 Hz tone plays in one ear, and a 210 Hz tone plays in the other ear (frequencies easily generated by conventional headphone drivers), the two signals "beat" against each other at 10 Hz, and a 10 Hz signal is perceived by the listener.

This is the process that has been employed by previous efforts to generate low-frequency brain waves. A significant drawback to this system is that in order to generate, say a 10 Hz interaural beat signal at a given amplitude, it is necessary to produce the two higher frequency signals that beat against each other. It is not possible with this approach to allow the user to perceive only the 10 Hz signal. The higher frequency signal is likely to be in a region that the human perceptual system is significantly more sensitive to than the desired frequency is, which may make the beating frequencies distracting and at cross purposes in terms of helping the user achieve a more relaxed state.

It would be desirable to provide a means for achieving brainwave entrainment while substantially eliminating or reducing distracting higher frequency signals.

A significant advantage of the subject invention is that it can be employed to directly generate the desired alpha wave frequencies, without also generating very obvious audio-frequency signals.

A key aspect of the entrainment mechanism is that externally producing the frequency that is desired to be reproduced in the form of brain waves will lead the brain to slowly synchronize its internal wave production to equal that of the externally produced wave. There is evidence that an open loop system can eventually achieve this result, at least in some cases.

A closed loop system—that is, a system that measures the brain wave activity of the person wearing the entrainment device, and then generates an entrainment signal that is adapted to the existing brain wave activity—could significantly improve the effectiveness of entrainment.

For example, the frequency, phase and/or intensity of the wearer's EEG in the alpha frequencies could be observed by the system, then tactile output could be ramped up that had frequency, phase and/or intensity matched to the wearer's native EEG, facilitating entrainment. The phase, intensity, and frequency content of the tactile signal could then progressively be moved closer to the target frequencies—the lower frequencies associated with greater relaxation.

In another non-limiting example, the tactile channel could signal to the user the degree to which they were achieving high alpha output.

Thus it would be desirable to provide a means for adapting brainwave entrainment signals to actual brainwaves of the user of the entrainment device.

Figure 65:
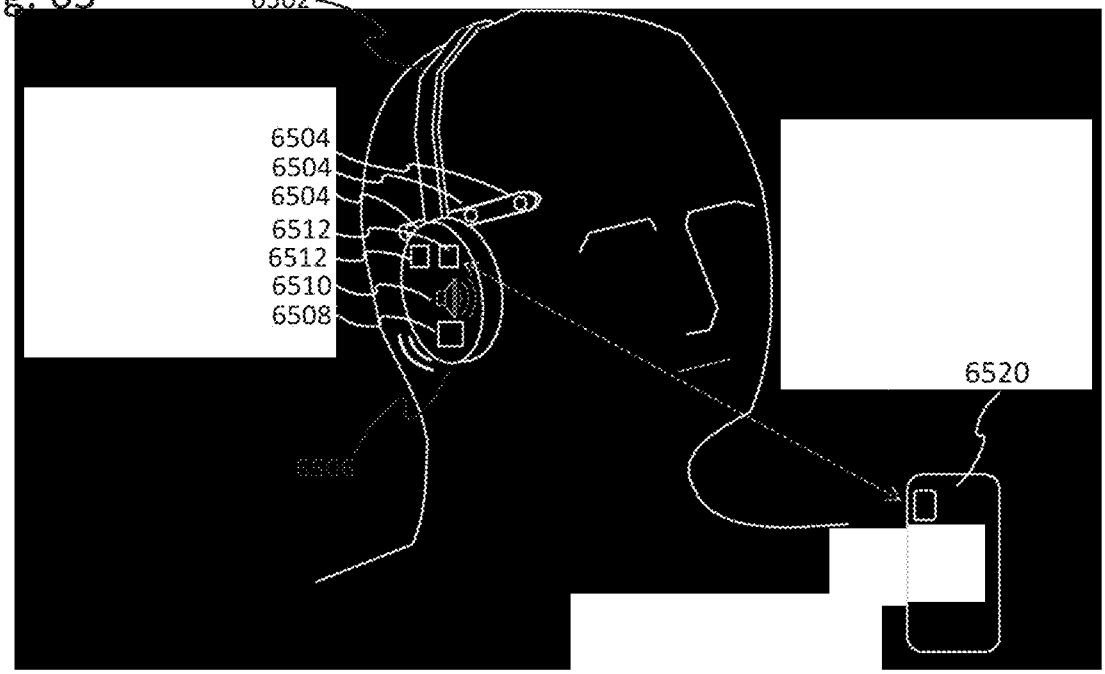
FIG. 65 illustrates a device that can be used for adapting brainwave entrainment signals to actual brainwaves of the user of the entrainment device.

FIG. 65 shows an embodiment of such a device. Band 6502 holds the device against the user's head. EEG electrodes 6504 read brain waves of the user. Earcup 6506 holds components that may include tactile transducer 6508, audio transducer 6510, EEG signal conditioning circuitry 6512, and wireless communication circuitry 6514. The headset may communicate wirelessly (or by wired connection if preferred) with a device such as a smart phone 6520. Applications running on the device 6520 can record meditation sessions, give feedback, etc.

Figure 66:
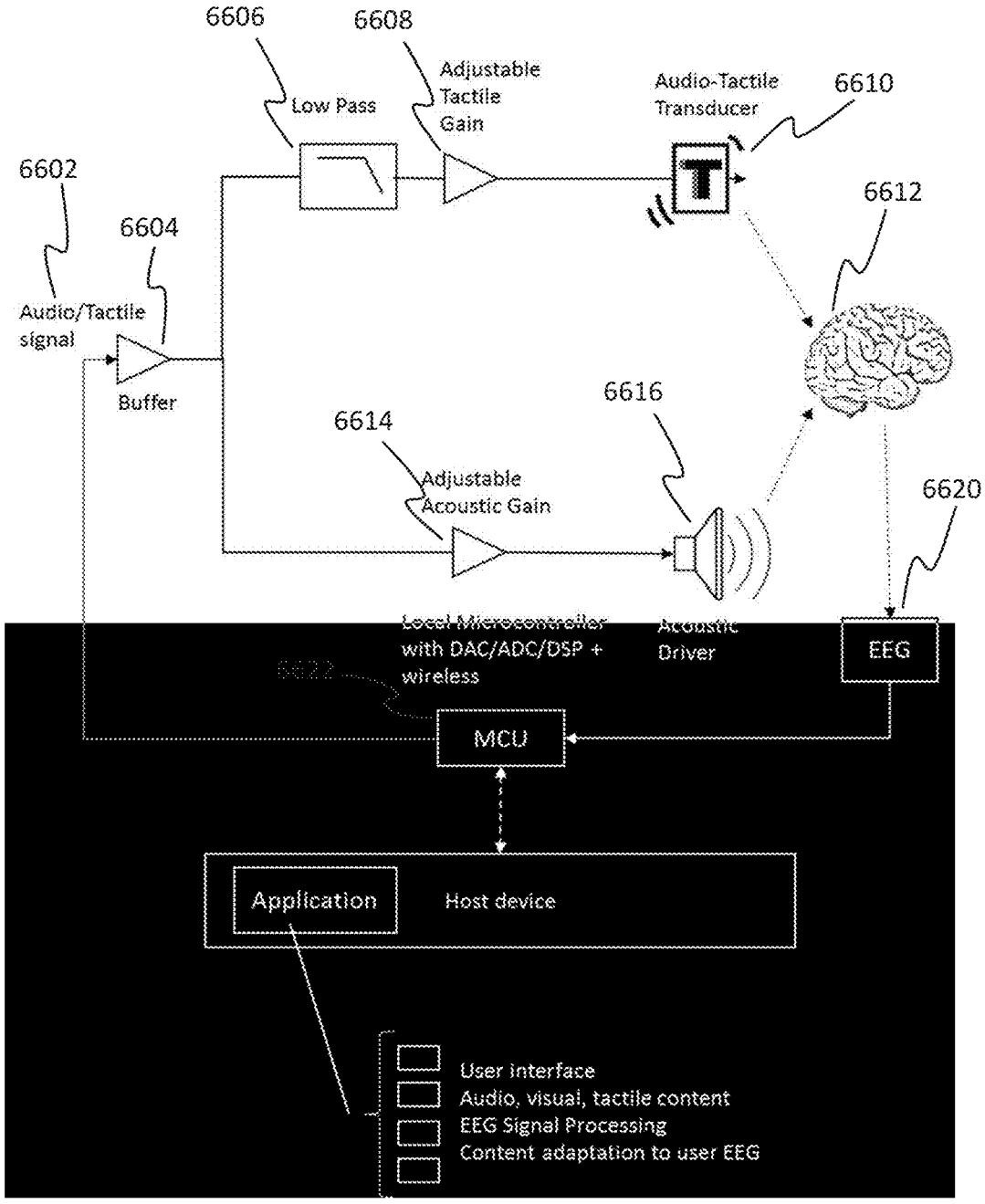
FIG. 66 is a conceptual block diagram of a device for adapting brainwave entrainment signals to actual brainwaves of the user of the entrainment device.

FIG. 66 discloses how an embodiment of this aspect of the invention could operate. Audio/tactile signal 6602 is fed to buffer 6604. Part of the signal then goes through low pass filter 6606 and adjustable gain stage 6608 and is transmitted to tactile transducer 6610, which transmits the tactile signal to the user's brain 6612. The signal is also transmitted to acoustic module 6614 and acoustic driver 6616, which also in effect transmits its signal to the brain 6612.

EEG sensor and related modules 6620 transmit the brain wave signal to the microprocessor 6622. The microprocessor uses that data to generate appropriate signals to transmit to buffer 6604.

Various methods have been disclosed for providing tactile drivers in an over-the-ear headphone. Another type of headphone that has become very popular is the in-ear headphone, or earphone. This type of device includes at least a portion that is intended to be placed inside the ear canal of the user. In some designs, the entire device is small and light enough that it can be held in place by a resilient foam, rubber or plastic component that makes contact with the ear canal. In other designs there may be a rigid or semi-rigid arm that wraps behind the user's pinnae, in a manner analogous to the arms of a pair of eyeglasses.

As wireless systems such as Bluetooth have been applied to headphones of various form factors, some in-ear headphones have been developed that include a roughly horseshoe-shaped central component that includes one or more batteries, amplification circuitry, and wireless circuitry. The in-ear portions of the headphone are connected to the horseshoe section with short wires, which may be configured so that wires retract into the horseshoe, and the in-ear components are protected by the horseshoe when the system is not in use. In some designs, the horseshoe is intended to fit loosely around the user's neck. In other designs it may be intended to fit over the user's head. The horseshoe section is generally capable of communicating wirelessly with an audio source such as, for example, a smart phone.

In-ear headphones are of course small in size, and present limited space for tactile transducers. It would therefore be desirable to offer a means for including tactile transducers that can be paired with in-ear headphones.

Figure 67:
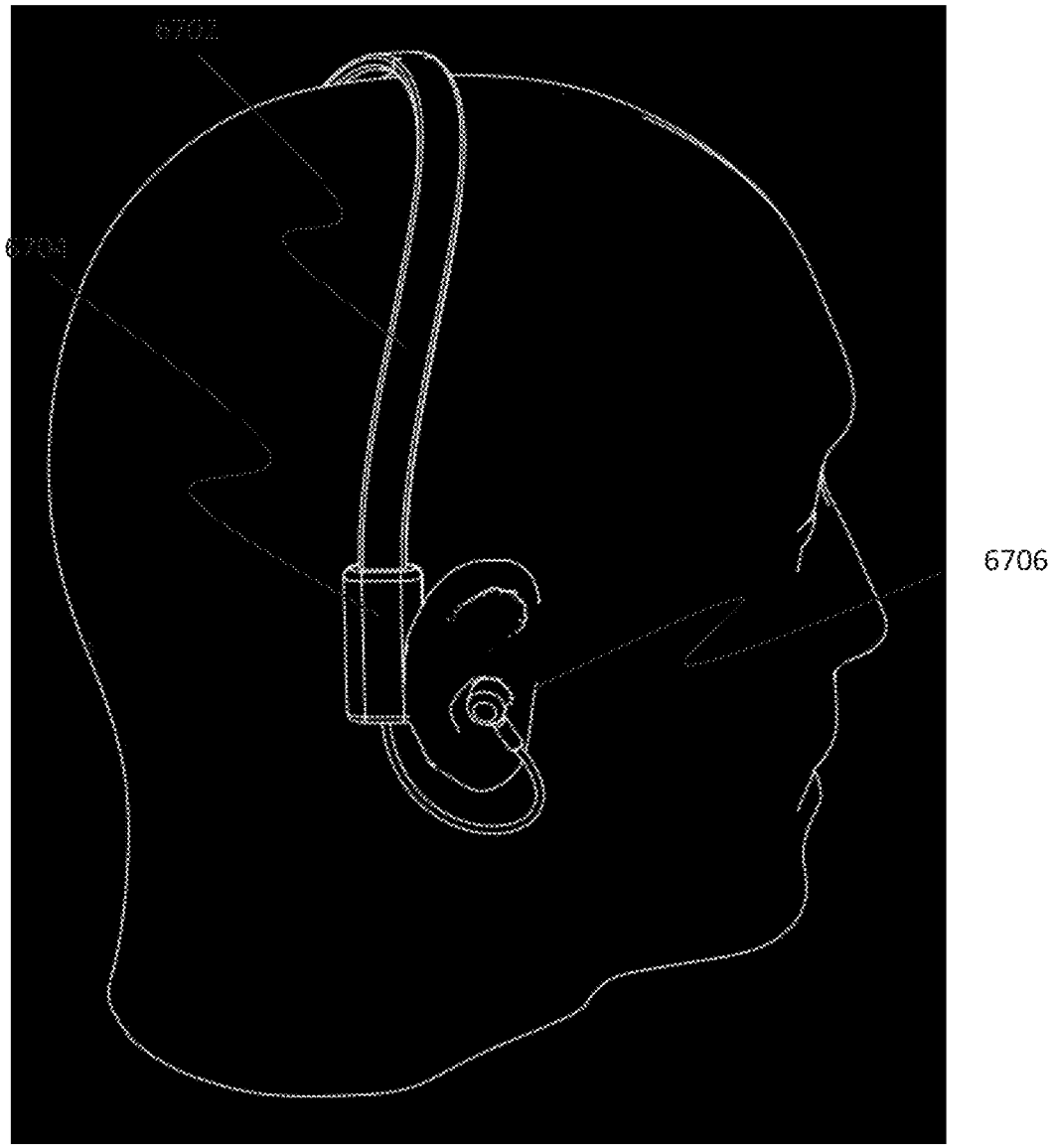
FIG. 67 illustrates an embodiment of a wireless in-ear headphone that includes tactile drivers.
Figure 68:
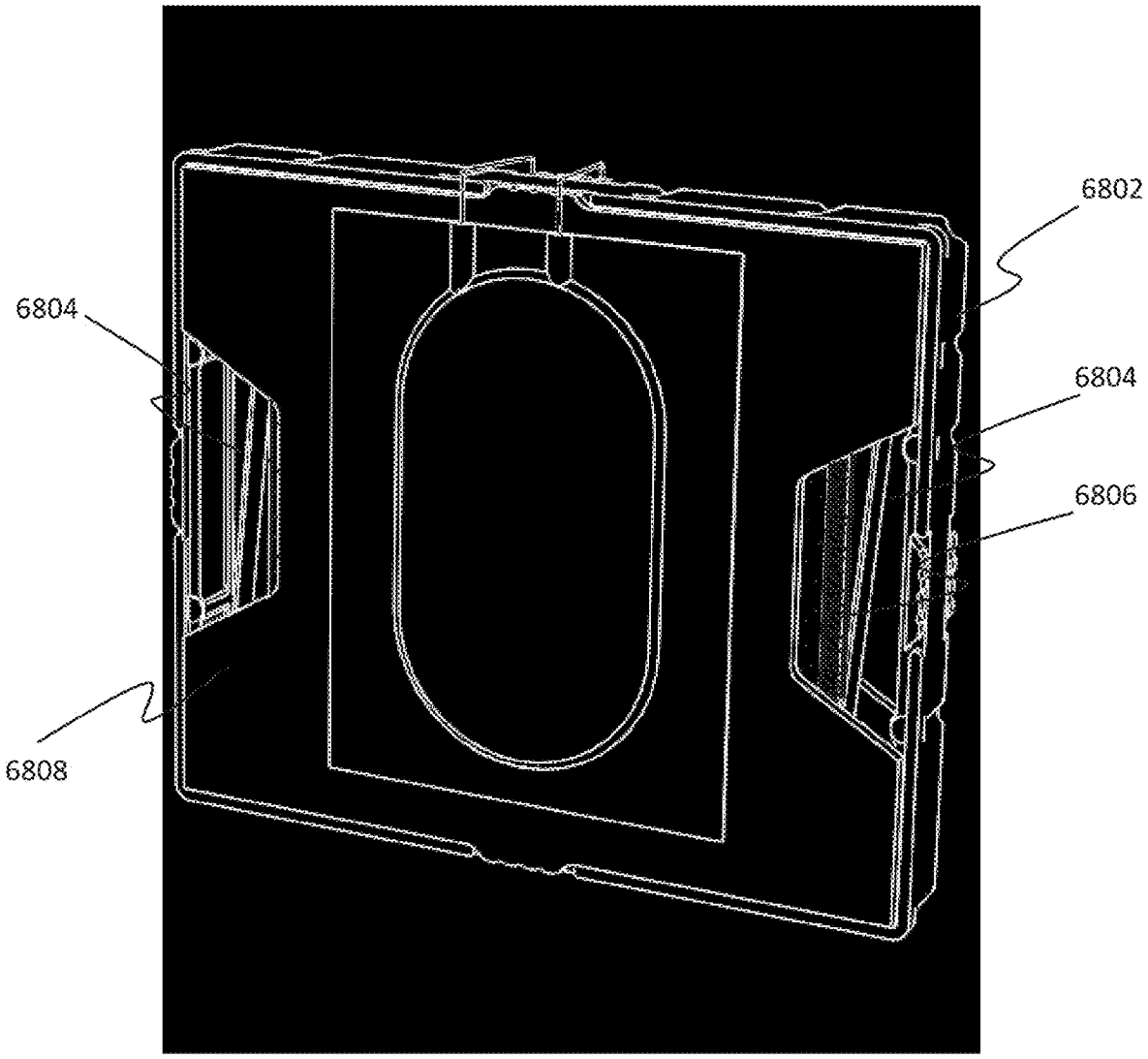
FIG. 68 illustrates an exemplary tactile transducer configured to make the movement of the moving portion of the transducer visible.
Figure 69:
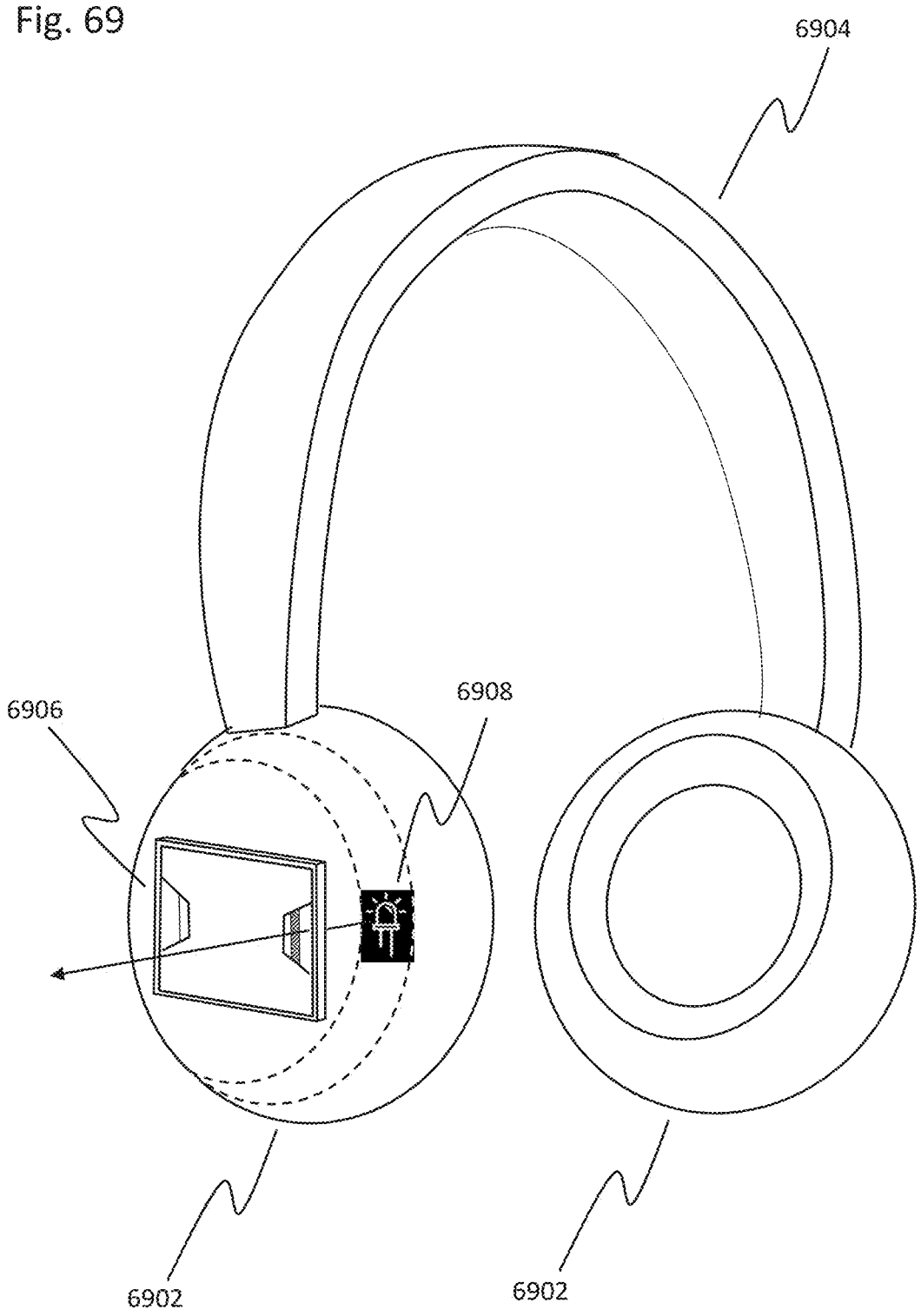
FIG. 69 illustrates an exemplary over-the-ear headphone including at least a tactile transducer visible from outside the headphone.
Figure 70A:
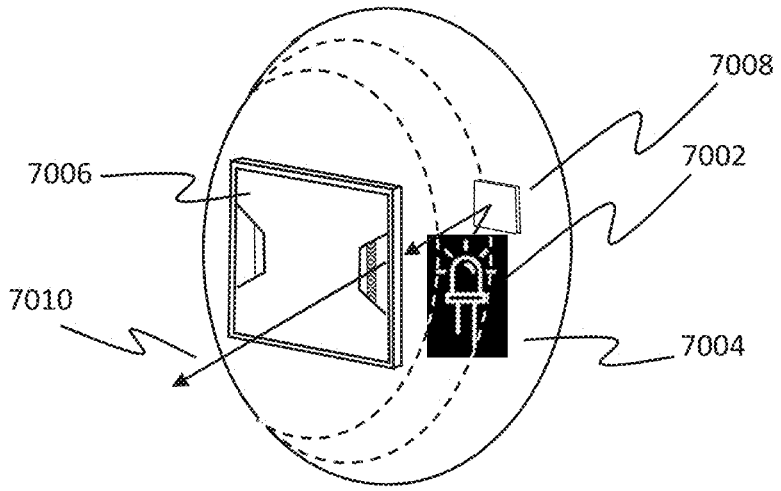
FIGS. 70*a*, 70*b* and 70*c* illustrate exemplary methods for combining a tactile transducer according to aspects of the subject invention together with elements required to illuminate the motion of the reciprocating element of the transducer
Figure 70B:
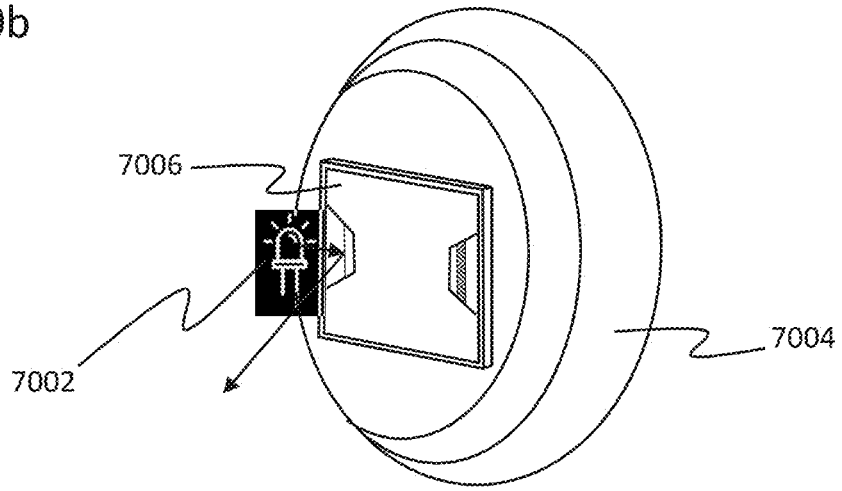
Figure 70C:
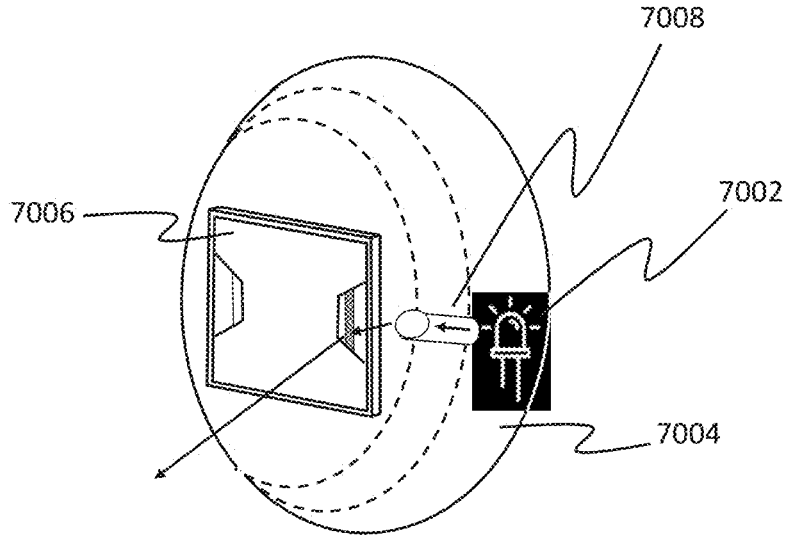
Figure 71:
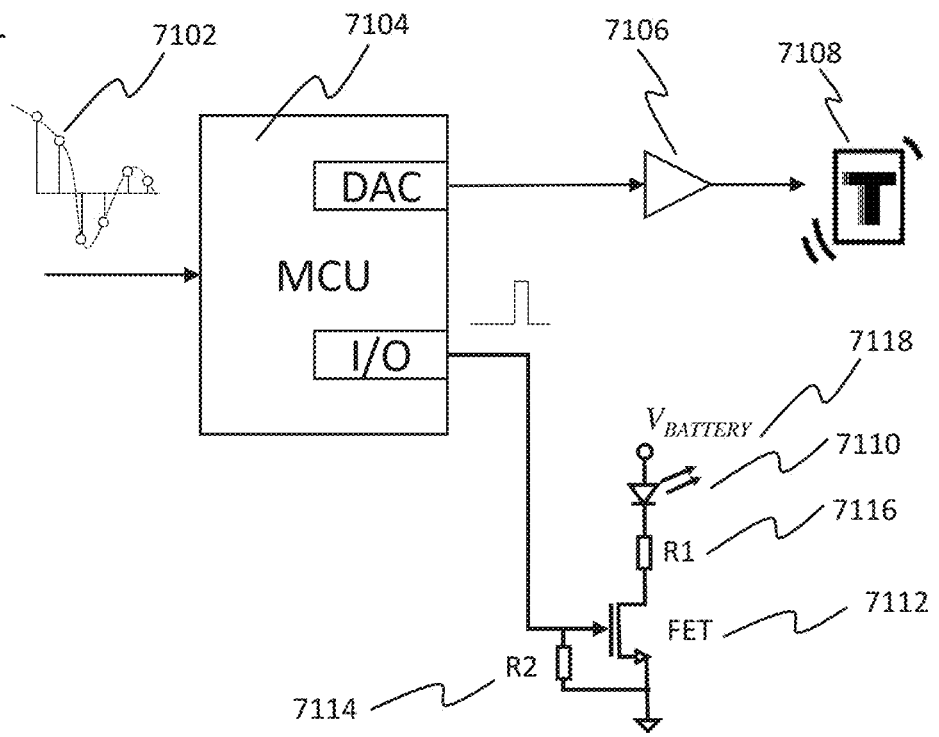
FIG. 71 is a simplified block diagram of an exemplary circuit design and components capable of dynamically cycling one or more LEDs to enhance the visibility of the motion of a tactile transducer.
Figure 72:
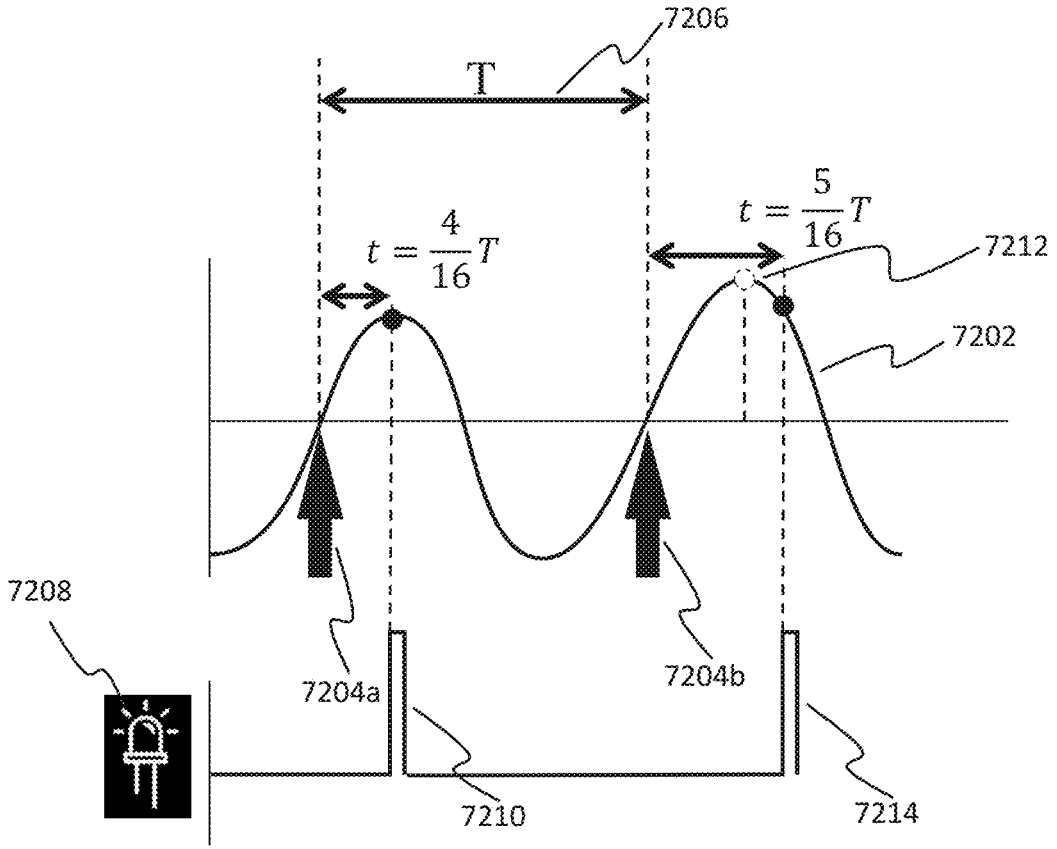
FIG. 72 is a graphic representation of an exemplary method for generating a signal to drive a light source in order to maximize the appearance of motion.
Figure 73:
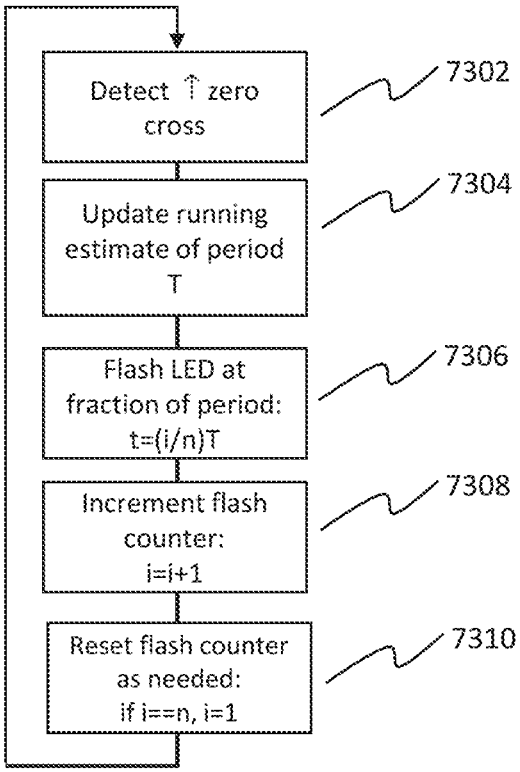
FIG. 73 is a flowchart illustrating exemplary steps that may be used to drive a light source to highlight tactile transducer motion.
Figure 74:
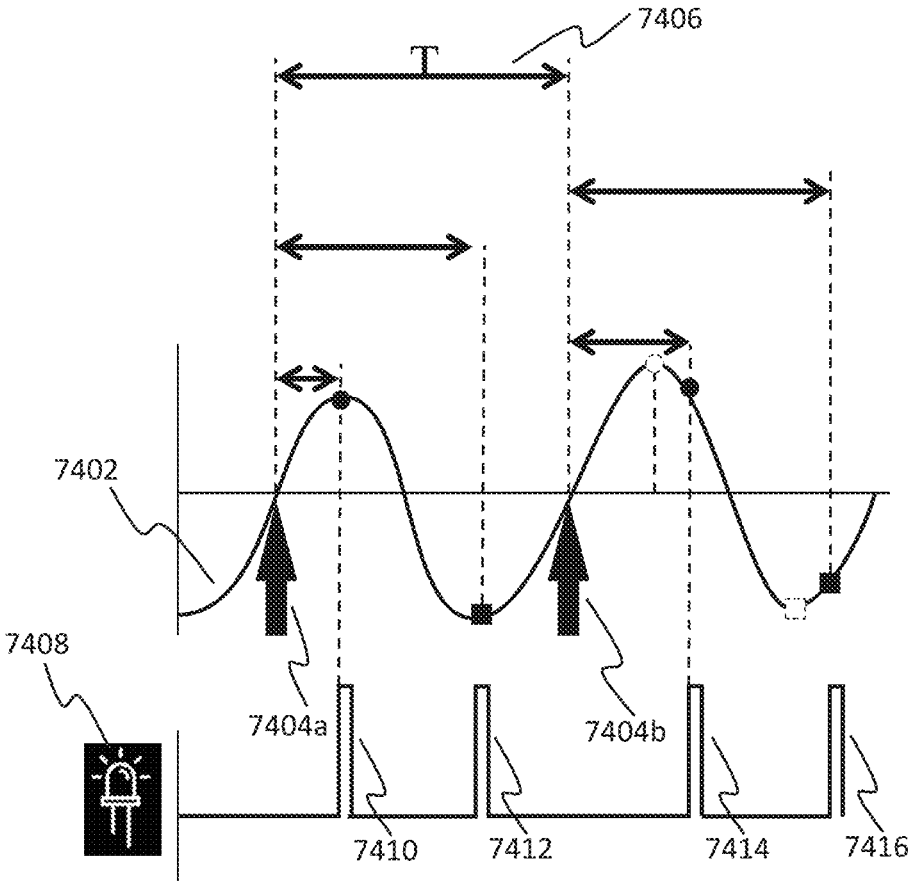
FIG. 74 is a graphic representation of another exemplary method for generating an optimal signal to drive a light source in order to maximize the appearance of motion without noticeable strobing by generating multiple pulses per period.
Figure 75:
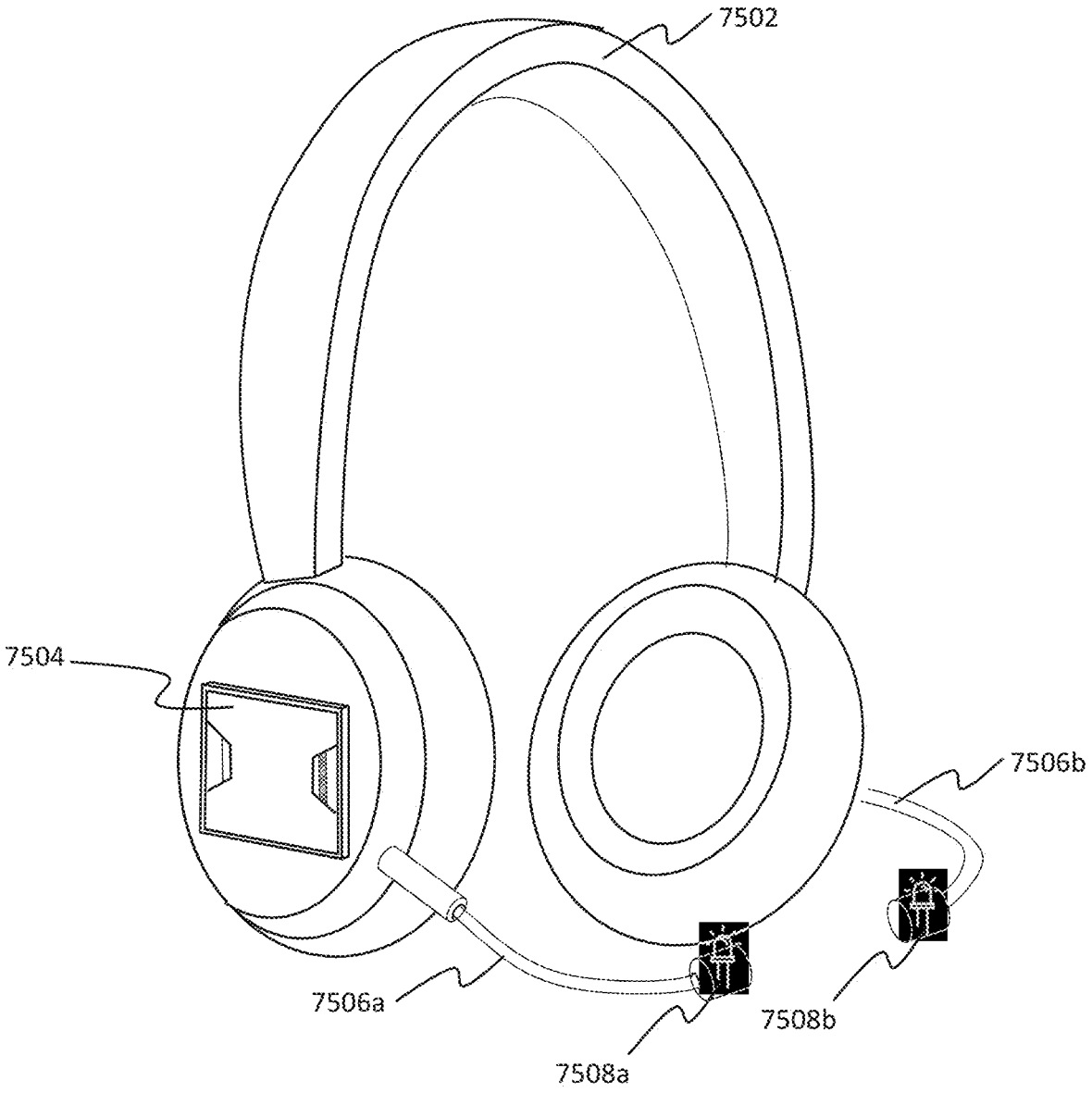
FIG. 75 is an illustration of a headset including exemplary means for providing visual cueing of low frequency content to the person wearing the headset.

FIG. 67 presents an embodiment of a wireless in-ear headphone that includes tactile drivers.

A semi-rigid, resilient band wraps 6702 around a significant portion of the wearer's head, or sits on the wearer's neck or shoulders. The band may provide means to adjust fit for a variety of head shapes and sizes. The band may contain functional components such as wireless communication circuitry, which may use protocols such as Bluetooth, 802.11 or one or more different wireless communications protocols). It may also contain analog and/or digital signal processing circuitry, one or more batteries, amplification, one or more displays, and one or more spaces for storing the attached in-ear audio drivers when the device is not in use. Each of the forgoing aspects of the device is or may be known in the prior art.

By including one or more tactile transducers 6704 and related drive circuitry in the band, and configuring them so that they transmit tactile signals to the wearer's skin, the benefits of tactile signal transmission can be delivered for users of in-ear headphones 6706.

It should be understood that the aspects, features and advantages made apparent from the foregoing are efficiently attained and, since certain changes may be made in the disclosed inventive embodiments without departing from the spirit and scope of the invention, it is intended that all matter contained herein shall be interpreted as illustrative and not in a limiting sense.

It is also to be understood that the following claims are intended to cover all of the generic and specific features of the invention herein described, and all statements of the scope of the invention that, as a matter of language, might be said to fall there between.

The systems described herein, or portions thereof, can be implemented as a computer program product or service that includes instructions that are stored on one or more non-transitory machine-readable storage media, and that are executable on one or more processing devices to perform or control the operations described herein. The systems described herein, or portions thereof, can be implemented as an apparatus, method, or electronic system that can include one or more processing devices, parallel processing devices, and memory to store executable instructions to implement various operations.

What is claimed is:

1. A method for altering a frequency response of a tactile transducer, included in a device that may be brought in contact with a user's skin, said method comprising:

digital signal processing a signal to be reproduced by a tactile transducer, said digital signal processing comprising filters with a plurality of virtual filter poles;

where a pass band of said digital signal processing lies below 500 Hz; and where said digital signal processing is employed to create at least a notch filter within the pass band to reduce at least one natural resonance of said tactile transducer.

2. A method as in claim 1 in which said digital signal processing employs infinite impulse response filtering.

3. A method as in claim 1 in which digital filtering reduces a plurality of resonances of the tactile transducer.

4. A method as in claim 1 in which said tactile transducer is oriented in said device so that it shears skin that contacts said device.

5. A method as in claim 1 in which said tactile transducer comprises a plurality of coils.

6. A method as in claim 1 in which said tactile transducer comprises a plurality of magnets.

7. A method as in claim 1 in which said device comprises a plurality of tactile transducers.

8. A method as in claim 1 in which said digital signal processing employs finite impulse response filtering.

9. A method as in claim 1 in which digital filtering comprises dynamic range compression.

10. A method as in claim 9 in which an amount of compression applied varies with signal level.

11. A system for altering a frequency response of a tactile transducer, included in a device that may be brought in contact with a user's skin, said system comprising:

at least a tactile transducer comprising at least a magnet, at least a coil of conductive wire, and a plurality of flexures connecting at least a subassembly comprising said magnet and a subassembly comprising at least said coil;

at least a microprocessor configured to perform digital signal processing of at least a signal to be reproduced by said tactile transducer, digital signal processing comprising filters with a plurality of virtual filter poles;

where a pass band of said digital signal processing lies below 500 Hz; and where said digital signal processing is employed to create at least a notch filter within the pass band to reduce at least one natural resonance of said tactile transducer.

12. A system as in claim 11 in which said digital signal processing employs infinite impulse response filtering.

13. A system as in claim 11 in which digital filtering flattens a plurality of resonances of the tactile transducer.

14. A system as in claim 11 in which said tactile transducer is oriented in said device so that it shears skin that contacts said device.

15. A system as in claim 11 in which said tactile transducer comprises a plurality of coils.

16. A system as in claim 11 in which said tactile transducer comprises a plurality of magnets.

17. A system as in claim 11 in which said device comprises a plurality of tactile transducers.

18. A system as in claim 11 in which said digital signal processing employs finite impulse response filtering.

19. A system as in claim 11 in which digital filtering comprises dynamic range compression.

20. A system as in claim 19 in which an amount of compression applied varies with signal level.

* * * * *